US007234447B2

(12) United States Patent
Okubo et al.

(10) Patent No.: US 7,234,447 B2
(45) Date of Patent: Jun. 26, 2007

(54) CONTROL DEVICE OF INTERNAL COMBUSTION ENGINE

(75) Inventors: Shigeo Okubo, Anjou (JP); Zenichiro Mashiki, Nisshin (JP); Nobuyuki Shibagaki, Toyota (JP); Hiroyuki Nomura, Toyota (JP); Yoshiyuki Shogenji, Toyota (JP); Kenichi Kinose, Okazaki (JP); Takuji Matsubara, Nagoya (JP); Yusuke Nakayama, Gotemba (JP); Yukihiro Sonoda, Sunto-gun (JP); Koji Morita, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 61 days.

(21) Appl. No.: 11/150,368

(22) Filed: Jun. 13, 2005

(65) Prior Publication Data

US 2005/0274353 A1 Dec. 15, 2005

(30) Foreign Application Priority Data

| | | |
|---|---|---|
| Jun. 15, 2004 | (JP) | 2004-177416 |
| Jul. 22, 2004 | (JP) | 2004-214443 |
| Jul. 22, 2004 | (JP) | 2004-214498 |
| Sep. 21, 2004 | (JP) | 2004-273765 |
| Sep. 21, 2004 | (JP) | 2004-273782 |
| Nov. 4, 2004 | (JP) | 2004-320973 |
| Mar. 18, 2005 | (JP) | 2005-078358 |

(51) Int. Cl.
*F02B 7/00* (2006.01)
*F02B 7/02* (2006.01)

(52) U.S. Cl. ..... 123/431; 123/520

(58) Field of Classification Search ..... 123/431, 123/500, 299, 518, 519
See application file for complete search history.

(56) References Cited

U.S. PATENT DOCUMENTS

| | | | | |
|---|---|---|---|---|
| 4,630,581 | A | 12/1986 | Shibata | |
| 4,977,881 | A | 12/1990 | Abe et al. | |
| 5,425,349 | A * | 6/1995 | Nagaishi et al. | 123/674 |
| 5,438,967 | A | 8/1995 | Ito | |
| 6,079,393 | A | 6/2000 | Tsutsumi et al. | |
| 6,079,397 | A | 6/2000 | Matsumoto et al. | |
| 6,314,940 | B1 | 11/2001 | Frey et al. | |

(Continued)

FOREIGN PATENT DOCUMENTS

DE 100 43 384 A1 3/2002

(Continued)

*Primary Examiner*—Mahmoud Gimie
(74) *Attorney, Agent, or Firm*—Oliff & Berridge, PLC

(57) ABSTRACT

When an injection sharing ratio r is neither 0 nor 1, an engine ECU executes a program including a step of calculating a purge reduction amount of an in-cylinder injector as fpg×r and calculating a purge reduction amount of an intake manifold injector as fpg×(1-r) when performing purge processing according to a current fuel injection sharing ratio of the injectors, and a step of calculating a correction fuel injection amount of the in-cylinder injector by raising the fuel injection amount to a minimum fuel injection amount, and calculating a correction fuel injection amount of the intake manifold injector by subtracting the raised amount from the fuel injection amount of the intake manifold injector when the fuel injection amount of the in-cylinder injector calculated by using the purge reduction amount is lower than the minimum injection amount.

29 Claims, 29 Drawing Sheets

U.S. PATENT DOCUMENTS

| | | | | |
|---|---|---|---|---|
| 6,363,908 | B1 * | 4/2002 | Kerns | 123/295 |
| 2003/0005916 | A1 | 1/2003 | Osanai | |
| 2005/0183698 | A1 * | 8/2005 | Yonezawa | 123/431 |
| 2005/0274368 | A1 * | 12/2005 | Itakura et al. | 123/698 |

FOREIGN PATENT DOCUMENTS

| | | | |
|---|---|---|---|
| EP | 0 532 020 | A1 | 3/1993 |
| EP | 1 074 706 | A2 | 2/2001 |
| EP | 1 384 877 | A2 | 1/2004 |
| JP | A 05-231221 | | 9/1993 |
| JP | A 07-103049 | | 4/1995 |
| JP | A 10-231758 | | 9/1998 |
| JP | A 11-107864 | | 4/1999 |
| JP | A 2001-020837 | | 1/2001 |
| JP | A 2002-081351 | | 3/2002 |
| JP | A 2003-184663 | | 7/2003 |
| JP | A 2003-247462 | | 9/2003 |
| JP | A 2004-011612 | | 1/2004 |

* cited by examiner

CONTROL DEVICE OF INTERNAL COMBUSTION ENGINE

This nonprovisional application is based on Japanese Patent Applications Nos. 2004-177416, 2004-214443, 2004-214498, 2004-273765, 2004-273782, 2004-320973, and 2005-078358 filed with the Japan Patent Office on Jun. 15, 2004, Jul. 22, 2004, Jul. 22, 2004, Sep. 21, 2004, Sep. 21, 2004, Nov. 4, 2004, and Mar. 18, 2005, respectively, the entire contents of which are hereby incorporated by reference.

BACKGROUND OF THE INVENTION

1. Field of the Invention

The present invention relates to a control device of an internal combustion engine including a first fuel injection unit (an injector for in-cylinder injection) injecting fuel into a cylinder and a second fuel injection unit (an injector for intake manifold injection) for injecting the fuel into an intake manifold or an intake port, and particularly to a control device for executing purge processing of vaporized fuel gas.

2. Description of the Background Art

A certain kind of known internal combustion engine includes an intake manifold injector for injecting fuel into an intake manifold of an engine and an in-cylinder injector for always injecting the fuel into a combustion chamber of the engine, and is configured such that the intake manifold injector stops the fuel injection when an engine load is lower than a predetermined set load, and injects the fuel when the engine load is higher than the set load. In this internal combustion engine, a total injection amount, which is a sum of amounts of the fuel injected from both injectors, is predetermined as a function of the engine load, and increases with the engine load.

Japanese Patent Laying-Open No. 2001-020837 has disclosed an internal combustion engine of a dual injection type, which includes in-cylinder injectors for injecting fuel into cylinders and intake manifold injectors injecting the fuel into an intake manifold or intake ports. In this structure, these injectors are selectively used according to an operation state of the engine for achieving, e.g., stratified charge combustion in a low load operation region and homogenous combustion in a high load operation region, and for achieving the fuel injection with a predetermined sharing ratio according to the operation state. Thereby, fuel consumption characteristics and output characteristics are improved.

Japanese Patent Laying-Open No. 05-231221 has disclosed an internal combustion engine of a fuel injection type for preventing fluctuations in engine output torque at the times of start and stop of fuel injection by an intake manifold injector of the above kind of internal combustion engine. This fuel injection internal combustion engine includes first fuel injection valves for injecting fuel into an engine intake manifold, and second fuel injection valves for injecting the fuel into engine combustion chambers, and is configured to stop the fuel injection from the first fuel injection valves when an operation state of the engine is in a predetermined operation region, and to inject the fuel from the first fuel injection valves when the operation state of the engine is outside the above predetermined operation region. This internal combustion engine includes a unit, which estimates an amount of fuel adhering to an inner wall surface of the intake manifold when the first fuel injection valve starts the fuel injection, and estimates an amount of adhered fuel flowing into the combustion chamber of the engine when the first fuel injection valve stops the fuel injection. When the first fuel injection valve starts the fuel injection, the amount of fuel to be injected from the second fuel injection valve is corrected and increased by the above amount of the adhesion fuel. When the first fuel injection valve stops the fuel injection, the amount to be injected from the second fuel injection valve is corrected and decreased by the above amount of inflow fuel.

According to the fuel injection internal combustion engine, when the first fuel injection valve starts the fuel injection, the amount of fuel to be injected from the second fuel injection valve is corrected and increased by the amount of the adhesion fuel. Thereby, the amount of fuel practically supplied to the combustion chamber of the engine is equal to a required fuel amount. When the first fuel injection valve stops the fuel injection, the amount to be injected from the second fuel injection valve is corrected and decreased by the inflow amount. Thereby, the amount of fuel practically supplied into the engine combustion chamber is equal to the required fuel amount. As a result, it is possible to prevent fluctuations in engine output torque at the time of start and stop of the fuel injection from the first fuel injection valve.

Generally, in a vehicle with an internal combustion engine, a collection device such as a canister temporarily absorbs fuel vapor produced in a fuel tank or the like, and the fuel vapor absorbed by the collection device such as canister or the like is purged and introduced into an intake system of the internal combustion engine according to an operation state of the internal combustion engine so that the fuel vapor is prevented from dispersing into an atmosphere.

As described above, when the purge processing is executed for purging the fuel vapor and introducing it into the intake system of the internal combustion engine, the purged fuel, of which amount depends on a concentration of the purged fuel vapor (i.e., a so-called purge gas concentration) and its flow rate, is introduced into the engine in addition to the fuel injected from the injector. This may cause fluctuations in air-fuel ratio to fluctuate and impair the combustion. For executing such purge processing, it is required to correct the fuel injection amount and the purged fuel amount for avoiding problems, i.e., lowering of the internal combustion engine performance and deterioration of emissions.

Japanese Patent Laying-Open No. 2002-081351 has disclosed a control device of an engine, which allows the purge of a large amount of fuel within a range not deteriorating drivability and independently of fluctuations in characteristics of each engine, and prevents releasing of vaporized fuel into an atmosphere, which may be caused when exceeding an absorption limit of a canister. This control device of the engine is configured to perform the purge by controlling a degree of opening of a purge control valve, which is arranged at a purge pipe connecting an intake manifold and a fuel tank, and includes a determining unit determining stability of a combustion state of the engine, and a control unit performing purge control to increase a purge amount when the determining unit determines that the stability of the combustion state is high, and to decrease the purge amount when the determining unit determines that the stability of the combustion is low.

This engine control device controls the purge amount based on the stability of the combustion state of the engine. Therefore, the purge of a large amount of fuel can be performed within a range not deteriorating the high drivability, independently of fluctuations in the engine, and it is possible to prevent reliably the release of the vaporized fuel due to exceeding of the absorption limit of the canister.

However, Japanese Patent Laying-Open Nos. 2001-020837 and 05-231221 have not disclosed correction of the fuel injection amount during execution of the purge processing. Therefore, the internal combustion engines of the fuel injection type disclosed in these publications cannot overcome the problems (e.g., lowering of performance due to adhesion of deposits and emission deterioration due to fluctuations in air-fuel ratio) during execution of the purge processing, although these engines can prevent fluctuations in engine output torque at the start and stop of fuel injection from the first fuel injection valve.

Further, the engine disclosed in the above Japanese Patent Laying-Open No. 2002-081351 does not have a first fuel injection unit injecting fuel into a cylinder and a second fuel injection unit injecting the fuel into an intake manifold, and it is difficult to apply this structure to the internal combustion engine having two fuel injection units (injectors).

SUMMARY OF THE INVENTION

The invention has been made for overcoming the above problems, and it is an object of the invention to provide a control device of an internal combustion engine, in which fuel injection is shared by a first fuel injection unit injecting fuel into a cylinder and a second fuel injection unit injecting fuel into an intake manifold, and particularly to provide a control device, which can avoid fluctuations in combustion of the internal combustion engine during execution of purge processing, and suppress lowering of performance and deterioration of emissions.

For achieving the above object, a control device of an internal combustion engine according to an aspect of the invention is a control device of an internal combustion engine including a first fuel injection mechanism for injecting fuel into a cylinder, and a second fuel injection mechanism for injecting the fuel into an intake manifold, and being configured to execute purge processing of fuel vapor. The control device includes a control unit for controlling the fuel injection mechanisms to inject the fuel by sharing the injection between the first fuel injection mechanism and the second fuel injection mechanism according to conditions required in the internal combustion engine, and a purge control unit for controlling the fuel injection mechanisms to correct a fuel injection amount corresponding to an introduced purged fuel amount during execution of the purge processing by sharing the correction between the first and second fuel injection mechanisms. The purge control unit includes a unit for correcting the fuel injection amount corresponding to the introduced purged fuel amount by causing the fuel injection mechanisms to share the correction according to a sharing ratio between the first and second fuel injection mechanisms.

According to the control device of the internal combustion engine, when the purge processing of the fuel vapor is performed, the correction of the fuel injection amount corresponding to the introduced purged fuel amount is performed by sharing the correction according to the injection sharing ratio between the first fuel injection mechanism (in-cylinder injector) and the second fuel injection mechanism (intake manifold injector). Therefore, no fluctuation occurs in the air-fuel ratio and the sharing ratio as a whole, and lowering of engine performance and deterioration of emissions can be avoided.

Preferably, the purge control unit includes a unit for controlling such that a basic fuel injection amount corresponding to the sharing ratio of each of the first and second fuel injection mechanisms is reduced by an amount depending oh the sharing ratio and a fuel injection correction amount corresponding to the introduced purged fuel amount, and, when the fuel injection amount reduced by the above amount is smaller than a minimum fuel injection amount of one of the first and second fuel injection mechanisms, a fuel injection amount restricted by the minimum fuel injection amount is distributed to the other of the first and second fuel injection mechanisms.

The correction of the fuel injection amount is performed such that the basic fuel injection amount corresponding to the sharing ratio between the in-cylinder injector and the intake manifold injector is reduced by the amount depending on the sharing ratio and the fuel injection correction amount corresponding to the introduced purged fuel amount. When the fuel injection amount reduced by the above amount is smaller than the minimum fuel injection amount of one of the in-cylinder injector and the intake manifold injector, the fuel injection amount restricted by the minimum fuel injection amount is distributed to the other of injectors. According to this structure, the minimum fuel injection amount of each injector is ensured so that the fuel injection amount can be controlled precisely, and the lowering of engine performance and the deterioration of emissions can be avoided.

Further preferably, the control device further includes a correction unit for correcting a sharing ratio of correction of the fuel injection amount according to fuel injection timing of the first fuel injection mechanism.

According to the structure, in which the sharing ratio of the fuel injection amount correction is corrected according to the fuel injection timing of the in-cylinder injector, it is possible to minimize an influence by the introduced purged fuel amount. Therefore, a good air-fuel mixture can be produced independently of the fuel injection timing of the in-cylinder injector, which is variable according to the operation state, and the lowering of engine performance and the deterioration of emissions can be avoided.

Further preferably, the correction unit includes a unit for modifying the sharing ratio of the correction of the fuel injection amount such that the sharing ratio of the correction of the fuel injection amount of the first fuel injection mechanism decreases as timing of the fuel injection from the first fuel injection mechanism becomes closer to a compression top dead center in a compression stroke region.

According to this structure, in which the sharing ratio of the correction of the fuel injection amount is modified such that the sharing ratio of the correction of the fuel injection amount of the in-cylinder injector decreases as the timing of the fuel injection from the in-cylinder injector becomes closer to the compression top dead center in the compression stroke region, it is possible to reduce an influence of the introduced purged fuel amount so that good stratified mixture can be formed when the fuel injection of the in-cylinder injector is performed in the compress stroke, and the lowering of engine performance and the deterioration of emissions can be avoided.

Further preferably, the control device includes a unit for correcting the fuel injection amount by an amount corresponding to a deviation of the air-fuel ratio by performing injection from the first fuel injection mechanism when an emission air-fuel ratio rapidly changes with respect to a target air-fuel ratio.

According to the structure, in which the fuel injection amount is corrected by the amount corresponding to the deviation of the air-fuel ratio by performing injection from the in-cylinder injector when the emission air-fuel ratio rapidly changes with respect to a the air-fuel ratio, since the correction by the in-cylinder injector is reflected more rapidly than that by the intake manifold injector, the deviation in air-fuel ratio of the mixture can be correctly rapidly.

Further preferably, the purge control unit includes a unit for correcting the fuel injection amount corresponding to the introduced purged fuel amount by the injection from only the second fuel injection mechanism during a transient operation.

In the transient operation, the correction of the fuel injection amount corresponding to the introduced purged fuel amount is performed by the injection from only the intake manifold injector. According to this structure, correction by the in-cylinder injector is stopped to reduce the influence on the formation of the good air-fuel mixture required for the stratified charge combustion so that the combustion stability is ensured.

For achieving the above object, a control device of an internal combustion engine according to another aspect of the invention controls an internal combustion engine, which includes a first fuel injection mechanism for injecting fuel into a cylinder, and a second fuel injection mechanism for injecting the fuel into an intake manifold, and is configured to execute purge processing of fuel vapor. The control device includes a control unit for controlling the fuel injection mechanisms to inject the fuel by sharing the injection between the first fuel injection mechanism and the second fuel injection mechanism according to conditions required in the internal combustion engine, and a purge control unit for controlling the fuel injection mechanisms to correct a fuel injection amount corresponding to an introduced purged fuel amount during execution of the purge processing by sharing the correction between the first and second fuel injection mechanisms. The purge control unit includes a unit for controlling the fuel injection mechanisms such that a ratio of the fuel injection amount of the first fuel injection mechanism with respect to a whole fuel supply amount does not change in a region of the fuel injection shared by the first and second fuel injection mechanisms.

According to the invention, the purge control unit corrects the fuel injection amount corresponding to the introduced purged fuel amount such that a change does not occur in a ratio of the fuel injected from the first fuel injection mechanism (e.g., in-cylinder injector) (with respect to the whole amount of the supplied fuel) when the purge processing is performed. Thereby, when a difference does not occur between the whole fuel supply amounts before and after the start of purge processing, the amount of fuel injected from the in-cylinder injector does not change. Thereby, as compared with the case in which the amount of fuel injected from the in-cylinder injector is reduced, e.g., by an amount corresponding to the purged fuel amount according to the sharing ratio, production of deposits can be suppressed to a higher extent because a tip temperature of the in-cylinder injector does not rise. Since the in-cylinder injector injects the fuel at a high pressure, variations in injection amount are larger than those of the second fuel injection mechanism (e.g., intake manifold injector) injecting the fuel at a low pressure. If the fuel injection amount of the in-cylinder injector is reduced, it is impossible to apply a learned value of air-fuel ratio obtained before the execution of the purge processing due to such variations. Conversely, if the amount of the fuel injected from the in-cylinder injector does not change, as in the invention, the above learned value can be applied. If the fuel injection amount of the in-cylinder injector is reduced to the vicinity of a minimum fuel injection amount, a relationship of the actual injection amount with respect to the fuel injection timing may enter a region not having linearity in relationship between the actual injection amount and the fuel injection timing. Therefore, if the fuel injection amount of the in-cylinder injector is reduced, more significant disadvantages may occur. If the amount of fuel injected from the in-cylinder injector does not change, as in the invention, the above disadvantage can be avoided. As described above, when the purge processing is executed, the fuel injection amount of the intake manifold injector is changed without changing the fuel injection amount of the in-cylinder injector, and thereby the fuel injection amount is corrected corresponding to the purged fuel amount so that the control of the air-fuel ratio can be performed satisfactorily as a whole. Therefore, the deterioration of emissions can be prevented, and the lowering of engine performance due to adhesion of deposits can be prevented. Consequently, for the internal combustion engine in which the fuel injection is shared between the in-cylinder injector and the intake manifold injector, it is possible to provide the control device that can avoid the lowering of performance of the internal combustion engine and the deterioration of emissions when executing the purge processing.

Preferably, the purge control unit includes a unit for performing control not to change the fuel injection amount of the first fuel injection mechanism.

According to the invention, when the purge processing is performed, the fuel injection amount of the in-cylinder injector is kept unchanged, and the fuel injection amount is corrected corresponding to the purged fuel amount by changing the fuel injection amount of the intake manifold injector instead of the fuel injection amount of the in-cylinder injector so that the air-fuel ratio can be controlled satisfactorily as a whole. Therefore, the deterioration of emissions can be prevented, and the lowering of engine performance due to adhesion of deposits can be prevented.

Preferably, the purge control unit includes a unit for performing control to change only the fuel injection amount of the second fuel injection mechanism.

According to the invention, when the purge processing is executed, the fuel injection amount is corrected corresponding to the purged fuel amount by changing only the fuel injection amount of the intake manifold injector, and thereby the air-fuel ratio can be controlled satisfactorily as a whole. Therefore, the deterioration of emissions can be prevented. Since the fuel injection amount of the in-cylinder injector is not reduced, an injection hole of the in-cylinder injector does not become hot so that the lowering of engine performance due to adhesion of deposits can be prevented.

More preferably, the purge control unit includes a unit for performing control such that the second fuel injection mechanism injects the fuel of an amount calculated by subtracting the purged fuel amount from a basic fuel injection amount of the second fuel injection mechanism.

According to the invention, the purged fuel amount is subtracted from the fuel injection amount of the intake manifold injector included in a basic fuel amount, which is determined from an engine speed and a load factor of the internal combustion engine, so that the fuel injection amount of the in-cylinder injector is kept unchanged. Therefore, the air-fuel ratio control can be performed satisfactorily as a whole so that the deterioration of emissions can be prevented. Since the fuel injection amount of the in-cylinder injector does not decrease, an injection hole of the in-cylinder injector does not become hot so that the lowering of engine performance due to adhesion of deposits can be prevented.

For achieving the above object, a control device of an internal combustion engine according to still another aspect of the invention controls an internal combustion engine, which includes a first fuel injection mechanism for injecting fuel into a cylinder, and a second fuel injection mechanism for injecting the fuel into an intake manifold, and is configured to execute purge processing of fuel vapor. The control device includes a control unit for controlling the fuel injection mechanisms to inject the fuel by sharing the injection between the first fuel injection mechanism and the second fuel injection mechanism according to conditions required in the internal combustion engine, and a purge control unit for controlling the fuel injection mechanisms to correct a fuel injection amount corresponding to an introduced purged fuel amount during execution of the purge processing by using at least one of the first and second fuel injection mechanisms. The purge control unit includes a unit for controlling the fuel injection mechanisms to ensure a normal operation of the first fuel injection mechanism in a region of the fuel injection shared by the first and second first and second fuel injection mechanisms.

According to the invention, when the purge processing is executed, the purge control unit controls the fuel injected from the first fuel injection mechanism (e.g., in-cylinder injector) (1) not to change the amount thereof, (2) to suppress changing or (3) to change the amount thereof only when the intake manifold injector cannot be used for correction, and thereby, the fuel injection amount corresponding to the introduced purged fuel amount is corrected. This can prevent or minimize the difference between amounts of the injected fuel of the in-cylinder injector before and after the start of purge processing. Thereby, as compared with the case in which the amount of fuel injected from the in-cylinder injector is reduced by a fuel injection amount corresponding to the purged fuel amount, e.g., according to the sharing ratio, production of deposits can be suppressed because a tip temperature of the in-cylinder injector does not rise. Since the in-cylinder injector injects the fuel at a high pressure, variations in injection amount are larger than those of the second fuel injection mechanism (e.g., intake manifold injector) injecting the fuel at a low pressure. If the fuel injection amount of the in-cylinder injector is reduced, it is impossible to apply a learned value of air-fuel ratio before the execution of the purge processing due to such variations. Conversely, if the amount of the fuel injected from the in-cylinder injector does not change or does not easily change, as in the invention, the above learned value can be applied. If the fuel injection amount of the in-cylinder injector is reduced to the vicinity of a minimum fuel injection amount, a relationship of the actual injection amount with respect to the fuel injection timing may enter a region not having linearity. Therefore, if the fuel injection amount of the in-cylinder injector is reduced, a more significant disadvantage may occur. If the amount of fuel injected from the in-cylinder injector does not change or does not easily change, as in the invention, the above disadvantage can be avoided. As described above, when the purge processing is executed, the fuel injection amount of the intake manifold injector is changed without changing the fuel injection amount of the in-cylinder injector so that the change in fuel injection amount of the in-cylinder injector is suppressed as far as possible, and the normal operation of the in-cylinder injector can be ensured. By correcting the fuel injection amount corresponding to the purged fuel amount, the control of air-fuel ratio can be performed satisfactorily as a whole. Therefore, the deterioration of emissions can be prevented, and the lowering of engine performance due to adhesion of deposits can be prevented. Consequently, for the internal combustion engine in which the fuel injection is shared between the in-cylinder injector and the intake manifold injector, it is possible to provide the control device which can avoid the lowering of performance of the internal combustion engine and the deterioration of emissions when executing the purge processing.

Preferably, the purge control unit includes a unit for controlling the fuel injection mechanisms such that the second fuel injection mechanism is used for the correction, and the fuel injection amount of the first fuel injection mechanism does not change.

According to the invention, when the purge processing is performed, the purge control unit corrects the fuel injection amount corresponding to the introduced purged fuel amount while preventing the change in amount of the fuel injected from the in-cylinder injector. Thereby, no difference occurs between amounts of the fuel injected from the in-cylinder injector before and after the start of purge processing. Thereby, as compared with the case in which the amount of fuel injected from the in-cylinder injector is reduced, e.g., by the fuel injection amount corresponding to the purged fuel amount according to the sharing ratio, the fuel injection amount of the in-cylinder injector does not decrease so that the tip temperature of the in-cylinder injector does not rise. Therefore, production of deposits can be prevented, and a normal operation of the in-cylinder injector can be ensured.

More preferably, the purge control unit includes a unit for controlling the fuel injection mechanisms such that a rate of correction using the second fuel injection mechanism is larger than a ratio of correction using the first fuel injection mechanism.

According to the invention, when the purge processing is executed, the purge control unit performs the control such that the ratio of correction using the intake manifold injector is larger than the ratio of correction using the in-cylinder injector. Thereby, the correction of the fuel injection amount corresponding to the introduced purged fuel amount is performed while suppressing the change in amount of the fuel injected from the in-cylinder injector as far as possible. Thereby, it is possible to suppress a difference that may occur between amounts of the fuel injected from the in-cylinder injector before and after the start of purge processing. Thereby, as compared with the case in which the amount of fuel injected from the in-cylinder injector is reduced, e.g., by the fuel injection amount corresponding to the purged fuel amount according to the sharing ratio, the fuel injection amount of the in-cylinder injector hardly decreases so that the tip temperature of the in-cylinder injector hardly rises. Therefore, production of deposits can be prevented, and a normal operation of the in-cylinder injector can be ensured.

More preferably, the purge control unit includes a unit for controlling the fuel injection mechanisms such that the correction using the first fuel injection mechanism is not performed until an amount of correction using the second fuel injection mechanism exceeds a maximum correction amount.

According to this invention, when the purge processing is executed, the purge control unit performs the correction such that the fuel injected from the in-cylinder injector does not change until the amount of correction by the intake manifold injector exceeds the maximum correction amount, and the fuel injection amount corresponding to the introduced purged fuel amount is corrected by using the intake manifold injector as far as possible. Thereby, it is possible to set a wide region in which a difference does not occur between the amounts of fuel injected from the in-cylinder injector before and after the start of purge processing. Thereby, as compared with the case in which the amount of fuel injected from the in-cylinder injector is reduced, e.g., by the fuel injection amount corresponding to the purged fuel amount according to the sharing ratio, it is possible to expand the region in which the fuel injection amount of the in-cylinder injector does not decrease, and the tip temperature of the in-cylinder injector does not rise in this region. Therefore, production of deposits can be prevented, and a normal operation of the in-cylinder injector can be ensured.

For achieving the above object, a control device of an internal combustion engine according to yet another aspect of the invention controls an internal combustion engine, which includes a first fuel injection mechanism for injecting fuel into a cylinder, and a second fuel injection mechanism for injecting the fuel into an intake manifold, and is configured to execute purge processing of fuel vapor. The control device includes a control unit for controlling the fuel injection mechanisms to inject the fuel by sharing the injection between the first fuel injection mechanism and the second fuel injection mechanism according to conditions required in the internal combustion engine, and an adjusting unit for adjusting the purged fuel amount. The adjusting unit includes a unit for adjusting the purged fuel amount corresponding to a change of a state caused by the control unit from the state of injecting the fuel from the second fuel injection mechanism to the state of not injecting the fuel, or from the state of not injecting the fuel from the second fuel injection mechanism to the state of injecting the fuel.

According to the invention, the purge amount is adjusted when the fuel injection is switched (1) from the injection only by the second fuel injection mechanism (e.g., intake manifold injector) to the injection only by the first fuel injection mechanism (e.g., in-cylinder injector), (2) from the injection only by the in-cylinder injector to the injection only by the intake manifold injector, (3) from the injection only by the in-cylinder manifold injector to the injection by the intake manifold injector and the in-cylinder injector, or (4) from the injection by the in-cylinder injector and the intake manifold injector to the injection only by the in-cylinder manifold injector. In the above cases (1) and (4), the intake manifold injector does not inject the fuel. Since the intake manifold injector does not inject the fuel, the temperatures of the intake manifold and the intake port rise, and the purge flow rate (purged fuel amount) and the wall adhesion amount of the purged fuel change (decrease) so that the amount of fuel taken into the combustion chamber changes to cause variations in air-fuel ratio, and the combustion fluctuations occur. In the foregoing cases (2) and (3), the intake manifold injector starts the fuel injection. Since the intake manifold injector starts the fuel injection, the temperatures of the intake manifold and the intake port decrease, and the purge flow rate (purged fuel amount) and the wall adhesion amount of the purged fuel change (increase) so that the amount of fuel taken into the combustion chamber changes to cause variations in air-fuel ratio, and the combustion fluctuations occur. Therefore, when the fuel injection changes in the above manner, the adjusting unit reduces the purge amount, or stops the purge processing to suppress the combustion fluctuations due to the influence of the purge processing. Consequently, in the internal combustion engine in which the fuel injection is shared between the first fuel injection mechanism injecting the fuel into the cylinder and the second fuel injection mechanism injecting the fuel into the intake manifold, it is possible to provide the control device which can avoid the combustion fluctuations of the internal combustion engine during the execution of the purge processing, and thereby can suppress the lowering of performance and the deterioration of emissions.

Preferably, the adjusting unit includes a unit for reducing the purged fuel amount corresponding to the change of the state.

According to the invention, when the second fuel injection mechanism (e.g., intake manifold injector) stops or starts the fuel injection, the purged fuel amount can be reduced to suppress the influence by the purge processing.

More preferably, the adjusting unit includes a unit for adjusting the purged fuel amount to zero corresponding to the change of the state.

According to the invention, when the second fuel injection mechanism (e.g., intake manifold injector) stops or starts the fuel injection, the purged fuel amount can be set to zero so that the influence by the purge processing can be suppressed to the maximum extent.

Further preferably, the adjusting unit includes a unit for adjusting the purged fuel amount corresponding to the change of the state and based on the operation state of the internal combustion engine.

According to the invention, when the second fuel injection mechanism (e.g., intake manifold injector) stops or starts the fuel injection, the purged fuel amount can be reduced to an appropriate value corresponding to an operation state of the internal combustion engine so that the influence of the purge processing can be suppressed appropriately.

Further preferably, the adjusting unit includes a unit for adjusting the purged fuel amount until a predetermined time elapses after the change of the state.

According to the invention, the adjusting unit limits the time in which the purge processing is stopped by reducing the purged fuel amount or setting it to zero, and the purge processing will be resumed when the combustion fluctuations can be prevented at the time of stop or start of the fuel injection by the second fuel injection mechanism such as intake manifold injector (i.e., when the predetermined time elapses). Thereby, the primary object of the purge processing can be achieved.

Further preferably, the adjusting unit includes a unit for performing the adjustment by gradually changing the purged fuel amount to return to a desired purged fuel amount after the predetermined time elapses.

According to the invention, the purged fuel amount is gradually returned, and thereby the air-fuel ratio can be gradually changed so that no problem occurs in a follow-up property of the air-fuel ratio control.

Further preferably, the device further includes a unit for causing the first or second fuel injection mechanism to complement the fuel by an amount corresponding to the purged fuel amount adjusted by the adjusting unit.

According to the invention, when the purged fuel amount is reduced or is set to zero, the in-cylinder injector or the intake manifold injector complements the fuel by the amount thus reduced so that a shortage of the total fuel amount can be avoided.

For achieving the above object, a control device of an internal combustion engine according to further another aspect of the invention controls an internal combustion engine, which includes a first fuel injection mechanism for injecting fuel into a cylinder, and a second fuel injection mechanism for injecting the fuel into an intake manifold, and is configured to execute purge processing of fuel vapor. The control device includes a control unit for controlling the fuel injection mechanisms to inject the fuel by sharing the injection between the first fuel injection mechanism and the second fuel injection mechanism according to conditions required in the internal combustion engine, and a purge control unit for controlling the first and second fuel injection mechanisms to correct a fuel injection amount corresponding to an introduced purged fuel amount during execution of the purge processing by sharing the correction between the first and second fuel injection mechanisms. The purge control unit includes a unit for providing a limit value in the reduction for the purge correction by the second fuel injection mechanism in a region of the fuel injection shared by the first and second fuel injection mechanisms.

According to the invention, when the purge is executed in such a region that the fuel injection is shared between the first fuel injection mechanism (e.g., in-cylinder injector) and the second fuel injection mechanism (e.g., intake manifold injector), the limit value is set for the amount of the reduction performed for the purge correction of the intake manifold injector. In a multi-cylinder internal combustion engine, if the intake manifold injector for each cylinder reduces the fuel injection amount by an amount that corresponds to the purge amount and is equal to those of the other cylinders, when a difference occurs in purge amount between the cylinders, an actual port injection amount (equal to a sum of the fuel injection amount of the intake manifold injector and the purge amount) decreases in the cylinder of which purge amount is small, and thereby such a situation may occur that the air-fuel ratio of the mixture in the combustion chamber becomes lean, and the direct injection ratio increases to lower the homogeneity in the air-fuel mixture. This causes fluctuations in combustion state, and thus deteriorates an output torque. According to the invention, the reduction related to the intake manifold injector is restricted so that a stable combustion state can be maintained even in the cylinder of a small purge amount. Consequently, in the multi-cylinder internal combustion engine in which the fuel injection is shared between the first fuel injection mechanism injecting the fuel into the cylinder and the second fuel injection mechanism injecting the fuel into the intake manifold, it is possible to provide the control device which can avoid the lowering of performance and others of the internal combustion engine.

Preferably, the purge control unit includes a unit for calculating the limit value such that fluctuations in combustion do not occur even when a difference is present in introduced purged fuel amount between the cylinders.

According to this invention, it is impossible to avoid completely the occurrence of a difference in amount of the introduced purged fuel between the cylinders. Therefore, the limit value is calculated to prevent the combustion fluctuations in the cylinder of a small purge amount so that a stable combustion state can be maintained even in the cylinder of a small purge amount.

Further preferably, the purge control unit includes a unit for providing a limit value in the reduction performed for the purge correction by the second fuel injection mechanism when the value calculated based on the ratio of the purge correction amount with respect to the basic fuel injection amount of the second fuel injection mechanism is equal to or larger than the predetermined value.

According to the invention, when the value obtained by multiplying the ratio, which is exhibited by the purge correction amount with respect to the basic fuel injection amount of the intake manifold injector, by the reduction amount of the purge amount, which may attain the maximum limit, is equal to or larger than the predetermined value, the reduction correction is limited in the purge operation of the intake manifold injector. Since the ratio of the purge correction amount with respect to the basic fuel injection amount is used, a stable combustion state can be maintained even when fluctuations occur in the basic fuel injection amount and/or the absolute value of purge correction amount.

Further preferably, the predetermined value is calculated from a function of the sharing ratios of the first and second fuel injection mechanisms.

According to this invention, the influence by increase/decrease of the purge amount increases with decrease in fuel injection ratio of the intake manifold injector. Therefore, the predetermined value can be determined to impose a further strong limit on the reduction correction performed for the purge by the intake manifold injector. Thereby, even if the fuel sharing ratio changes, a stable combustion state can be maintained.

Further preferably, the function increases the predetermined value with decrease in sharing ratio of the second fuel injection mechanism. The purge control unit includes a unit for calculating the purge correction amount in the first fuel injection mechanism by subtracting a second value obtained by multiplying the basic fuel injection amount of the second fuel injection mechanism by the predetermined value from a first value calculated based on the purge correction amount.

According to the invention, the reduction control can be further enhanced according to the sharing ratio of the intake manifold injector. Thus, the predetermined value increases with decrease in sharing ratio of the intake manifold injector, and the second value for subtraction is calculated based on the predetermined value so that the calculation is performed to provide a large purge correction amount for the in-cylinder injector as well as a small purge correction amount for the intake manifold injector. Thus, the influence by the purge increases with decrease in sharing ratio of the intake manifold injector, and therefore, the reduction amount of the purge correction by the intake manifold injector is limited more strongly.

More preferably, the purge control unit includes a unit for controlling the fuel injection mechanisms by using a correction amount calculated to limit more strongly the reduction for the purge correction by the second fuel injection mechanism with decrease in sharing ratio of the second fuel injection mechanism.

According to the invention, as the sharing ratio of the intake manifold injector decreases, the influence by the purge amount increases so that limitations are imposed more strongly on the reduction in amount performed for the purge correction by the intake manifold injector, and a stable combustion state can be maintained even when the sharing ratio of the intake manifold injector is small.

More preferably, the purge control unit includes a unit for controlling the fuel injection mechanisms to achieve the correction amount exceeding the limit value by using the first fuel injection mechanism.

According to the invention, the reduction correction is performed on the in-cylinder injector side to correct an amount which could not be corrected by correction on the intake manifold injector side, and the air-fuel ratio control can be performed as a whole.

For achieving the above object, a control device of an internal combustion engine according to a further aspect of the invention controls an internal combustion engine, which includes a first fuel injection mechanism for injecting fuel into a cylinder, and a second fuel injection mechanism for injecting the fuel into an intake manifold, and is configured to execute purge processing of fuel vapor. The control device includes a control unit for controlling the fuel injection mechanisms to inject the fuel by sharing the injection between the first fuel injection mechanism and the second fuel injection mechanism according to conditions required in the internal combustion engine, and a purge control unit for controlling the fuel injection mechanisms to correct a fuel injection amount corresponding to an introduced purged fuel amount during execution of the purge processing by sharing the correction between the first and second fuel injection mechanisms. The purge control unit includes a unit for controlling the fuel injection mechanisms to perform the correction of the fuel injection amount corresponding to the purged fuel amount by changing the fuel injection amounts of both the first and second fuel injection mechanism in a region of the fuel injection shared by the first and second fuel injection mechanisms.

According to the invention, when the purge processing is performed, the purge control unit changes both the amount of the fuel injected from the first fuel injection mechanism (e.g., in-cylinder injector) and the amount of the fuel injected from the second fuel injection mechanism (e.g., intake manifold injector) so that any of the injectors does not stop the injection. Thereby, even if the purge processing is executed, the intake manifold injector does not stop the fuel injection so that the combustion does not become instable during a transient period and others due to inhomogeneity in the air-fuel mixture during the purge processing. Since the in-cylinder injector does not stop the fuel injection, a tip temperature of the in-cylinder injector does not rise to a temperature producing deposits. Consequently, in the internal combustion engine in which the fuel injection is shared between the in-cylinder injector and the intake manifold injector, it is possible to provide the control device which can avoid the lowering of performance of the internal combustion engine during execution of the purge processing.

Preferably, the purge control unit includes a unit for controlling the fuel injection mechanisms such that the fuel injection amount corrected in the first fuel injection mechanism is equal to the fuel injection amount corrected in the second fuel injection mechanism.

According to the invention, when the purge processing is performed, the fuel injection amount is corrected corresponding to the purged fuel amount such that the fuel correction amount in the in-cylinder injector may be equal to the fuel correction amount in the intake manifold injector, and thereby the air-fuel ratio can be controlled satisfactorily as a whole. Thereby, it is possible to prevent the deterioration of emissions and the lowering of engine performance due to adhesion of deposits.

Preferably, the purge control unit includes a unit for controlling the fuel injection mechanisms such that the fuel injection amount of the first fuel injection mechanism and the fuel injection amount of the second fuel injection mechanism are corrected in accordance with a ratio of sharing of the fuel injection amount between the first fuel injection mechanism and the second fuel injection mechanism.

According to the invention, when the purge processing is executed, the fuel correction amount in the in-cylinder injector and the fuel correction amount in the intake manifold injector correct the fuel injection amounts corresponding to the purged fuel amounts according to the sharing ratio, so that the air-fuel ratio control can be satisfied as a whole. Therefore, it is possible to prevent the deterioration of emissions and the lowering of engine performance due to adhesion of deposits.

Further preferably, the purge control unit includes a unit for controlling the fuel injection mechanisms such that a ratio of sharing of the fuel injection between the first and second fuel injection mechanisms remains unchanged for the whole fuel supply amount including the purged fuel amount.

According to the invention, the ratio between the shared fuel injection amounts of the in-cylinder injector and the intake manifold injector does not change, and the same combustion state can be maintained before and after the start of purge processing.

More preferably, the purge control unit includes a unit for controlling the fuel injection mechanisms to correct the fuel injection amounts corresponding to the purged fuel amount such that linearity of the injection amount with respect to an injection time is ensured in each of the first fuel injection mechanism and the second fuel injection mechanism.

According to the invention, when the in-cylinder injector, which is an example of the first fuel injection mechanism, decreases its fuel injection amount to the vicinity of the minimum fuel injection amount in accordance with the purged fuel amount, the operation may enter a region in which linearity is not present in the relationship between the actual injection amount and the fuel injection timing. Likewise, when the intake manifold injector, which is an example of the second fuel injection mechanism, decreases its fuel injection amount to the vicinity of the minimum fuel injection amount in accordance with the purged fuel amount, the operation may enter the region in which linearity is not present in the relationship between the actual injection amount and the fuel injection timing. In these cases, the fuel injection amounts corresponding to the purged fuel amount are corrected such that the linearity may be ensured in the relationship of the injection amount of the in-cylinder injector with respect to the injection time thereof and in the relationship of the injection amount of the intake manifold injector with respect to the injection time thereof Thereby, the fuel can be injected accurately, and the air-fuel ratio can be controlled accurately.

Further preferably, the purge control unit includes a unit for controlling the fuel injection mechanisms such that, when the linearity may not be ensured in the injection amount with respect to the injection time of the first fuel injection mechanism, the fuel injection amount is corrected corresponding to the purged fuel amount within a range capable of ensuring the linearity, and the second fuel injection mechanism corrects the fuel injection amount by an amount corresponding to a shortage.

According to the invention, when the in-cylinder injector, which is an example of the first fuel injection mechanism, decreases its fuel injection amount to the vicinity of the minimum fuel injection amount, the operation may enter a region in which linearity is not present in the relationship between the actual injection amount and the fuel injection timing. In this case, the in-cylinder injector corrects the fuel injection amount corresponding to the purged fuel amount within such a range that can ensure the linearity, and the in-cylinder injector corrects the fuel injection amount by the amount corresponding to the shortage. Thereby, the in-cylinder injector can accurately inject the fuel, and the air-fuel ratio can be controlled accurately.

Further preferably, the first fuel injection mechanism is an in-cylinder injector, and the second fuel injection mechanism is an intake manifold injector.

According to the invention, in the internal combustion engine in which the fuel injection is shared between the first fuel injection mechanism, i.e., the in-cylinder injector and the second fuel injection mechanism, i.e., the intake manifold injector, which are arranged independently of each other, it is possible to provide the control device that can avoid the occurrence of instable combustion during a transient period or the like due to inhomogeneity in the air-fuel mixture during the purge processing, and to prevent such a situation that a temperature rises due to stop of the fuel injection from the in-cylinder injector, and thereby deposits are produced in an injection hole.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First to sixth embodiments of the invention will now be described with reference to the drawings. In the following description, the same portions bear the same reference numbers and the same names, and achieve the same functions. Therefore, description thereof is not repeated.

First Embodiment

Figure 1:
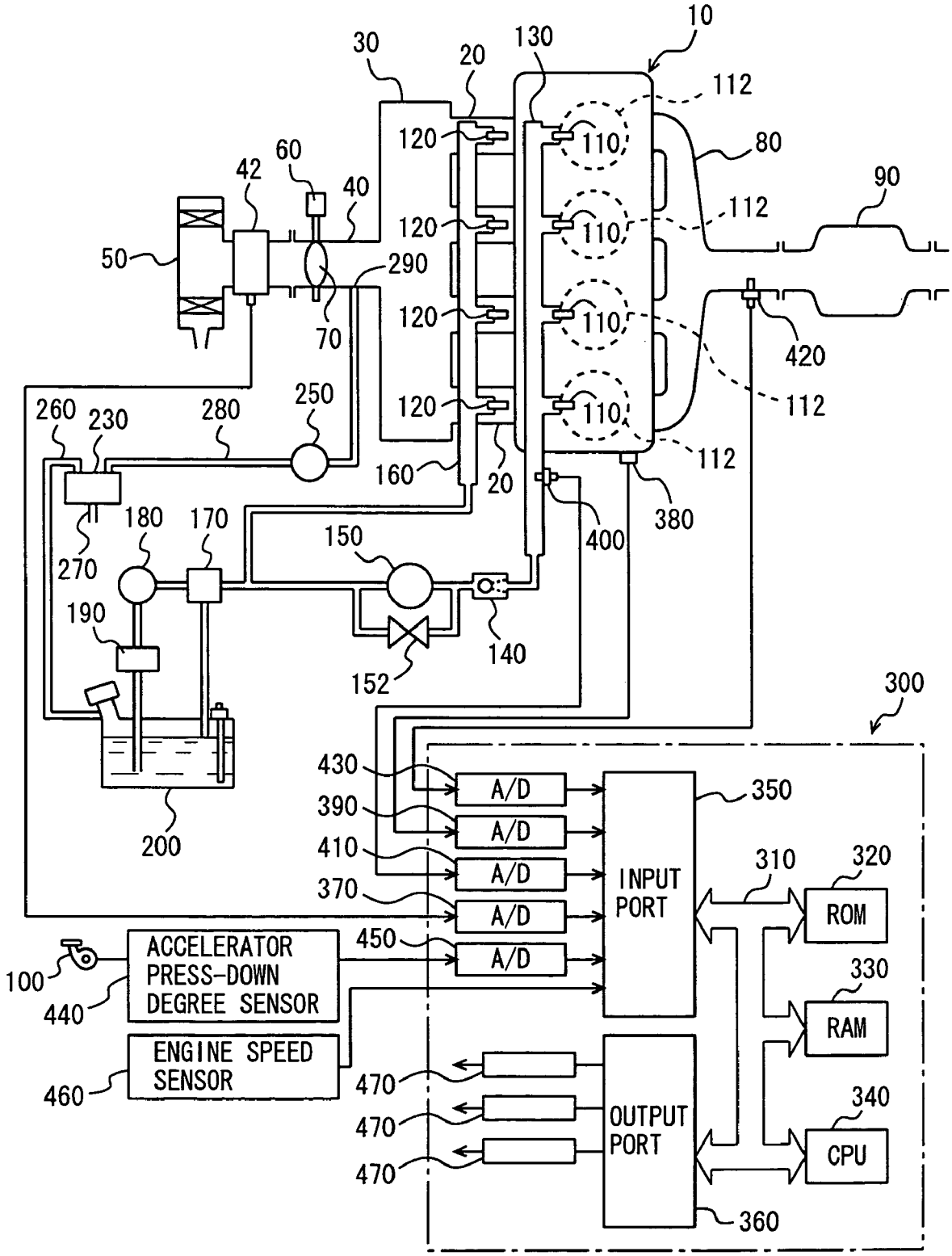
FIG. 1 shows a schematic structure of an engine system controlled by a control device according to a first embodiment of the invention.

FIG. 1 shows a schematic structure of an engine system controlled by an engine ECU (Electronic Control Unit), which is a control device of an internal combustion engine according to a first embodiment of the invention. Although FIG. 1 shows an inline four-cylinder gasoline engine, the invention is not restricted to such an engine.

As shown in FIG. 1, an engine 10 includes four cylinders 112, which are each connected to a common surge tank 30 via a corresponding intake manifold 20. Surge tank 30 is connected to an air cleaner 50 via an intake duct 40. An air flow meter 42 as well as a throttle valve 70 driven by an electric motor 60 are arranged in intake duct 40. The degree of opening of throttle valve 70 is controlled according to an output signal of an engine ECU 300 independently of an accelerator 100. Each cylinder 112 is coupled to a common exhaust manifold 80, which is coupled to a three-way catalytic converter 90.

For each cylinder 112, the engine is provided with an in-cylinder injector 110 for injecting fuel into the cylinder and an intake manifold injector 120 for injecting the fuel into an intake port or an intake manifold. These injectors 110 and 120 are controlled according to output signals of engine ECU 300. Each in-cylinder injector 110 is connected to a common fuel delivery pipe 130, which is connected to a mechanically driven high-pressure fuel pump 150 via a check valve 140 allowing flow toward fuel delivery pipe 130. Although this embodiment relates to the internal combustion engine, in which two kinds of injectors are arranged independently of each other, the invention is not restricted to the internal combustion engine of such structure. For example, the internal combustion engine may have an injector in the form of a combination of the in-cylinder injector and the intake manifold injector.

As shown in FIG. 1, a discharge side of high-pressure fuel pump 150 is coupled to an intake side of high-pressure fuel pump 150 via an electromagnetic spill valve 152. The amount of the fuel supplied from high-pressure fuel pump 150 to fuel delivery pipe 130 increases with decrease in degree of opening of electromagnetic spill valve 152. When electromagnetic spill valve 152 fully opens, high-pressure fuel pump 150 stops supply of the fuel to fuel delivery pipe 130. Electromagnetic spill valve 152 is controlled according to an output signal of engine ECU 300.

Each intake manifold injector 120 is connected to a common fuel delivery pipe 160 on a low pressure side. Fuel delivery pipe 160 and high-pressure fuel pump 150 are connected to a low-pressure fuel pump 180 driven by an electric motor via a common fuel pressure regulator 170. Low-pressure fuel pump 180 is connected to a fuel tank 200 via a fuel filter 190. Fuel pressure regulator 170 is configured to return a part of fuel discharged from low-pressure fuel pump 180 to fuel tank 200 when the pressure of the fuel discharged from low-pressure fuel pump 180 exceeds a preset fuel pressure. Thus, fuel pressure regulator 170 prevents such a situation that the fuel pressure applied to intake manifold injector 120 and the fuel pressure applied to high-pressure fuel pump 150 exceed the above preset fuel pressure.

Engine ECU 300 is formed of a digital computer, and includes a ROM (Read Only Memory) 320, a RAM (Random Access Memory) 330, a CPU (Central Processing Unit) 340, an input port 350 and an output portion 360, which are mutually connected via a bidirectional bus 310.

Air flow meter 42 produces an output voltage that is proportional to an intake air flow rate, and provides it to input port 350 via an A/D converter 370. Engine 10 is provided with a coolant temperature sensor 380 producing an output voltage that is proportional to a temperature of engine coolant, and provides it to input port 350 via an A/D converter 390.

A fuel pressure sensor 400, which produces an output voltage proportional to the fuel pressure in fuel delivery pipe 130, is attached to fuel delivery pipe 130, and provides the output voltage to input port 350 via an A/D converter 410. An air-fuel ratio sensor 420, which produces an output voltage proportional to an oxygen concentration of the exhaust gas, is attached to exhaust manifold 80 upstream of three-way catalytic converter 90, and provides the output voltage to input port 350 via an A/D converter 430.

Air-fuel ratio sensor 420 in the engine system according to the embodiment is a whole area air-fuel ratio sensor (linear air-fuel ratio sensor) producing the output voltage proportional to the air-fuel ratio of the mixture burned in engine 10. Air-fuel ratio sensor 420 may be formed of an $O_2$ sensor determining, in an on-off fashion, whether the air-fuel ratio of the mixture burned in engine 10 is rich or lean with respect to a theoretical air-fuel ratio.

Accelerator 100 is connected to an accelerator press-down degree sensor 440, which produces an output voltage proportional to an amount of press-down of accelerator 100, and provides the output voltage to input port 350 via an A/D converter 450. Input port 350 is also connected to an engine speed sensor 460, which produces an output pulse indicating an engine speed. ROM 320 of engine ECU 300 has stored, in a mapped form, the value of fuel injection amount, which is set corresponding to the operation state based on the engine load factor and the engine speed obtained by accelerator press-down degree sensor 440 and engine speed sensor 460, respectively, as well as the correction value depending on the engine coolant temperature.

A canister 230, which is a container for collecting fuel vapor generated in fuel tank 200, is connected to fuel tank 200 via a vapor pipe 260, and canister 230 is also connected to a purge pipe 280 for supplying the fuel vapor collected in canister 230 to the intake system of engine 10. Purge pipe 280 is connected to a purge port 290 located downstream of throttle valve 70 in intake duct 40. As is well known, canister 230 is filled with an absorbent (active carbon) absorbing the fuel vapor, and is provided with an air pipe 270 for introducing the air into canister 230 via a check valve during purging. Further, purge pipe 280 is provided with a purge control valve 250 controlling a purge amount. Engine ECU 300 performs duty control of the degree of opening of purge control valve 250, and thereby controls an amount of fuel vapor subjected to the purge processing in canister 230 and therefore an amount of the fuel introduced into engine 10 from canister 230. The latter amount will be referred to as a "purged fuel amount" hereinafter.

Figure 2:
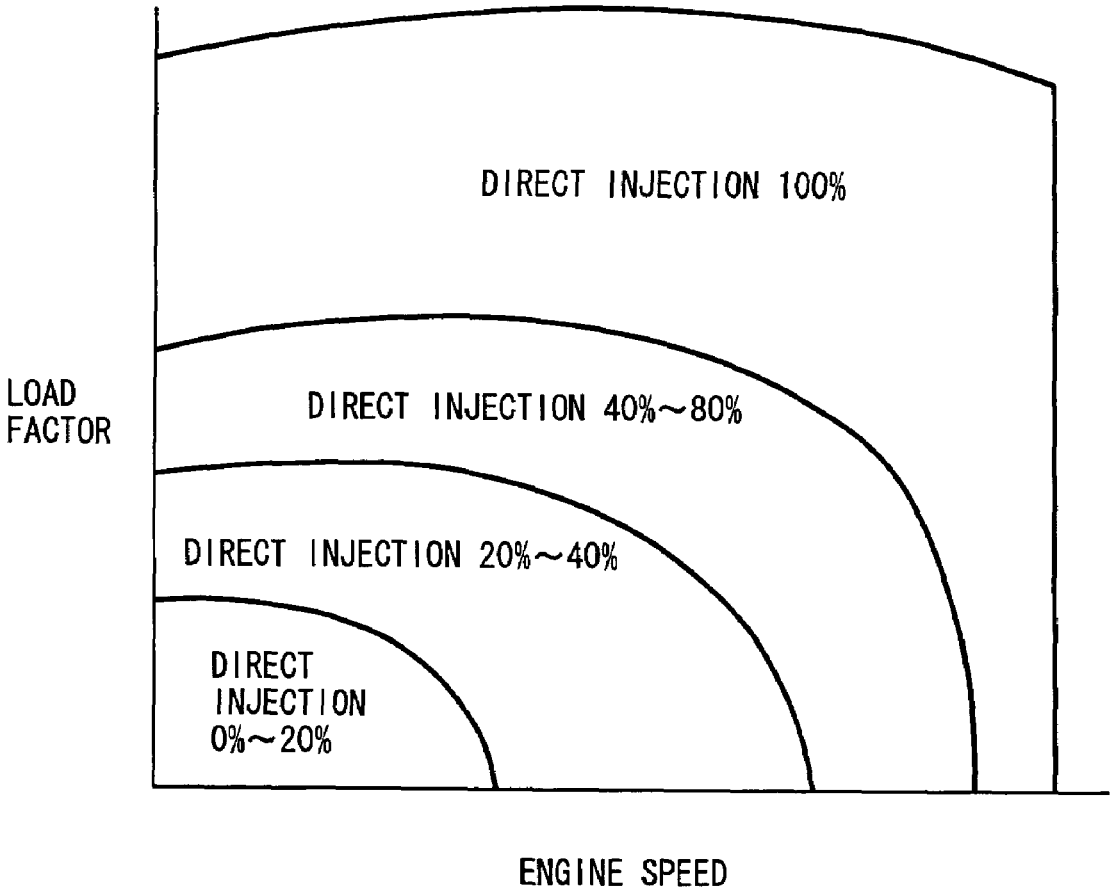
FIG. 2 illustrates a map of an injection ratio between an in-cylinder injector and an intake manifold injector.

FIG. 2 illustrates a map representing an injection ratio between in-cylinder injector 110 and intake manifold injector 120. This ratio is stored in ROM 320 of engine ECU 300, and may also be referred to as a "direct injection ratio" or "DI ratio r" hereinafter. As illustrated in FIG. 2, the abscissa gives the engine speed, the ordinate gives the load factor, and the map represents the sharing ratio of in-cylinder injector 110 by the direct injection ratio (DI ratio r) on a percentage basis.

As illustrated in FIG. 2, the direct injection ratio (DI ratio r) is set for each operation region determined by the engine speed and the load factor. "DIRECT INJECTION 100%" represents a region of (r=1.0, r=100%), in which only in-cylinder injector 110 performs the fuel injection, and "DIRECT INJECTION 0–20%" represents a region of (r=0–0.2), in which the injection amount of in-cylinder injector 110 is 0% to 20% of the whole fuel injection amount. For example, "DIRECT INJECTION 40%" represents that in-cylinder injector 110 injects 40% of the whole injection fuel, and intake manifold injector 120 injects 60% of the whole injection fuel.

Figure 3:
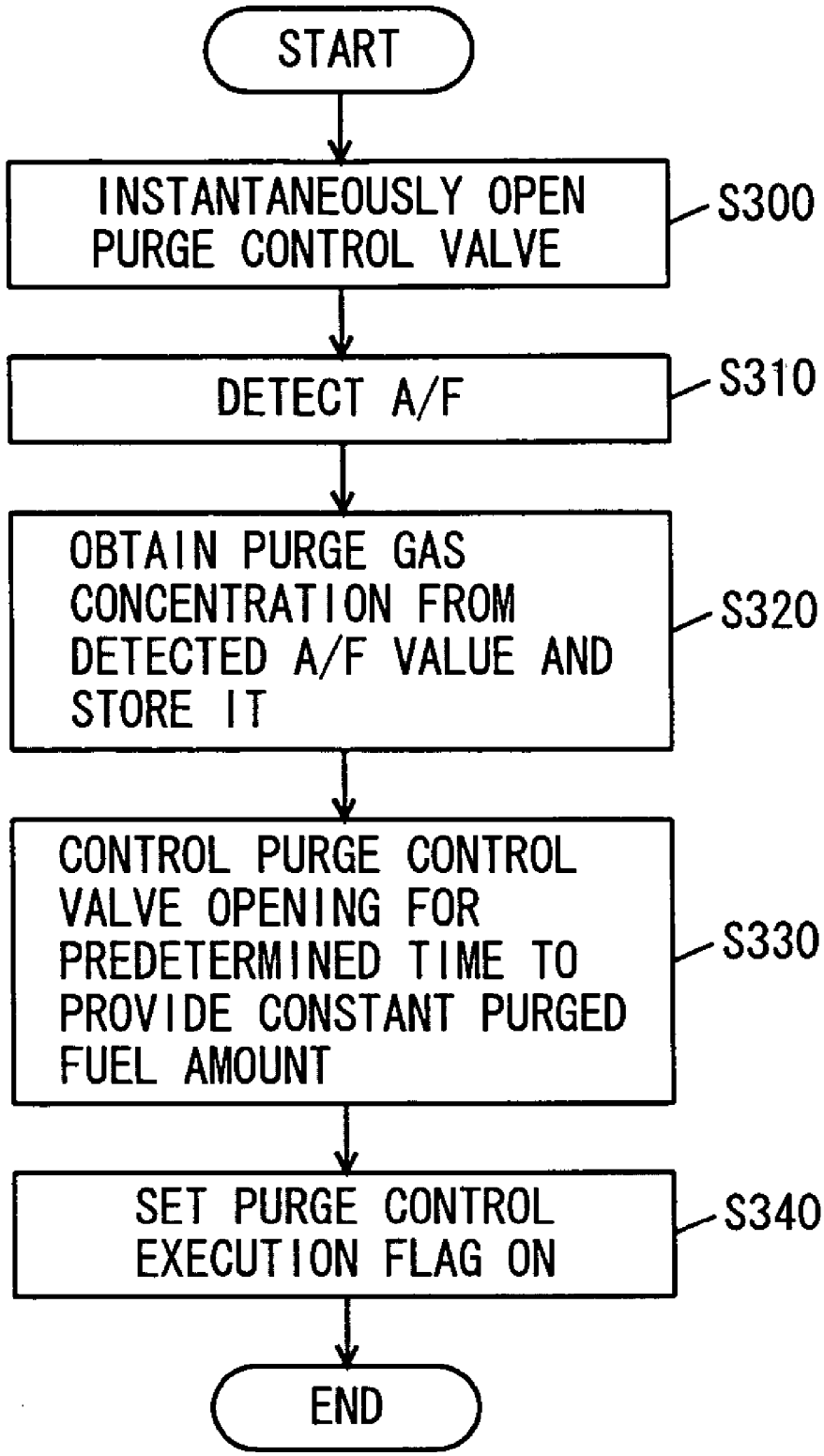
FIGS. 3–6, 8 and 9 are flowcharts illustrating a control structure of a program executed by an engine ECU, which is the control device according to the first embodiment of the invention.

Referring to FIG. 3, description will now be given on a control structure of a program executed by engine ECU 300, which is the control device according to the embodiment.

The flowchart in FIG. 3 is used as follows. After the start of engine 10, arithmetic is performed to make a comparison, e.g., between a current fuel gauge value of a fuel gate and a fuel gauge value recorded during stop of the engine, and thereby it is determined whether refueling was performed or not. Based on this determination and/or changes in atmospheric temperature during stop of the engine, the amount of fuel vapor collected in canister 230 is estimated, and it is determined whether the purge processing is required or not. When the purge processing is required, and can be performed, a routine of purge gas concentration detection and purge processing execution control starts according to the flowchart of FIG. 3. The purge processing is allowed, for example, during a state of low-speed and low-load operation, in which a sufficiently large intake pressure occurs in engine 10.

In step S300, engine ECU 300 controls purge control valve 250 to open instantaneously with a small opening degree. When purge control valve 250 opens with a small opening degree, purge gas containing fuel vapor is introduced into engine 10 via purge pipe 280 and purge port 290.

In step S310, engine ECU 300 causes air-fuel ratio sensor 420 to detect the air-fuel ratio (A/F) of the combustion gas produced when the purge gas is introduced.

In step S320, engine ECU 300 obtains the purge gas concentration based on the air-fuel ratio (A/F) thus detected. More specifically, the air-fuel ratio attained after the purge gas introduction is rich, as compared with that before the purge gas introduction. Therefore, the purge gas concentration is determined from the degree of such richness. A relationship between such degree and concentration is already determined by an experiment, and is prestored in ROM 320. The purge gas concentration thus determined is stored in RAM 330.

In step S330, engine ECU 300 executes the purge control by performing the duty control of the degree of opening of purge control valve 250 based on the purge gas concentration stored in RAM 330 for a predetermined time such that the purged fuel amount, i.e., the amount of purged fuel introduced into engine 10 may be constant. In step S340, engine ECU 300 sets a purge control execution flag to the on state during processing in step S330.

The purged fuel amount means the fuel amount contained in the purge gas, and the duty control is effected on the degree of opening of purge control valve 250 to control the purge gas flow rate such that the purged fuel amount may be constant independently of the changes in intake negative pressure caused by fluctuations in operation state. The duty ratio is determined in advance by an experiment, using the purge gas concentration and intake negative pressure as parameters, and is stored in ROM 320 in a mapped form. A correction value corresponding to the purged fuel amount may be described as a "purge correction amount FPG (fpg)".

Figure 4:
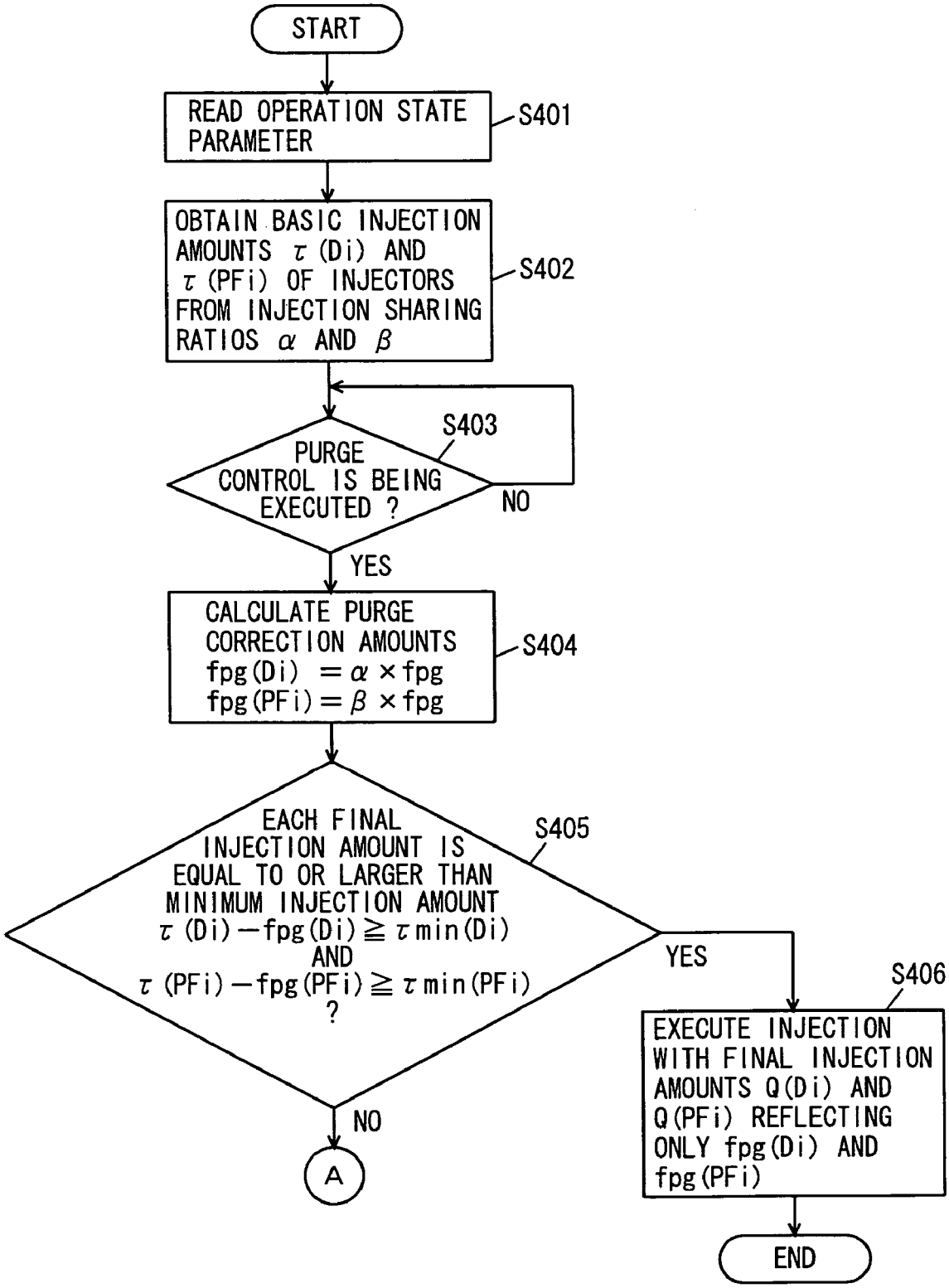
Figure 5:
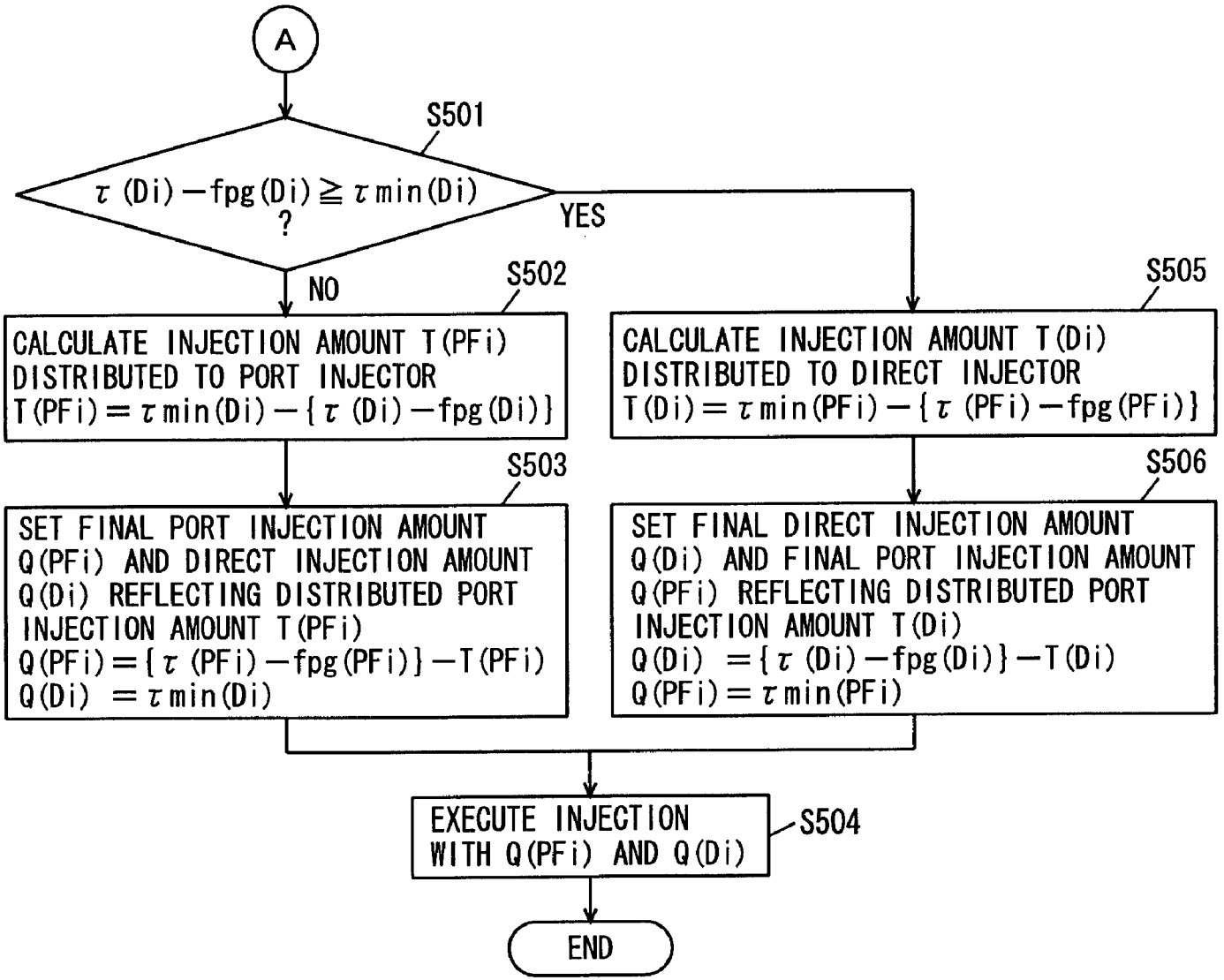

Referring to flowcharts of FIGS. 4 and 5, the control device according to the embodiment will now be described. This control routine is executed at every predetermined time or every predetermined crank angle. When the control starts, a load factor and an engine speed signal are read from accelerator press-down degree sensor 440 and engine speed sensor 460 as parameters indicating the operation state of engine 10 in step S401, respectively. In accordance with the operation state, processing is executed in a next step S402 to determine an injection sharing ratio α of in-cylinder injector 110, an injection sharing ratio β of intake manifold injector 120, a corresponding basic injection amount τ(Di) of in-cylinder injector 110 and a corresponding basic injection amount τ(PFi) of intake manifold injector 120.

In a next step S403, it is determined whether the purge control is being executed or not. This determination of whether the purge control is being executing or not is performed by determining whether the foregoing purge control execution flag is on or not. If it is being executed, i.e., if "YES", the process proceeds to step S404. In step S404, purge correction values fpg(Di) and fpg(PFi) for the two kinds of injectors are calculated by the following formulas, respectively:

$$fpg(Di)=\alpha\times fpg$$

$$fpg(PFi)=\beta\times fpg$$

In the above formulas, fpg is the purge correction value corresponding to the foregoing purged fuel amount, and is expressed as (fpg=fpg(Di)+fpg(PFi)). Therefore, fpg(Di) and fpg(PFi) represent the purge correction values determined by reflecting the sharing ratio.

In step S405, determination is performed in connection with a final direct injection amount Q(Di) of in-cylinder injector 110 and a final port injection amount Q(PFi) of intake manifold injector 120, in which purge correction values fpg(Di) and fpg(PFi) obtained by reflecting the sharing ratio calculated in step S404, respectively. More specifically, it is determined according to the following formulas whether final direct injection amount Q(Di) and final port injection amount Q(PFi) are equal to or larger than respective minimum injection amounts τmin(Di) and τmin (PFi), or not. The above minimum injection amount is an injection amount, which allows control of the injector while keeping linearity.

$$Q(Di)=\tau(Di)-fpg(Di)\geqq\tau(Di)$$

$$Q(PFi)=\tau(PFi)-fpg(PFi)\geqq\tau(PFi)$$

When it is determined in step S405 that the final injection amounts of the injectors are equal to or larger than minimum injection amounts τmin(Di) and τmin(PFi), respectively, the process proceeds to step S406, and the injection is executed with final direct injection amounts Q(Di) and Q(PFi) by reflecting only purge correction values fpg(Di) and fpg(PFi) determined by reflecting the sharing ratio, respectively. More specifically, purge correction values fpg(Di) and fpg (PFi) determined by reflecting the sharing ratio are subtracted from basic injection amounts τ(Di) and τ(PFi) of in-cylinder injector 110 and intake manifold injector 120, and the fuel injection amounts determined after the reduction are injected as final direct injection amount Q(Di) and final port injection amount Q(PFi), respectively. Thereby, the routine is once terminated. According to this embodiment, since purge correction value fpg is distributed according to the sharing ratio, fluctuations do not occur in air-fuel ratio and sharing ratio in engine 10 as a whole, and the lowering of engine performance and the deterioration of emissions can be avoided.

When it is determined in step S405 that the final injection amount of one of the injectors is lower than corresponding minimum injection amount τmin(Di) or τ(PFi), i.e., when the result of determination is "NO", the process proceeds to step S501, and determination according to the following formula is performed to specify the injector, of which final injection amount is lower than corresponding minimum injection amount τmin(Di) or τmin(PFi):

$$Q(Di)=\tau(Di)-fpg(Di)\geqq\tau min(Di)$$

When the result of the above determination is "NO", this means that the fuel injection amount, i.e., the final amount of the fuel to be injected from in-cylinder injector 11 is smaller than the corresponding minimum injection amount τmin(Di). In this case, the process proceeds to step S502. In step S502, a port fuel injection amount T(PFi) distributed to intake manifold injector 120 is calculated according to the following formula for maintaining the injection of minimum injection amount τmin(Di) from in-cylinder injector 110:

$$T(PFi)=\tau min(Di)-\{\tau(Di)-fpg(Di)\}$$

This distribution port fuel injection amount T(PFi) is distributed to intake manifold injector 120 for the following reason. As described above, after fuel injection correction amount fpg(Di) corresponding to the sharing ratio is subtracted from the basic fuel injection amount τ(Di) corresponding to the sharing ratio of in-cylinder injector 110, the fuel injection amount remaining after the reduction is smaller than minimum injection correction amount fpg(Di). In view of this, the fuel injection amount limited by minimum injection amount τmin(Di) is distributed to intake manifold injector 120 as distribution port fuel injection amount T(PFi).

In a next step S503, final port injection amount Q(PFi) and final direct injection amount Q(Di) are set, reflecting distribution port fuel injection amount T(PFi), as represented by the following formulas:

$$Q(PFi)=\{\tau(PFi)-fpg(PFi)\}-T(PFi)$$

$$Q(Di)=\tau min(Di)$$

When the result of the determination in step S501 is "YES", this means that the fuel injection amount, which is the final amount of the fuel to be injected from intake manifold injector 120, is smaller than minimum injection amount τmin(PFi). In this case, the process proceeds to step S505. In step S505, for maintaining the injection of minimum injection amount τmin(PFi) of intake manifold injector 120, a direct fuel injection amount T(Di) distributed to in-cylinder injector 110 is calculated by the following formula:

$$T(Di)=\tau min(PFi)-\{\tau(PFi)-fpg(PFi)\}$$

Distribution direct fuel injection amount T(Di) is employed for the following reason. As already described, after fuel injection correction amount fpg(PFi) corresponding to the sharing ratio is subtracted from basic fuel injection amount τ(PFi) corresponding to the sharing ratio of intake manifold injector 120, the fuel injection amount remaining after the reduction is smaller than minimum injection amount τmin(PFi). In view of this, the fuel injection amount limited by minimum injection amount τmin(PFi) is distributed to in-cylinder injector 110 as distribution direct fuel injection amount T(Di).

The process proceeds to step S506, in which distribution direct fuel injection amount T(Di) is reflected, and final direct injection amount Q(Di) and final port injection amount Q(PFi) are set according to the following formulas:

$$Q(Di)=\{\tau(Di)-fpg(Di)\}-T(Di)$$

$$Q(PFi)=\tau min(PFi)$$

Final direct injection amount Q(Di) and final port injection amount Q(PFi) set in steps S503 and S506 are injected in step S504. In the embodiment, as described above, the fuel injection amount limited by minimum fuel injection amount τmin(Di) or τmin(PFi) of one of in-cylinder injector 110 and intake manifold injector 120 is distributed to the other injector. This embodiment can ensure minimum fuel injection amount τmin(Di) and τmin(PFi) of in-cylinder and intake manifold injectors 110 and 120, and therefore can accurately control the fuel injection amount so that the lowering of engine performance and the deterioration of emissions can be avoided.

A first modification of the fuel injection control in the control device according to the embodiment will now be described with reference to a flowchart of FIG. 6. In this first modification, the sharing ratio of fuel injection correction is modified in accordance with the fuel injection timing of in-cylinder injector 110. More specifically, as the timing of fuel injection of in-cylinder injector 110 becomes closer to the compression top dead center in the compression stroke region, the sharing ratio of fuel injection amount correction of in-cylinder injector 110 is reduced. Thereby, the influence of the introduced purged fuel amount is decreased to produce good stratified air-fuel mixture in such a case that the fuel injection timing of the in-cylinder injector, which is variable according to the operation state, and particularly the fuel injection timing of in-cylinder injector is in the compression stroke.

Similarly to the foregoing embodiment, this control routine is executed at every predetermined time or every predetermined crank angle. Therefore, when the control starts, processing is performed in step S601 to read, as parameters indicating the operation state of engine 10, the load factor and the engine speed signal from accelerator press-down degree sensor 440 and engine speed sensor 460, respectively, and processing is performed in a next step S602 corresponding to this operation state to determine injection sharing ratios α and β of in-cylinder injector 110 and intake manifold injector 120 as well as basic injection amounts τ(Di) and τ(PFi) of in-cylinder injector 110 and intake manifold injector 120 corresponding to the respective factors, as already described.

In a next step S603, it is determined whether the purge control execution flag is on or not, and thereby it is determined whether the purge control is being executed or not, similarly to the foregoing embodiment. Only when it is being executed, and thus the result is "YES", the process proceeds to step S604. In step S604, purge correction amounts fpg(Di) and fpg(PFi) are obtained from purge correction value fpg corresponding to the purged fuel amount by reflecting the injection sharing ratio obtained in step S602, and more specifically are obtained for the respective injectors from the following formulas:

$$fpg(Di)=\alpha\times fpg$$

$$fpg(PFi)=\beta\times fpg$$

In a next step S605, processing is performed to read the fuel injection timing of in-cylinder injector 110, i.e., in-cylinder injection timing xinj(Di). In-cylinder injection timing xinj(Di) is preset in a map according to the operation state of engine 10.

Figure 7:
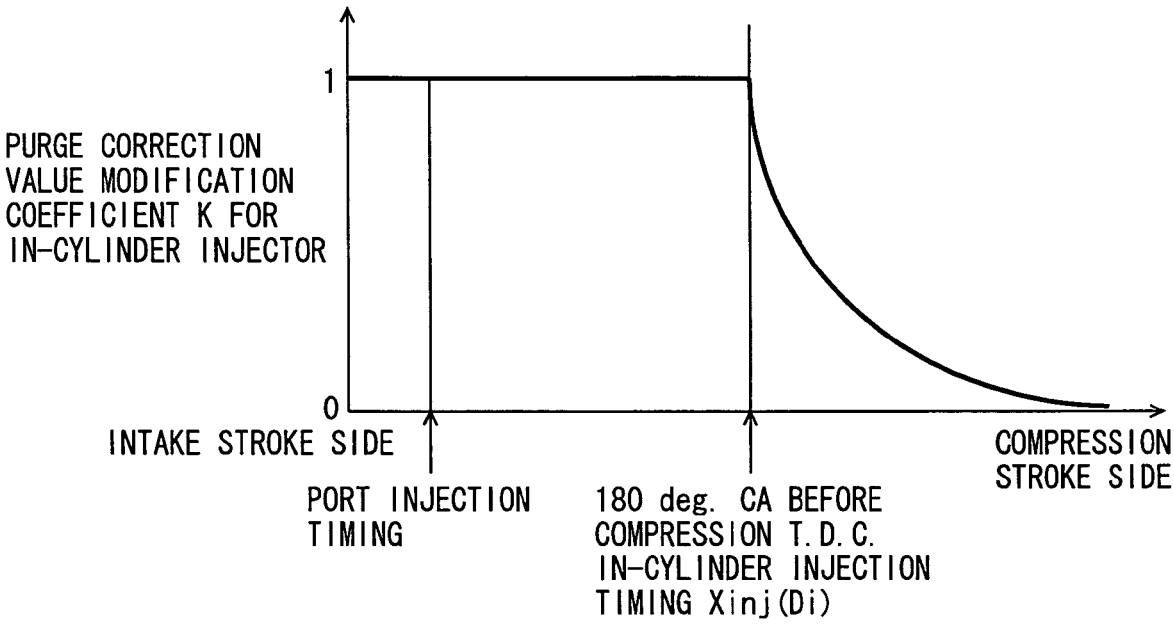
FIG. 7 illustrates a relationship between in-cylinder injection timing and a purge correction modifying factor for the in-cylinder injector.

In a next step S606, a purge correction value modifying coefficient k for in-cylinder injector 110 is calculated according to in-cylinder injection timing xinj(Di). Purge correction value modifying coefficient k is employed for modifying the sharing ratio of the fuel injection amount correction, and takes a form, e.g., of a two-dimensional map as illustrated by a graph in FIG. 7. According to this graph, in which the abscissa and ordinate give in-cylinder injection timing xinj(Di) and purge correction value modifying coefficient k, respectively, when in-cylinder injection timing xinj(Di) is earlier the 180 deg. CA (Crank Angle) before the compression top dead center (T. D. C), i.e., when it is in the intake stroke region, coefficient k is equal to 1(k=1). When in-cylinder injection timing xinj(Di) later than 180 deg. CA before the compression top dead center, i.e., when it is in the compression stroke region, coefficient k is asymptotically reduced toward zero such that the sharing ratio of the fuel injection amount correction of in-cylinder injector 110 decrease as the timing becomes closer to the compression top dead center. This is for the following reason. When in-cylinder injection timing xinj(Di) is in the compression stroke region, it is in the stratified charge combustion region, and therefore the above control is performed for reducing the influence by the introduced purged fuel amount and providing good stratified mixture allowing easy ignition around a spark plug.

Figure 6:
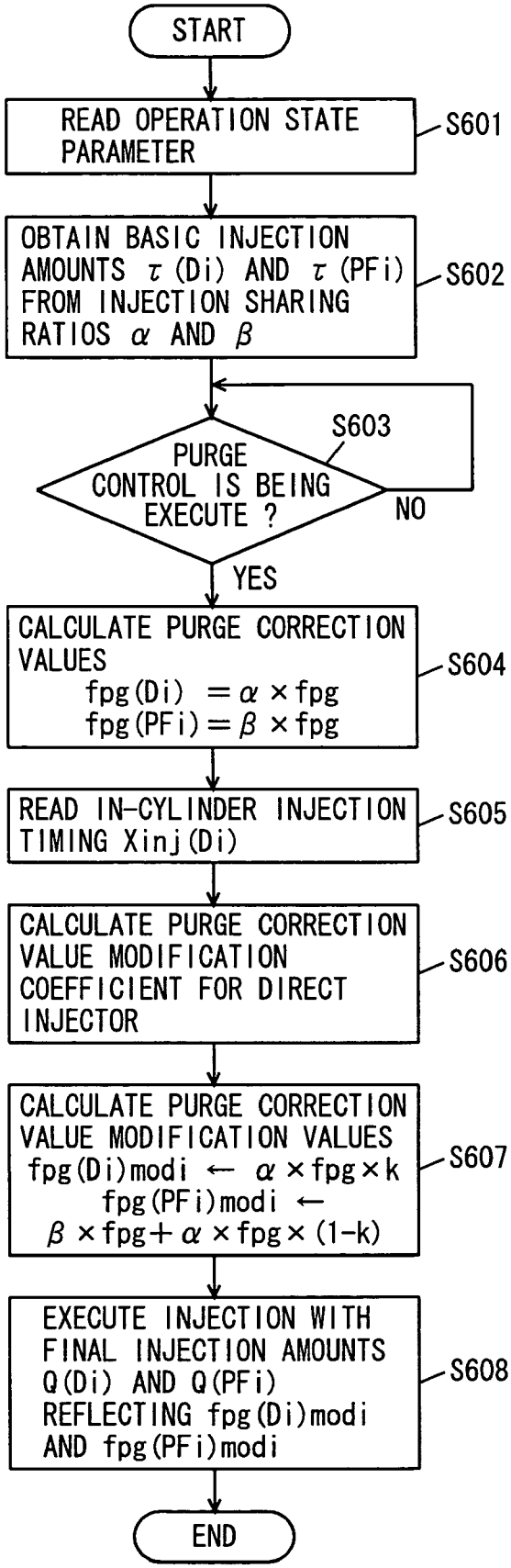

Returning to the flowchart of FIG. 6, the process proceeds to step S607, in which the purge correction value modifying values for the respective injectors are calculated based on purge correction value modifying coefficient k obtained in step S606, and more specifically, purge correction value modifying values fpg(Di)modi and fpg(PFi)modi for in-cylinder injector 110 and intake manifold injector 120 are calculated from the following formulas, respectively.

$$fpg(Di)modi=\alpha\times fpg\times k$$

$$fpg(PFi)modi=\beta\times fpg\times(1-k)$$

In step S608, the injection is executed with final direct injection amount Q(Di) and final port injection amount Q(PFi) determined by reflecting purge correction value modifying values fpg(Di)modi and fpg(PFi)modi for the respective injectors. More specifically, purge correction value modifying values fpg(Di)modi and fpg(PFi)modi are obtained from purge correction values fpg(Di) and fpg(PFi), which are determined by reflecting the fuel injection sharing ratios α and β, by modifying sharing ratio of the fuel injection amount correction according to in-cylinder injection timing xinj(Di), and purge correction value modifying values fpg(Di)modi and fpg(PFi)modi thus obtained are subtracted from basic injection amounts τ(Di) and τ(PFi) of in-cylinder and intake manifold injectors 110 and 120 to obtain final direct injection amount Q(Di) and final port injection amount Q(PFi), respectively. The fuel remaining after the above reduction, i.e., the fuel of final direct injection amount Q(Di) and final port injection amount Q(PFi) are injected, respectively.

According to the above embodiment, purge correction value fpg is distributed according to the injection sharing ratio. Further, when the fuel injection timing of in-cylinder injector 110, which is variable according to the operation state, and particularly the fuel injection timing of in-cylinder injector 110 is in the compression stroke, modification is performed to reduce the sharing ratio of the fuel injection amount correction. Therefore, it is possible to reduce the influence by the introduced purged fuel amount, and to provide good stratified mixture allowing easy ignition around the spark plug. Consequently, the ignition timing can be angularly retarded, and the lowering of engine performance and the deterioration of emissions can be avoided.

Figure 8:
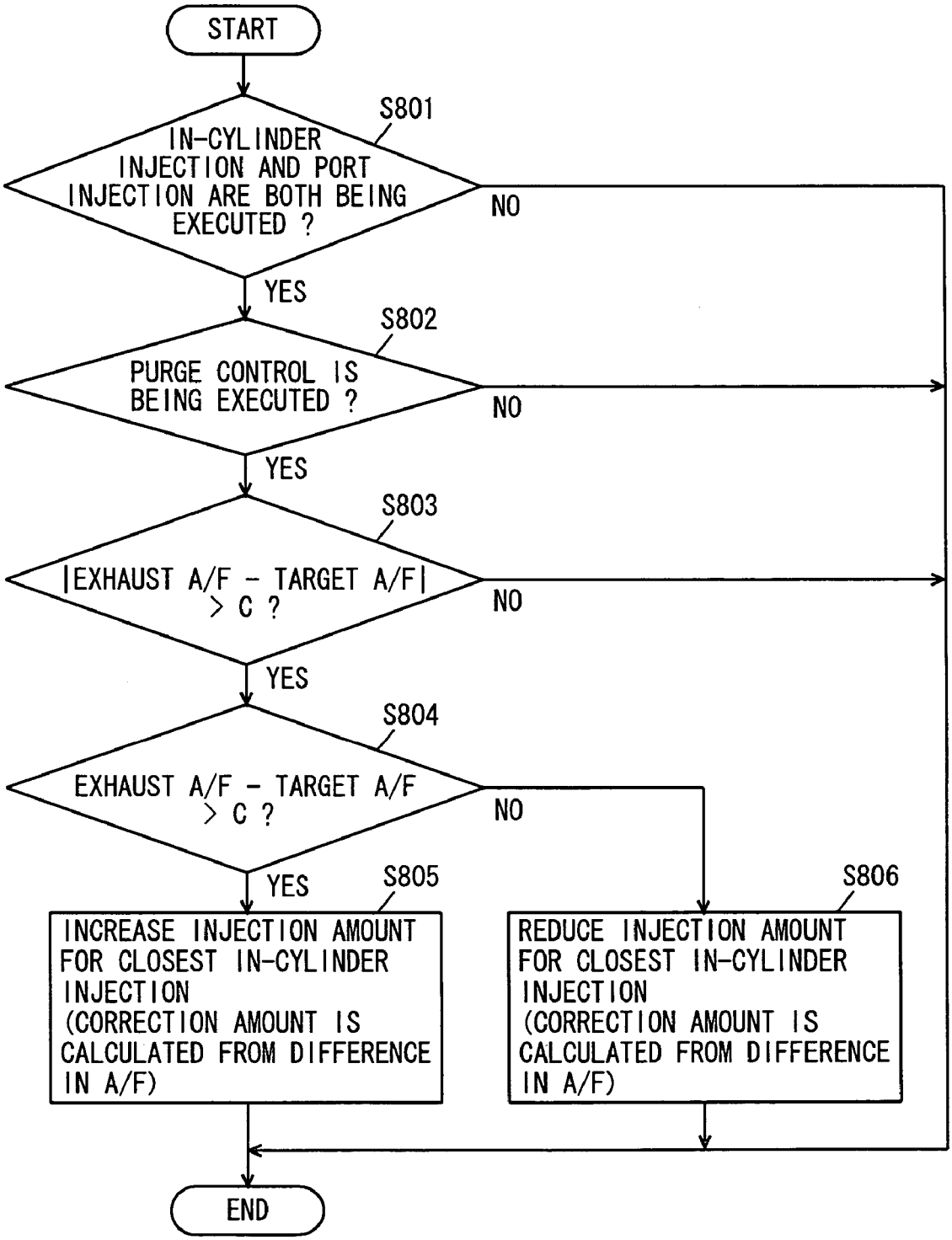

A second modification of the fuel injection control of the control device according to the embodiment will now be described with reference to the flowchart of FIG. 8. In this second modification, when the exhaust air-fuel ratio rapidly changes with respect to a target air-fuel ratio, in-cylinder injector 110 performs the injection to correct the fuel injection amount by an amount corresponding to a deviation or difference in air-fuel ratio, and thereby can rapidly correct the deviation in air-fuel ratio. This control routine is executed as a subroutine of the routines of the ordinary fuel injection control, ignition timing control and air-fuel ratio control.

When the control starts, it is determined in step S801 whether both the in-cylinder injection of in-cylinder injector 110 and the port injection of intake manifold injector 120 are being executed or not. When these are being executed, i.e., when the result is "YES", the process proceeds to step S802. If "NO", the routine ends. In step S802, based on whether the foregoing purge control execution flag is on or not, it is determined whether the purge control is being executed or not, similarly to the foregoing embodiment. When it is being executed, i.e., when the result is "YES", the process proceeds to step S803, and otherwise, the routine ends.

In step S803, the exhaust air-fuel ratio (A/F) of the combustion gas detected by air-fuel ratio sensor 420 is compared with the target air-fuel ratio (A/F), and it is determined whether an absolute value of a difference between them exceeds a predetermined value C (e.g., air-fuel ratio of one) or not. Based on the result of this determination, it is determined whether the exhaust air-fuel ratio suddenly changed with respect to the target air-fuel ratio or not. When the sudden change did not occurred, the routine ends. When it occurred, i.e., when the result is "YES", the process proceeds to step S804. In step S804, it is determined whether this difference in air-fuel ratio is positive (on the lean side) or negative (on the rich side). When the difference in air-fuel ratio is positive, the process proceeds to step S805, in which correction of increasing the fuel injection amount is effected on the in-cylinder injection, which is executable immediately after the determination. When the difference in air-fuel ratio is negative, the process proceeds to step S806, in which correction of decreasing the fuel injection amount is effected on the in-cylinder injection, which is executable immediately after the determination. In the above cases, these increasing correction amount and decreasing correction amount are fuel injection amounts corresponding to the modification or correction of the difference in air-fuel ratio obtained in step S803. When the fuel injection amount corresponding to the difference cannot be provided by one fuel injection operation, the required fuel injection may be shared by the in-cylinder injection immediately after the determination and the subsequent in-cylinder injection, for example.

As described above, when the difference in air-fuel ratio exceeds predetermined value C, and is positive (on the lean side), this means that the purge correction is excessive, and thus the purge correction value is excessively large. When the difference in air-fuel ratio exceeds predetermined value C, and is negative (on the rich side), this means that the purge correction is insufficient, and thus the purge correction value is excessively small. In either case, if the situation is left as it is, the emissions will deteriorate. In this embodiment, therefore, the correction of fuel injection amount is effected, e.g., on the in-cylinder injection of the executable closest (and following) in-cylinder injector(s). Therefore, the difference in air-fuel ratio can be corrected more rapidly that the case of the port injection.

Figure 9:
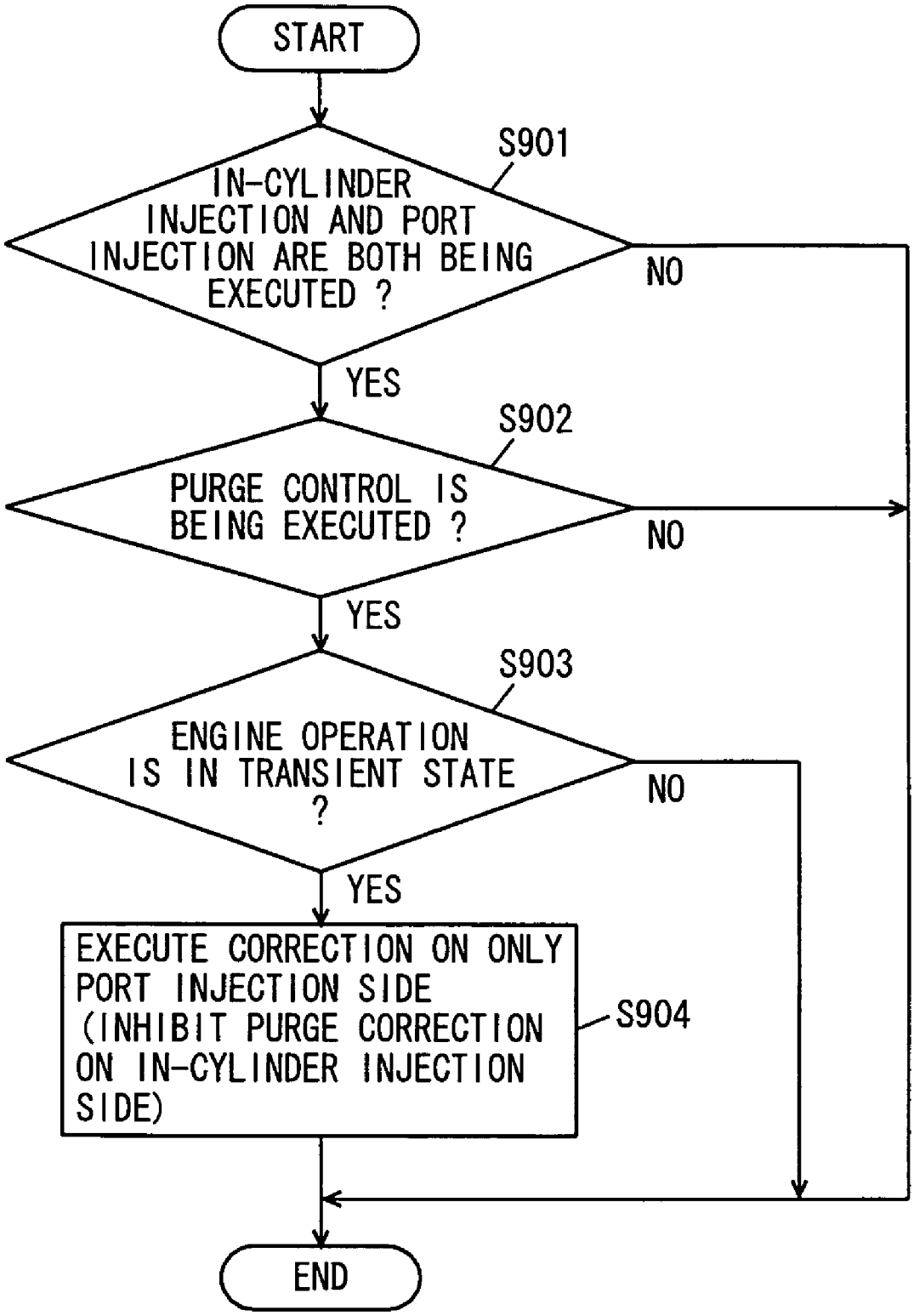

A third modification of the fuel injection control of the control device according to the embodiment will now be described with reference to a flowchart of FIG. 9. In the third modification, when a transient operation is performed, the correction of the fuel injection amount corresponding to the introduced purged fuel amount is performed by the injection of only the intake manifold injector, and thereby an influence on formation of the good air-fuel mixture is reduced to ensure the combustion stability. This control routine is executed as a subroutine of the ordinary fuel injection control or ignition timing control.

When the control starts, it is determined in step S901 whether both the in-cylinder injection of in-cylinder injector 10 and the port injection of intake manifold injector 120 are being executed or not. When these are being executed, i.e., when the result is "YES", the process proceeds to step S902. If "NO", the routine ends. In step S902, based on whether the foregoing purge control execution flag is on or not, it is determined whether the purge control is being executed or not, similarly to the foregoing embodiment. When it is being executed, i.e., when the result is "YES", the process proceeds to step S903, and otherwise, the routine ends.

In step S903, it is determined whether the operation state of the engine is in the transient state or not. This determination of the state is performed, e.g., based on a magnitude of a fluctuation rate or speed of the load factor obtained according to the state of accelerator press-down degree sensor 440. When it is determined in step S903 that the state is not the transient state but the stationary state, the routine ends. When it is the transient state, the process proceeds to step S904. The correction of the fuel injection amount corresponding to the introduced purged fuel amount is performed by the injection of only intake manifold injector 120. Thus, independently of fuel injection sharing ratios $\alpha$ and $\beta$, the purge correction by in-cylinder injector 110 is inhibited, and the purge correction is executed by only intake manifold injector 120. As described above, during the transient state, in which instable combustion is liable to occur, in-cylinder injector 110 performs the injection without reducing the fuel injection amount corresponding to the fuel injection sharing ratio $\alpha$. Therefore, the good air-fuel mixture required for the stratified charge combustion is produced so that the combustion stability can be ensured, and torque down and others do not occur.

Second Embodiment

A control device of an internal combustion engine according to a second embodiment of the invention will now be described. The second embodiment employs the same structures and operations as those in FIGS. 1 to 3 of the first embodiment, and therefore description thereof is not repeated.

Figure 10:
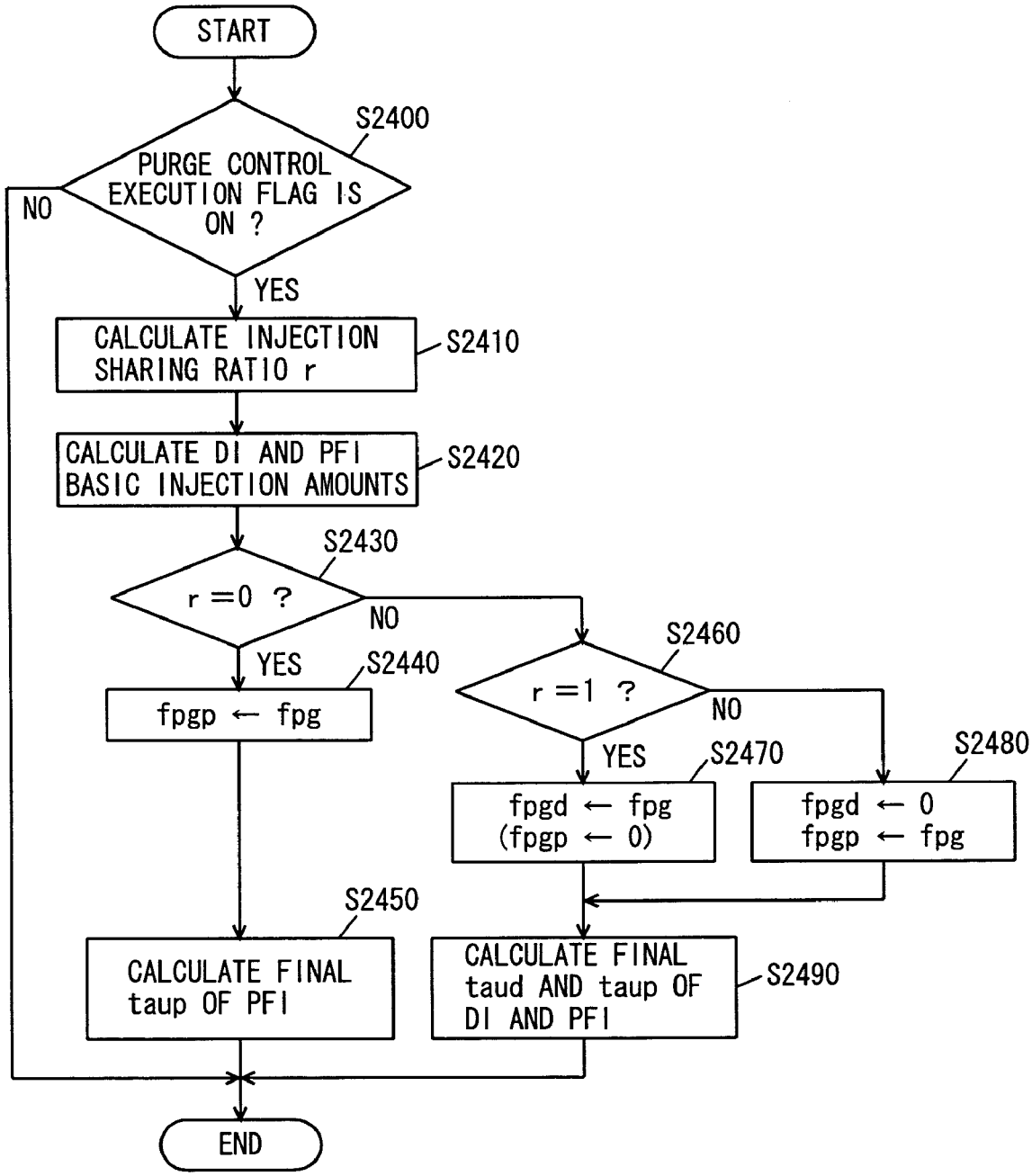
FIG. 10 is a flowchart illustrating a control structure of a program executed by an engine ECU, which is a control device according to a second embodiment of the invention.

Referring to FIG. 10, description will now be given on a control structure of a program for correcting the purged fuel amount when the purge control is being executed. The control program illustrated in FIG. 10 is executed at every predetermined time or every predetermined crank angle.

In step S2400, engine ECU 300 determines whether the purge control execution flag is on or not. When the purge control execution flag is on (YES in S2400), the process proceeds to step S2410. If not (NO in S2400), the processing ends.

In step S2410, engine ECU 300 calculates an injection sharing ratio (DI ratio) r. The map of FIG. 2 is used for calculating injection sharing ratio (DI ratio) r.

In step S2420, engine ECU calculates the basic injection amounts of in-cylinder injector 110 (DI) and intake manifold injector 120 (PFI). The basic injection amount taudb of in-cylinder injector 110 is calculated by the following formula:

$$taudb=r\times EQMAX\times k1fwd\times fafd\times kgd\times kpr \quad (2\text{-}1)$$

The basic injection amount taupb of intake manifold injector 120 is calculated by the following formula:

$$taupb=k\times(1-r)\times EQMAX\times k1fwd\times fafp\times kgd\times kgp \quad (2\text{-}2)$$

In the above formulas (2-1) and (2-2), r represents the injection sharing ratio (DI ratio), EQMAX represents the maximum injection amount, k1fwd represents the load factor, fafd and fafp represent feedback coefficients in a stoichiometric state, kgd is a learned value, kpr is a conversion coefficient corresponding to a fuel pressure, and kgp is a learned value of intake manifold injector 120.

In step S2430, engine ECU 300 determines whether DI ratio r is zero or not. When DI ratio r is zero (YES in S2430), the process proceeds to step S2440. If not (NO in S2430), the process proceeds to step S2460.

In step S2440, engine ECU 300 substitutes purge correction value fpg corresponding to the foregoing purged fuel amount for a purge reduction calculation value fpgp on the intake manifold injector side (120). In step S2450, engine ECU 300 calculates a final injection amount taup of intake manifold injector 120. This injection amount taup is calculated from the following formula:

$$taup=taub-fpgp+tauv \quad (2\text{-}3)$$

where tauv is an invalid injection amount.

In step S2460, engine ECU 300 determines whether DI ratio r is one or not. When DI ratio r is one (YES in S2460), the process proceeds to step S2470. If not (NO in S2460), the process proceeds to step S2480.

In step S2470, engine ECU 300 substitutes fpg for purge reduction calculation value fpgd of in-cylinder injector 110. Also, it substitutes 0 for purge reduction calculation value fpgp of intake manifold injector 120.

In step S2480, engine ECU 300 substitutes 0 for purge reduction calculation value fpgd. Also, it substitutes fpg for purge reduction calculation value fpgp of intake manifold injector 120.

In step S2490, engine ECU 300 calculates final injection amounts taud and taup of in-cylinder injector 110 and intake manifold injector 120. In this operation, final injection amount taud of in-cylinder injector 110 is calculated by the following formula:

$$taud=taudb-fpgd \quad (2\text{-}4)$$

Final injection amount taup of intake manifold injector 120 is calculated by the foregoing formula (2-3).

The purge reduction calculation value can be summarized as follows:

$$\text{When DI ratio } r=1.0,\ fpgd=fpg(fpgp=0) \quad (2\text{-}5)$$

$$\text{When DI ratio } r\neq 1.0,\ fpgd=0,\ fpgp=fpg \quad (2\text{-}6)$$

Based on the foregoing structures and flowcharts, engine ECU 300, which is the control device according to the embodiment, executes the injection sharing control during the purge processing of engine 10, and this control performed during the purge processing will now be described.

Figure 11:
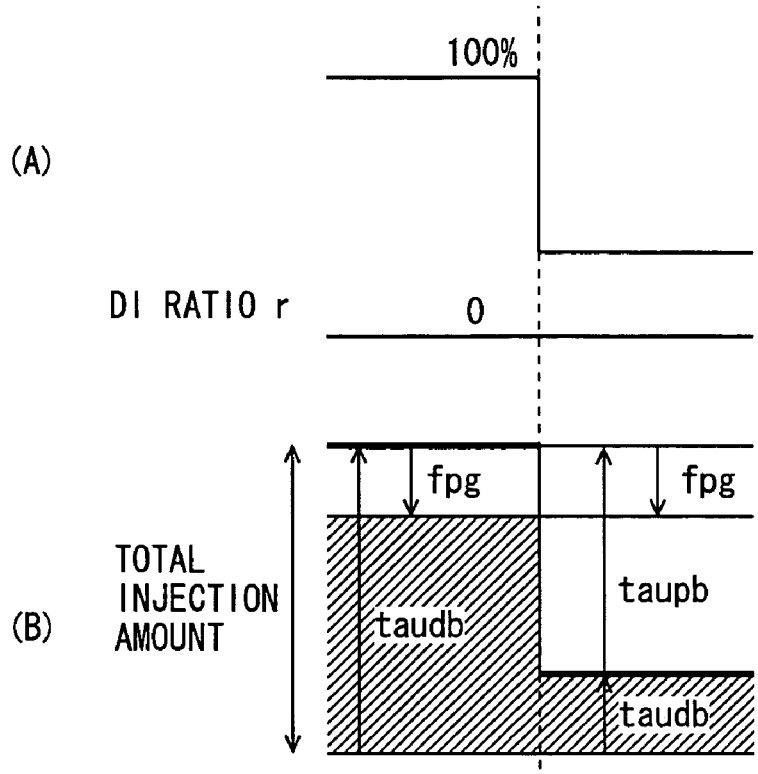
FIG. 11 illustrates changes occurring in fuel injection amount when purge processing is being executed and an operation changes from a state of injecting fuel only by the in-cylinder injector to a state of sharing the injection.

When DI ratio r is 1.0, and the purge processing is executed in such a case that the control is effected on the injection sharing between in-cylinder injector 110 and intake manifold injector 120 based on the map of FIG. 2, purge reduction calculation value fpg (=fpgd) is subtracted from basic injection amount taudb of in-cylinder injector 110. This corresponds to the case where DI ratio r is 100% at (A) and (B) in FIG. 11.

When DI ratio r is neither 100% nor 0%, purge reduction calculation value fpg is subtracted from basic injection amount taupb of intake manifold injector 120, and is not reflected in basic injection amount taudb of in-cylinder injector 110. Thus, as illustrated on the right side at (B) in FIG. 11, when injection sharing is being performed between in-cylinder injector 110 and intake manifold injector 120 (0<DI ratio r<1.0), the correction amount of fuel related to the purge processing with purge reduction calculation value fpg is subtracted from basic injection amount taupb of intake manifold injector 120 so that basic fuel injection amount taudb of in-cylinder injector 110 does not change.

Figure 12:
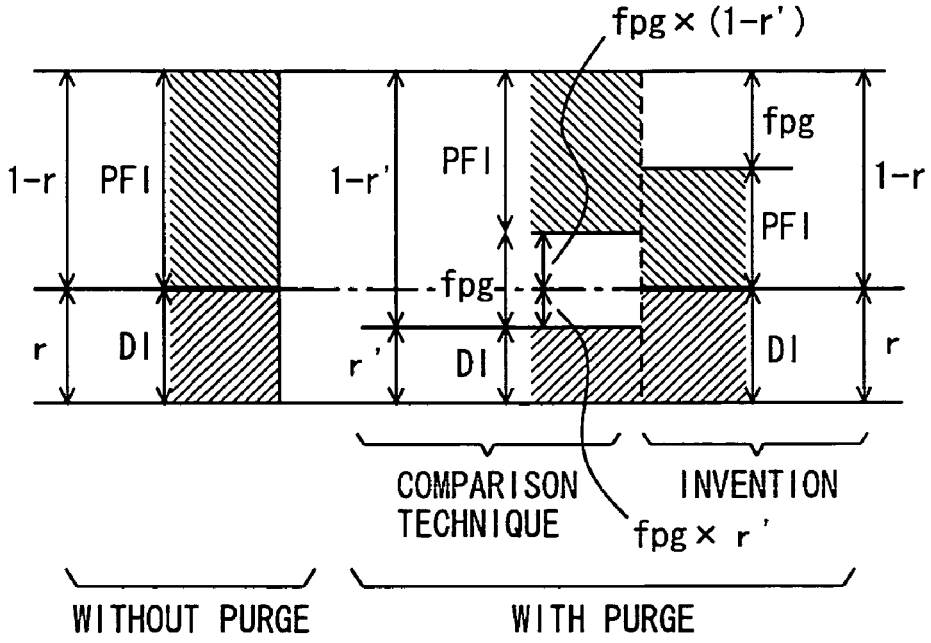
FIG. 12 illustrates comparisons between fuel injection amounts during the purge processing.

FIG. 12 illustrates a case in which the purge processing is executed, and a case in which the purge processing is not executed. In connection with the case of executing the purge processing, FIG. 12 illustrates correction processing, which is effected according to the invention on the fuel reduction amount when the purge processing is performed, and also illustrates correction processing, which is executed according to a comparison technique on the fuel reduction amount when purge processing is performed.

As illustrated in FIG. 12, when the purge processing is not being executed, final injection amounts of in-cylinder injector 110 and intake manifold injector 120 are calculated according to DI ratio r. In another technique such as the illustrated comparison technique, when the purge processing is executed, purge reduction calculation value fpg is distributed according to a DI ratio r' between in-cylinder injector 110 (DI) and intake manifold injector 120 (PFI). Thus, in the comparison technique, the purge reduction calculation value of intake manifold injector 120 is calculated by (fpg×(1−r')), and the purge reduction calculation value of in-cylinder injector 110 is calculated by (fpg×r').

According to the invention, DI ratio r of in-cylinder injector 110 does not change regardless of execution and nonexecution of the purge processing, and the fuel correction is performed during execution of the purge processing by subtracting purge reduction calculation value fpg from basic fuel injection amount taupb of intake manifold injector 120 (PFI).

In this manner, when the fuel injection amount of the intake manifold injector does not change (i.e., does not decrease) depending on whether the purge processing takes place of not, and the injection hole temperature of the in-cylinder injector does not rise so that the production of deposits is prevented. Further, the in-cylinder injector injects the fuel at a high pressure so that fluctuations in fuel amount thereof are larger than those of intake manifold injector injecting the fuel at a low pressure. However, the fuel injection amount of in-cylinder injector does not decrease so that the learned value of the air-fuel control can be applied as it is. Since such a situation does not occur that the fuel injection amount of in-cylinder injector decreases to the vicinity of the minimum fuel injection amount, it is possible to avoid occurrence of a significant problem even in a region where linearity is not present in relationship between the actual injection amount and the fuel injection timing at the vicinity of the minimum fuel injection amount.

Third Embodiment

Description will now be given on a control device of an internal combustion engine according to a third embodiment of the invention. The third embodiment employs the same structures and operations as those in FIGS. 1 to 3 of the first embodiment, and therefore description thereof is not repeated.

Figure 13:
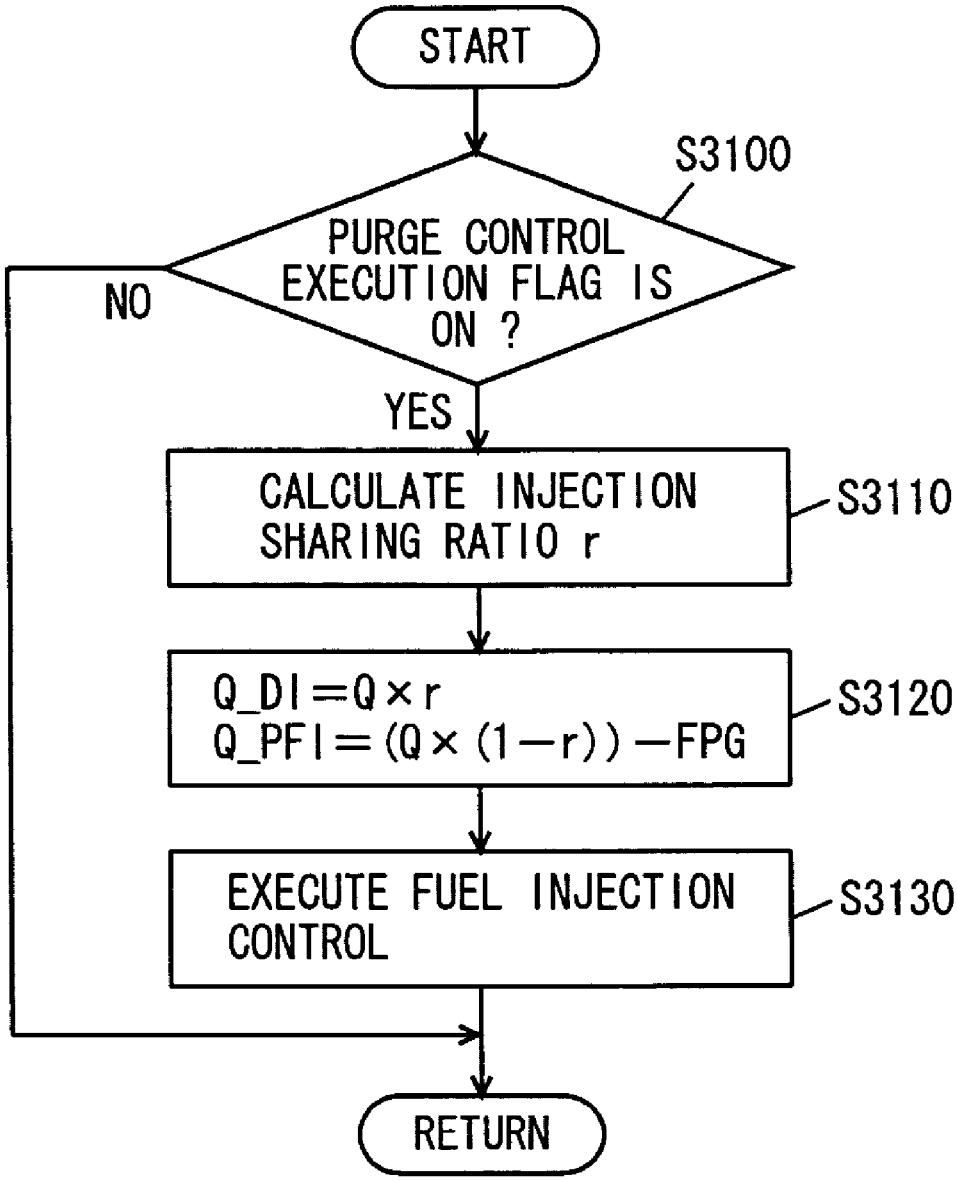
FIGS. 13, 15 and 17 are flowcharts illustrating a control structure of a program executed by an engine ECU, which is a control device according to a third embodiment of the invention.

Referring to FIG. 13, description will now be given on a control structure of a program for correcting the purged fuel amount when the purge control is being executed. The control program illustrated in FIG. 13 is executed at every predetermined time or every predetermined crank angle.

In step S3100, engine ECU 300 determines whether the purge control execution flag is on or not. When the purge control execution flag is on (YES in S3100), the process proceeds to step S3110. If not (NO in S3100), the processing ends.

In step S3110, engine ECU 300 calculates injection sharing ratio r. The map of FIG. 2 is used for this calculation. In step S3120, engine ECU 300 calculates an injection amount Q_DI of in-cylinder injector 110 by (Q_DI=Q×r), and calculates an injection amount Q_PFI of intake manifold injector 120 by (Q_PFI=Q×(1−r)−FPG), where Q is a required fuel injection amount of engine 10.

In step S3130, engine ECU 300 executes the fuel injection by controlling in-cylinder injector 110 and intake manifold injector 120 based on injection amount Q_DI of in-cylinder injector 110 and injection amount Q_PFI of intake manifold injector 120.

Based on the foregoing structures and flowcharts, engine ECU 300, which is the control device according to the embodiment, executes the injection sharing control during the purge processing of engine 10, and this control performed during the purge processing will now be described.

When the control is effected on the injection sharing between in-cylinder injector 110 and intake manifold injector 120 based on the map of FIG. 2, and the purge processing is executed (YES in S3100), injection sharing ratio r between in-cylinder injector 110 and intake manifold injector 120 is calculated (S3100). This calculation of injection sharing ratio r is performed based on the predetermined map of FIG. 2.

Injection amount Q_DI of in-cylinder injector 110 is calculated by multiplying required fuel injection amount Q by injection sharing ratio r, and injection amount Q_PFI of intake manifold injector 120 is calculated by subtracting purge correction amount FPG from the value obtained by multiplying required fuel injection amount Q by (1−r) (S3120).

Figure 14A:
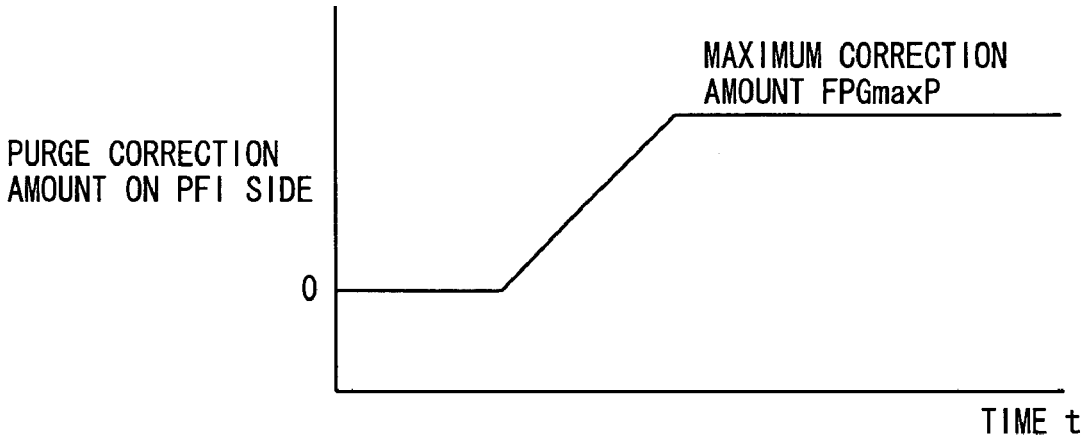
FIGS. 14A, 14B, 16 and 18 illustrate changes in amount of purge correction executed in engine by the engine ECU, which is the control device according to the third embodiment of the invention.
Figure 14B:
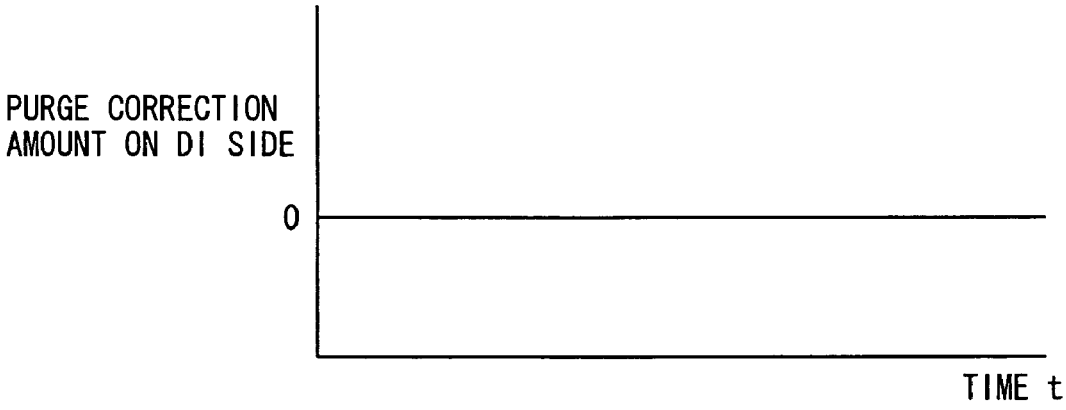

FIG. 14A illustrates changes in purge correction amount of intake manifold injector 120 with time, and FIG. 14B illustrates changes in purge correction amount of in-cylinder injector 110 with time. As illustrated in FIG. 14B, the purge correction amount of in-cylinder injector 110 is zero independently of time t. As illustrated in FIG. 14A, the purge correction amount of intake manifold injector 120 is controlled to rise uniformly until it reaches a maximum correction amount FPGmaxP.

In the engine system controlled by the engine ECU according to the embodiment, as described above, when the purge processing is executed, the fuel injected from the in-cylinder injector does not change, and the intake manifold injector is used for correcting the fuel injection amount corresponding to the introduced purged fuel amount. Thereby, a difference does not occur between the injected fuel amounts of the in-cylinder injector before and after the start of purge processing. Therefore, in contrast to the case in which the fuel injection amount of the in-cylinder injector is reduced by the injected fuel amount corresponding to the purged fuel amount according to the injection sharing ratio r, the fuel injection amount of the in-cylinder injector does not decrease so that the tip temperature of the in-cylinder injector does not rise, and the production of deposits can be prevented. Therefore, the normal operation of the in-cylinder injector can be ensured.

A first modification of the fuel injection control of the control device according to the embodiment will now be described. The control device according to this modification executes a program different from that of the control device according to the second embodiment. This modification employs the same hardware structures and others as those in FIGS. 1 to 3, and therefore description thereof is not repeated.

Figure 15:
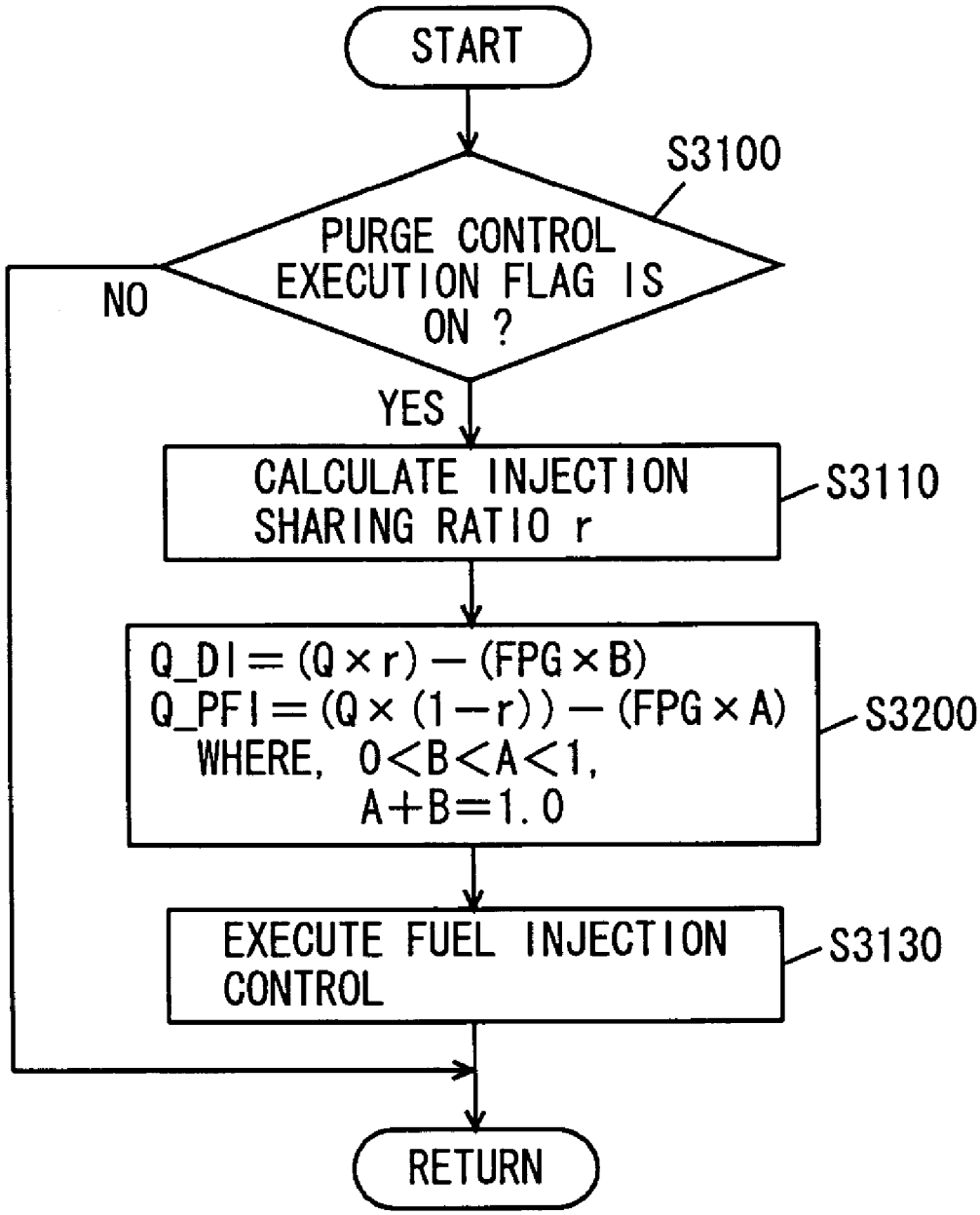

Referring to FIG. 15, description will now be given on the control structure of the program executed by engine ECU 300, which is the control device according to this modification. In a flowchart of FIG. 15, steps of the same processing as those in the flowchart of FIG. 13 bear the same reference numbers. Therefore, description thereof is not repeated.

In step S3200, engine ECU 300 calculates injection amount Q_DI of in-cylinder injector 10 by (Q_DI=(Q×r)−(FRG×B)), and also calculates injection amount Q_PFI of intake manifold injector 120 by (Q_PFI=Q×(1−r)−FRG×A), where A and B are constants satisfying relationships of (0<B<A<1) and (A+B=1). Since constant A is larger than B, injection amount Q_PFI of intake manifold injector 120 is affected by purge correction amount FPG to a higher extent than the other.

Based on the foregoing structures and flowcharts, engine ECU 300, which is the control device according to this modification, executes the injection sharing control during the purge processing of engine 10, and this control performed during the purge processing will now be described.

When the control is effected on the injection sharing between in-cylinder injector 110 and intake manifold injector 120 based on the map of FIG. 2, and the purge processing is executed (YES in S3100), injection sharing ratio r between in-cylinder injector 110 and intake manifold injector 120 is calculated (S3100). This calculation of injection sharing ratio r is performed based on the predetermined map of FIG. 2.

Constant A is larger than constant B, and injection amount Q_DI of in-cylinder injector 110 is calculated by (Q×r−FRG×B). Also, injection amount Q_PFI of intake manifold injector 120 is calculated by (Q×(1−r)−FRG×A).

Figure 16:
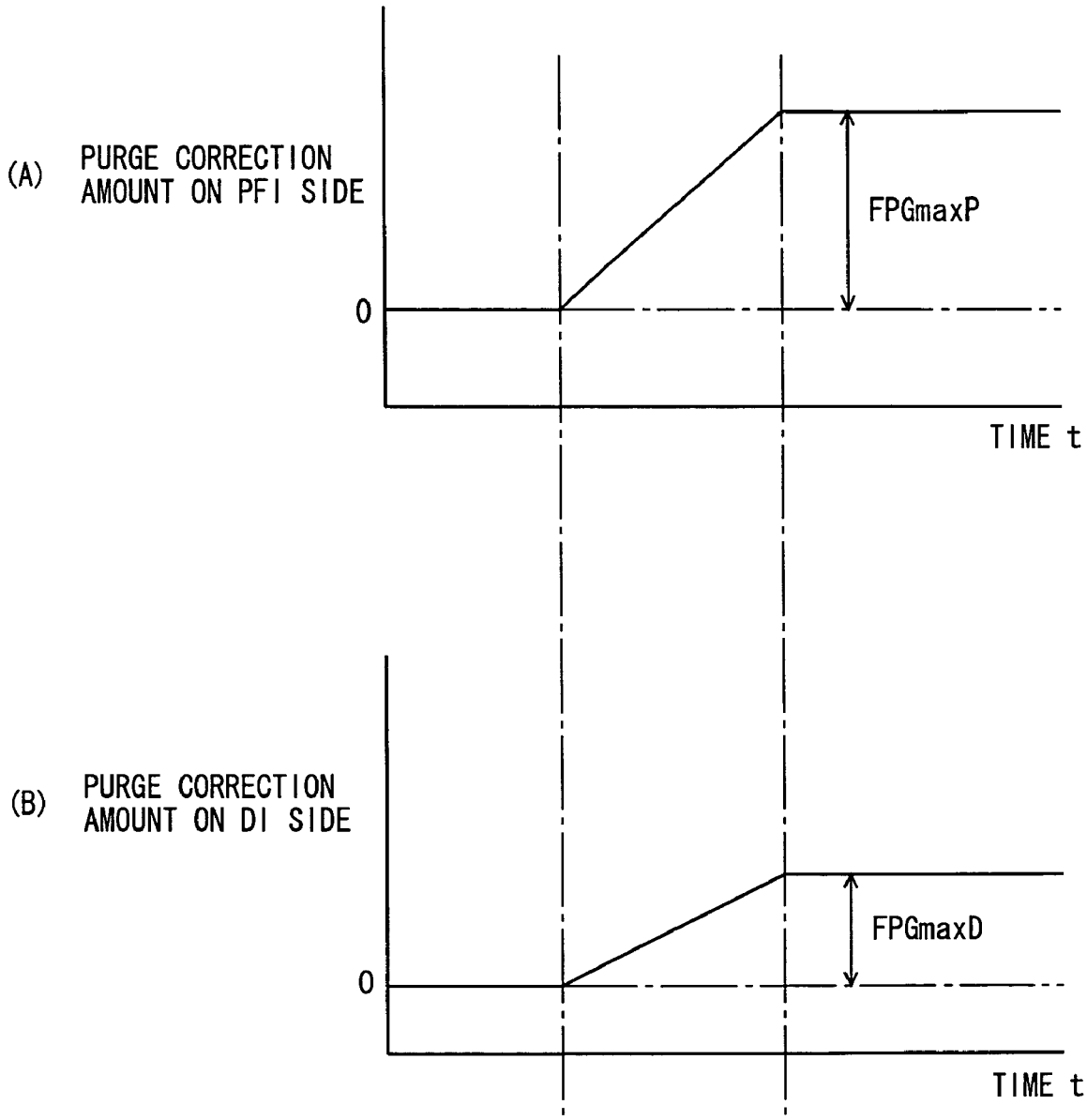

FIG. 16A illustrates changes in purge correction amount of intake manifold injector 120 with time, and FIG. 16B illustrates changes in purge correction amount of in-cylinder injector 110 with time. As illustrated in FIGS. 16A and 16B, the purge correction amount FPG is corrected in each of in-cylinder injector 110 and intake manifold injector 120 in a shared manner when the purge processing is executed. Constant B is smaller than constant A so that a correction amount of in-cylinder injector 110 may smaller that that of intake manifold injector 120.

As illustrated in FIGS. 16A and 16B, an inclination of the change in purge correction amount of in-cylinder injector 110 is smaller than an inclination of the change in purge correction amount of intake manifold injector 120. As illustrated in FIGS. 16A and 16B, when each of in-cylinder injector 110 and intake manifold injector 120 reaches the maximum purge correction amount (i.e., FPGmaxD in the case of in-cylinder injector 10, and FRGmaxP in the case of intake manifold injector 120), the purge correction amount can be increased no longer. This situation occurs, e.g., in such a case that the corrected fuel injection amount is smaller than the minimum fuel injection amount of in-cylinder injector 10 or intake manifold injector 120.

In the engine system controlled by the engine ECU according to the modification, when the purge processing is executed, the control is performed such that the ratio of correction using the intake manifold injector is larger than the ratio of correction using the in-cylinder injector, as described above. Thereby, the correction is effected on the fuel injection amount corresponding to the introduced purged fuel amount while suppressing changes in fuel injected from in-cylinder injector as far as possible. Thereby, a difference hardly occurs between the fuel amounts injected from the in-cylinder injector before and after the start of purge processing. This suppresses reduction in fuel injection amount of the in-cylinder injector, and therefore suppresses rising in tip temperature of the in-cylinder injector so that it is possible to prevent the production of deposits, and therefore to ensure the normal operation of the in-cylinder injector.

Description will now be given on a second modification of fuel injection control of a control device according to the embodiment. The control device according to this modification executes a program different from those of the control devices according to the second embodiment and the first modification of the second embodiment. This modification employs the same hardware structures and others as those in FIGS. 1 to 3, and therefore description thereof is not repeated.

Figure 17:
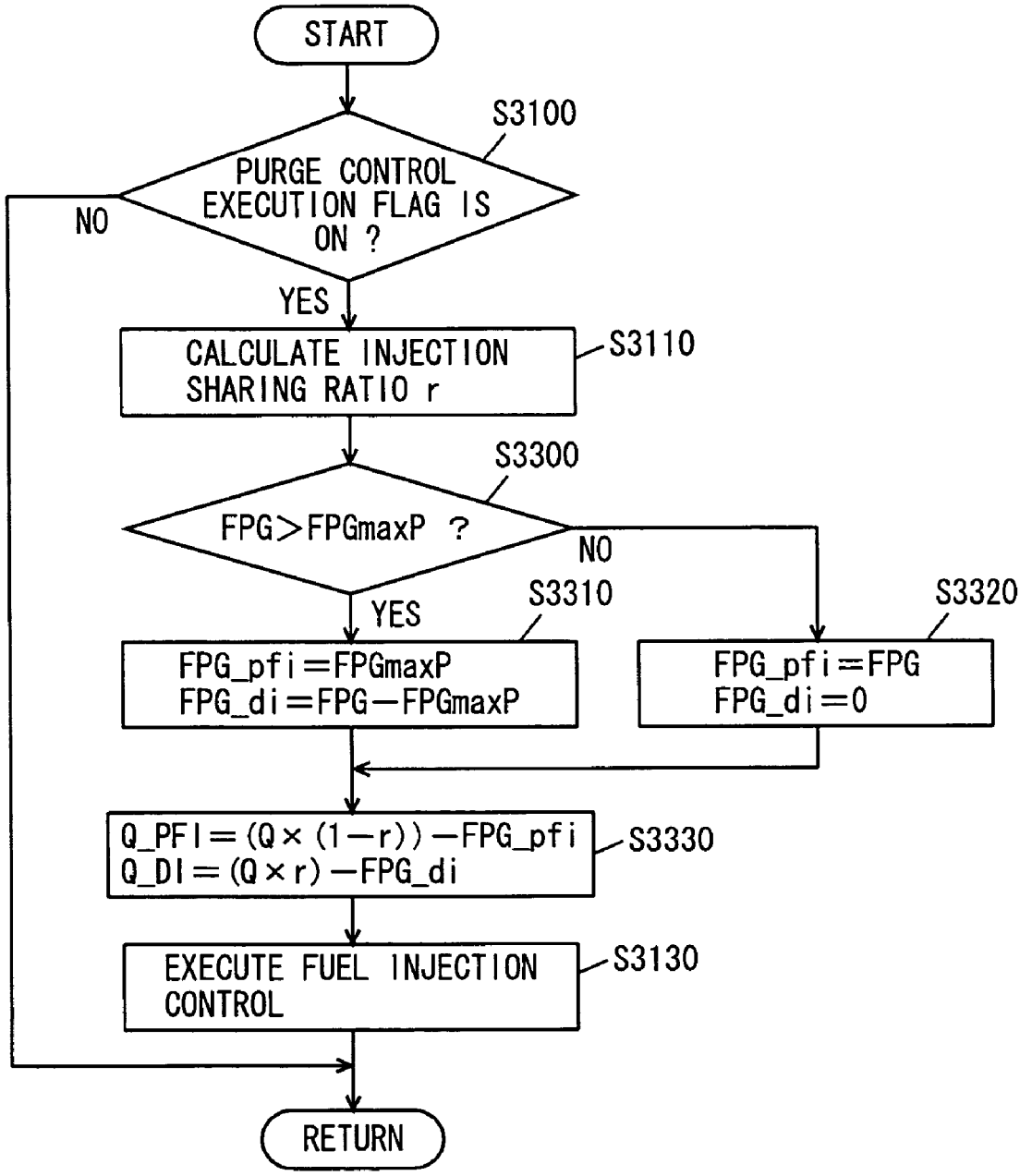

Referring to FIG. 17, description will now be given on the control structure of the program executed by engine ECU 300, which is the control device according to this modification. In a flowchart of FIG. 17, steps of the same processing as those in the flowchart of FIG. 13 bear the same reference numbers. Therefore, description thereof is not repeated.

In step S3300, engine ECU 300 determines whether purge correction amount FPG is larger than maximum purge correction amount FPGmaxP of intake manifold injector 120 or not. When purge correction amount FPG required in the purge processing is larger than maximum purge correction amount FPGmaxP of intake manifold injector 120 (YES in S3300), the process proceeds to step S3310. Otherwise (NO in S3300), the process proceeds to step S3320.

In step S3310, engine ECU 300 calculates a purge correction amount FPG_pfi of intake manifold injector 120 as (FPG_pfi=FPGmaxP), and calculates a purge correction amount FPG_di of in-cylinder injector 110 as (FPG_di=FPG−FPGmaxP).

In step S3320, engine ECU 300 calculates purge correction amount FPG_pfi of intake manifold injector 120 as (FPG_pfi=FPGmaxP), and calculates purge correction amount FPG_di of in-cylinder injector 110 as (FPG_di=0).

In step S3330, engine ECU 300 calculates injection amount Q_PFI of intake manifold injector 120 as (Q_PFI=Q×(1−r)−FPG_pfi), and calculates injection amount Q_DI of in-cylinder injector 110 as (Q_DI=Q×r−FPG_di).

Based on the foregoing structures and flowcharts, engine ECU 300, which is the control device according to this modification, executes the injection sharing control during the purge processing of engine 10, and this control performed during the purge processing will now be described.

When the control is effected on the injection sharing between in-cylinder injector 110 and intake manifold injector 120 based on the map of FIG. 2, and the purge processing is executed (YES in S3100), injection sharing ratio r is calculated (S3100). This calculation of injection sharing ratio r is performed based on the predetermined map of FIG. 2.

When purge correction amount FPG required in the purge processing is smaller than maximum purge correction amount FPGmaxP of intake manifold injector 120 (NO in S3300), purge correction amount FPG_pfi of intake manifold injector 120 is set as required purge correction amount FPG. Purge correction amount FPG_di of intake manifold injector 120 is set to zero.

When purge correction amount FPG required in the purge processing increases above maximum purge correction amount FPGmaxP of intake manifold injector 120 (YES in S3300), purge correction amount FPG_pfi of intake manifold injector 120 is fixed to FPGmaxP, and purge correction amount FPG_di of in-cylinder injector 110 is calculated as (FPG_di=FPG−FPGmaxP).

Figure 18:
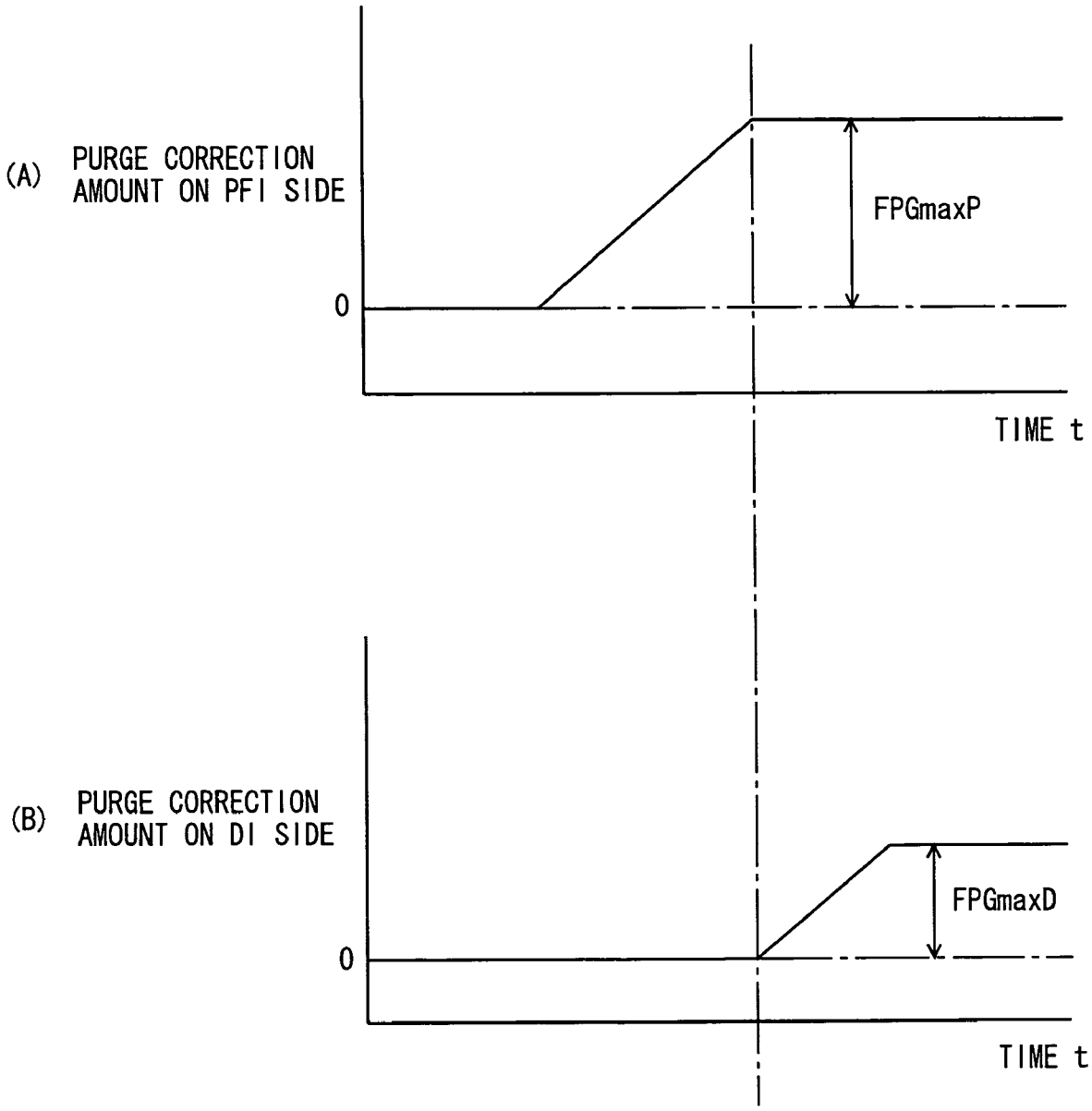

FIG. 18A illustrates changes in purge correction amount of intake manifold injector 120 with time, and FIG. 18B illustrates changes in purge correction amount of in-cylinder injector 110 with time. As illustrated in FIG. 18A, the purge processing is executed, and the purge correction amount of intake manifold injector 120 increases with increase in required purge correction amount FPG, and reaches FPGmaxP. When the purge correction amount of intake manifold injector 120 reaches maximum purge correction amount Pap of intake manifold injector 120, in-cylinder injector 110 executes the purge correction as illustrated in FIG. 18B. As illustrated in FIG. 18B, the maximum value of the purge correction amount of intake manifold injector 120 is FRGmaxP, and the maximum value of the purge correction amount of in-cylinder injector 110 is FPGmaxD.

In the engine system controlled by the engine ECU according to this modification, as described above, the control is performed during the purge processing such that the fuel injected from the in-cylinder injector does not change until the correction amount of the intake manifold injector exceeds the maximum correction amount. Thus, the correction of the fuel injection amount corresponding to the purged fuel amount is performed by using the intake manifold injector as far as possible. This can expand a region in which the fuel injection amount of the intake manifold injector does not change after the start of purge processing. It is possible to expand a range in which the fuel injection amount of the in-cylinder injector does not decrease, and the tip temperature of the in-cylinder injector does not rise in this region so that the production of deposits can be prevented, and the normal operation of the in-cylinder injector can be ensured.

Fourth Embodiment

Description will now be given on a control device of an internal combustion engine according to a fourth embodiment of the invention. The fourth embodiment employs the same structures and operations as those in FIGS. 1 to 3 of the first embodiment, and therefore description thereof is not repeated.

Figure 19:
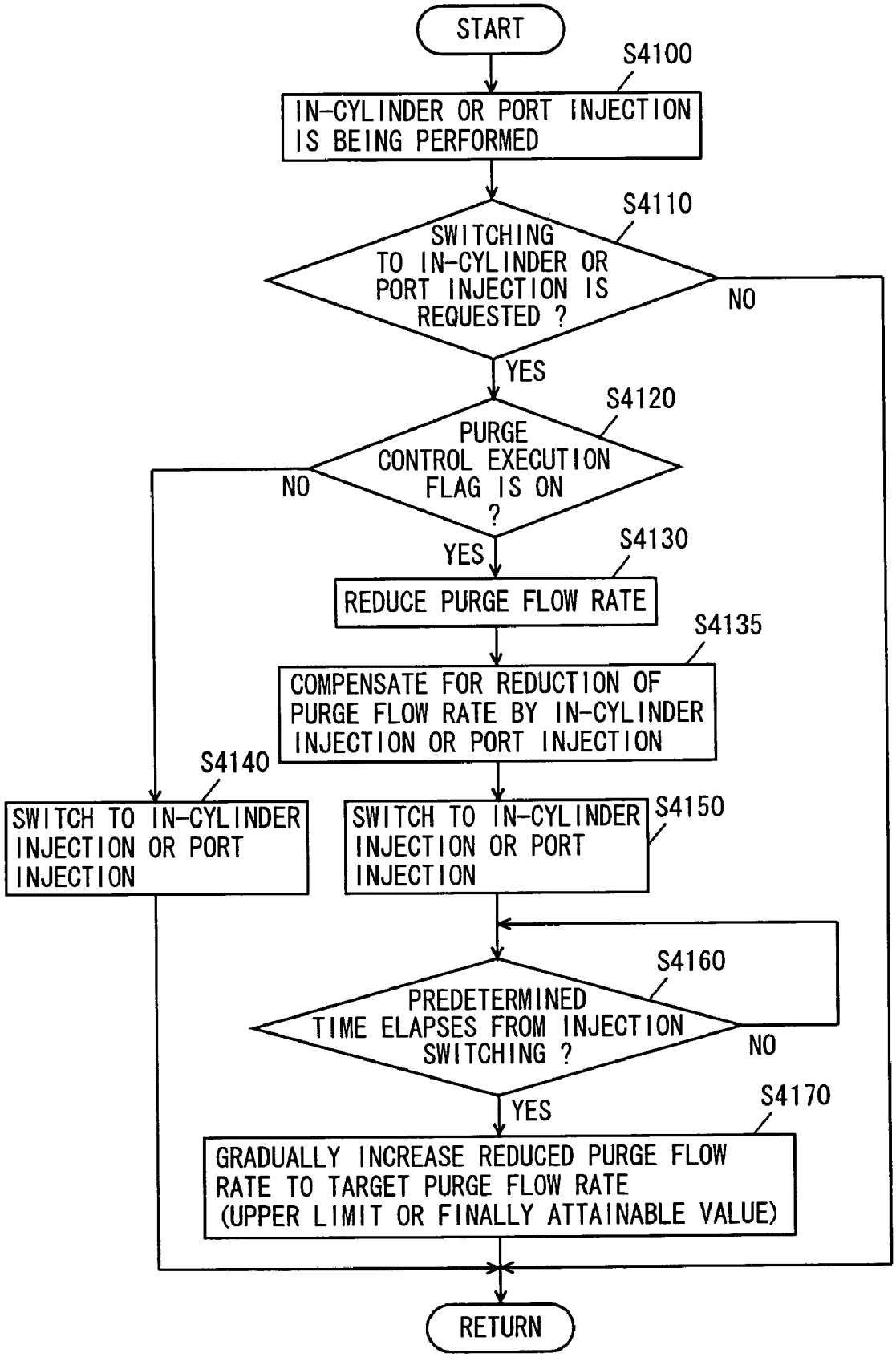
FIGS. 19–22 are flowcharts illustrating a control structure of a program executed by an engine ECU, which is a control device of a fourth embodiment of the invention.

Referring to FIG. 19, description will now be given on a control structure of a program for correcting the purged fuel amount when the purge control is being executed. The control program illustrated in FIG. 19 is executed at every predetermined time or every predetermined crank angle.

Engine ECU 300, which is a control device according to this embodiment, adjusts the purge amount when the fuel injection is switched (1) from the injection only by intake manifold injector 120 to the injection only by in-cylinder injector 110, (2) from the injection only by in-cylinder injector 110 to the injection only by intake manifold injector 120, (3) from the injection only by in-cylinder injector 110 to the injection by intake manifold injector 120 and in-cylinder injector 110, or (4) from the injection by in-cylinder injector 110 and intake manifold injector 120 to the injection only by in-cylinder injector 110. In the following description, "switch request for in-cylinder injection or port injection" means a request for one of the above four switching manners.

In the above manners (1) and (4), the fuel injection by intake manifold injector 120 terminates. In this case, since intake manifold injector 120 no longer injects the fuel, the temperatures of intake manifold 120 and the intake port located downstream from intake manifold injector 120 rise so that the purge flow rate itself and the amount of purged fuel adhering onto a wall change (decrease). Therefore, the amount of fuel supplied into the combustion chamber changes so that the air-fuel ratio may fluctuate to cause the combustion fluctuations. For the above case, therefore, the purge amount is changed to avoid the combustion fluctuations.

In the above manners (2) and (3), intake manifold injector 120 starts the fuel injection. In this case, since the fuel injection by intake manifold injector 120 starts, the temperatures of intake manifold 120 and the intake port located downstream of intake manifold injector 120 lower so that the purge flow rate itself and the amount of purged fuel adhering onto the wall change (increase). Therefore, the amount of fuel supplied into the combustion chamber changes so that the air-fuel ratio may fluctuate to cause the combustion fluctuations. For the above case, the purge amount is changed to avoid the combustion fluctuations.

In step S4100 illustrated in FIG. 19, engine ECU 300 controls in-cylinder injector 110 and intake manifold injector 120, based on the sharing ratio in FIG. 2, such that in-cylinder injector 110 injects the fuel into the cylinder, or intake manifold injector 120 injects the fuel into the intake manifold.

In step S4110, engine ECU 300 determines whether there is a request for switching to the in-cylinder injection or the port injection or not. In this case, engine ECU 300 determines whether there is a switch request for one of the foregoing four manners (1)–(4) or not. When the switch to the in-cylinder injection or the port injection is requested (YES in S4110), the process proceeds to step S4120. If not (NO in S4110), this processing ends.

In step S4120, engine ECU 300 determines whether a purge execution flag is on or not. This purge execution flag is set to on in step S450 in FIG. 4. When the purge execution flag is on (YES in S4120), the process proceeds to step S4130. If not (NO in S4120), the process proceeds to step S4140.

In step S4130, engine ECU 300 decreases the purge flow rate. In step S4135, engine ECU 300 calculates the fuel injection amount such that either in-cylinder injector 110 or intake manifold injector 120 (at least the one performing the fuel injection) compensates for the shortage of the purge flow rate.

In steps S4140 and S4150, engine ECU 300 controls in-cylinder injector 110 and intake manifold injector 120 for switching to the in-cylinder injection or the port injection. After the processing in step S4140, this processing ends. After the processing in step S4150, the process proceeds to step S4160.

In step S4160, engine ECU 300 determines whether a predetermined time elapses after the injection switching or not. When the predetermined time elapses after the injection switching (YES in S4160), the process proceeds to step S4170. If not (NO in S4160), the process returns to step S4160 for waiting for elapsing of the predetermined time.

In step S4170, engine ECU 300 gradually increases the reduced purge flow rate to a target purge flow rate (i.e., an upper limit of the purge flow rate or a finally attainable value in purge flow rate control).

Based on the foregoing structures and flowcharts, engine ECU 300, which is the control device according to the embodiment, executes the correction control of the purged fuel amount at the time of injection switching in engine 10. The following description will be given on the control during execution of the purge processing.

In the case where the control is effected on the injection sharing between in-cylinder injector 110 and intake manifold injector 120 based on the map of FIG. 2 (S4100), when the switching to the in-cylinder injection or port injection is requested (YES in S4110), and the purge control execution flag is on (YES in S4120), control is performed to reduce the purge flow rate (S4130), and thereby to compensate for the reduction in purge flow rate (S4135).

As described above, the requested switching to the in-cylinder injection or the port injection is performed (S4150) after the purge flow rate is reduced. When a predetermined time elapses after the injection switching (YES in S4160), the reduced purge flow rate gradually returns to the target purge flow rate (S4170), and the desired purge processing is recovered.

As described above, the engine ECU, which is the control device of the internal combustion engine according to the embodiment, achieves the following effects. When the intake manifold injector stops the fuel injection, or when the intake manifold injector starts the fuel injection, the temperatures of the intake manifold and intake port change so that the purge flow rate itself and the amount of purged fuel adhering to the wall also change. Thereby, the amount of fuel supplied into the combustion chamber changes so that the air-fuel ratio varies to cause the combustion fluctuations. Therefore, in the case where the injection switching is requested, the injection switching is executed after reducing the purge flow rate, and the purge flow rate will be gradually increased to the target purge flow rate after elapsing of the predetermined time from the injection switching. Thereby, it is possible to avoid the combustion fluctuations due to the purged fuel at the time of injection switching, and the lowering of performance and the deterioration of emissions can be suppressed.

Description will now be given on a first modification of the fuel injection control in the control device according to the embodiment. The control device according to this modification executes a program different from that of the control device according to the foregoing second embodiment. This modification employs the same hardware structures and others as those in FIGS. 1 to 3, and therefore description thereof is not repeated.

Figure 20:
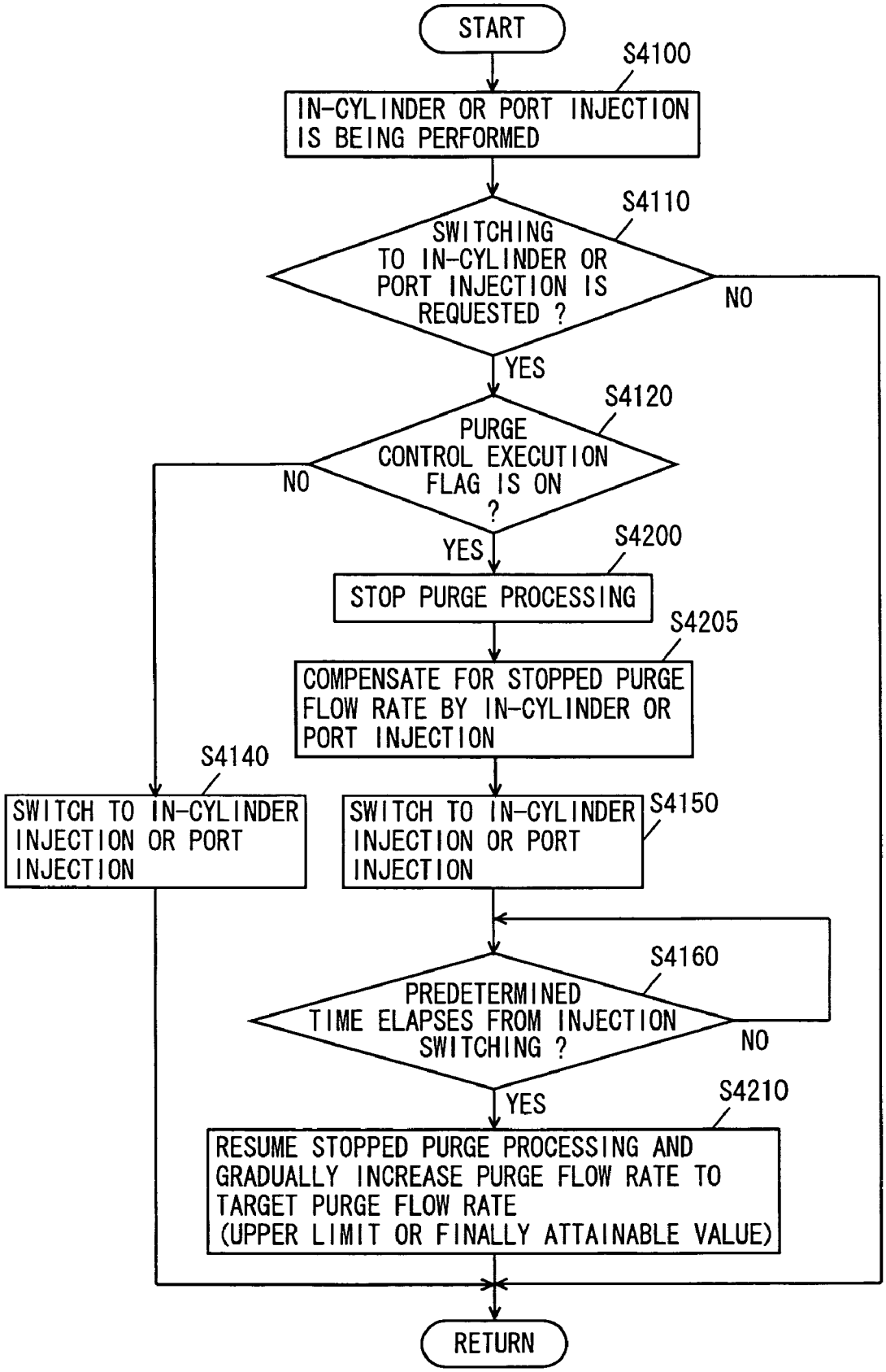

Referring to FIG. 20, description will now be given on the control structure of the program executed by engine ECU 300 according to this modification. In a flowchart of FIG. 20, steps of the same processing as those in the flowchart of FIG. 19 bear the same reference numbers. Therefore, description thereof is not repeated.

In step S4200, engine ECU 300 stops the purge processing (i.e., sets the purge flow rate to 0). In step S4205, engine ECU 300 calculates the fuel injection amount so that in-cylinder injector 110 or intake manifold injector 120 (at least the one performing the fuel injection) may compensate for the stopped purge flow rate.

In step S4210, engine ECU 300 resumes the purge processing, and gradually increases the purge flow rate to the target flow rate (the purge flow rate upper limit or the finally attainable value in purge flow rate control).

Based on the foregoing structures and flowcharts, engine ECU 300, which is the control device according to this modification, executes the correction control of the purged fuel amount at the time of injection switching in engine 10, and this correction control will now be described.

In the case where the control is effected on the injection sharing between in-cylinder injector 110 and intake manifold injector 120 based on the map of FIG. 2 (S4100), when switching to the in-cylinder injection or port injection is requested (YES in S4110), and the purge control execution flag is on (YES in S4120), the control is performed to stop the purge processing (S4200).

After the purge processing stops (S4200), the compensation for the stopped purge flow is performed (S4205), and the switching to the in-cylinder injection or port injection is performed as requested (S4140, S4150). When the predetermined time elapsed from the injection switching (YES in S4160), the purge processing is resumed to increase gradually the purge flow rate to the target purge flow rate (S4210), and returns to the desired purge processing.

As described above, according to the engine ECU, which is the control device of the internal combustion engine according to this modification, when the injection switch request is made, the purge processing stops, and then the injection switching is executed. When the predetermined time elapses after the injection switching, the purge processing is resumed to increase gradually the purge flow rate to the target purge flow rate. Thereby, the combustion fluctuations due to the purged fuel is avoided at the time of injection switching, and the lowering of performance and the deterioration of emissions can be suppressed.

Description will now be given on a second modification of the fuel injection control in the control device according to this embodiment. The control device according to this modification executes a program different from those of the foregoing control devices according to the third embodiment and the first modification of the third embodiment. This modification employs the same hardware structures and others as those in FIGS. 1 to 3, and therefore description thereof is not repeated.

Figure 21:
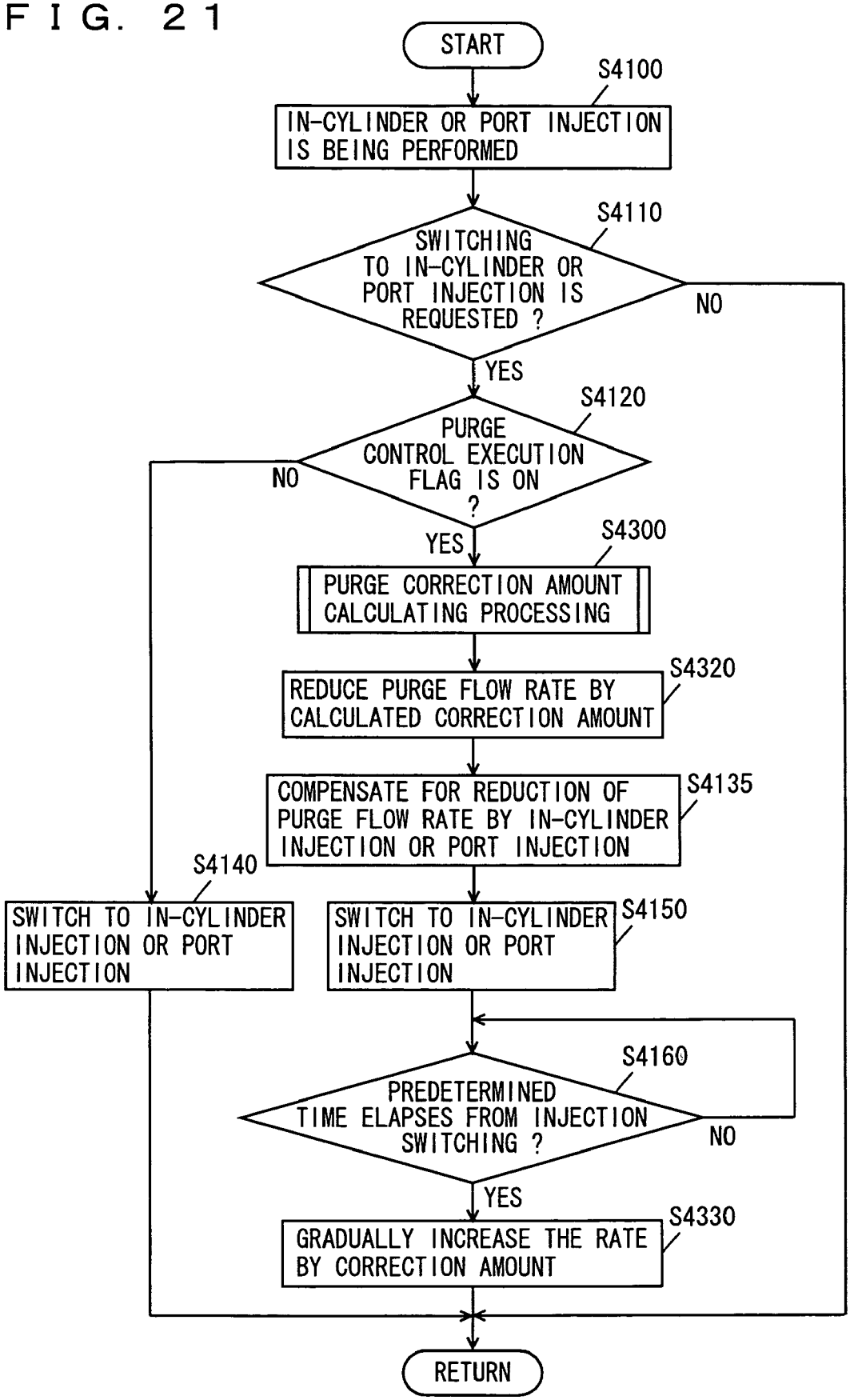
Figure 22:
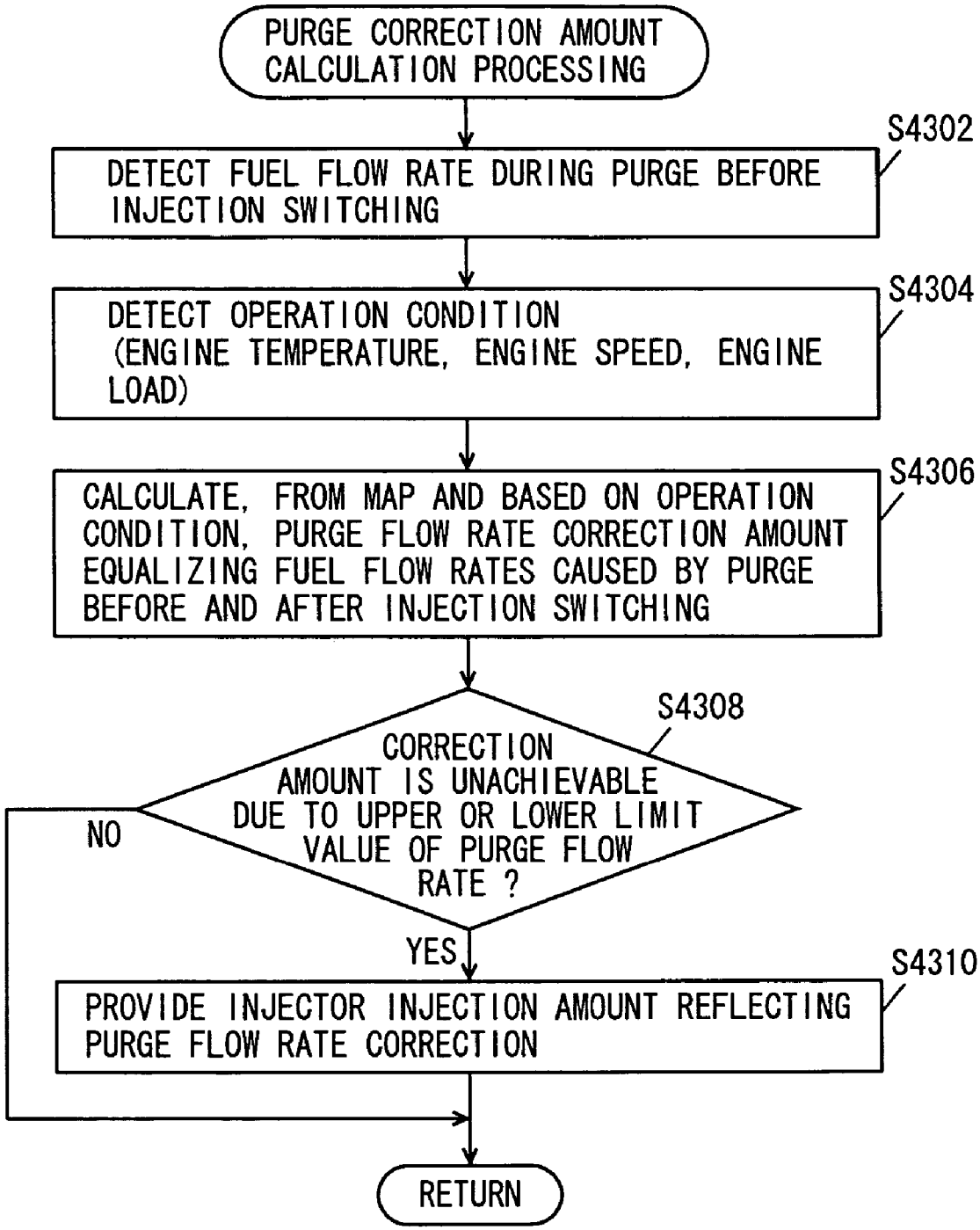

Referring to FIGS. 21 and 22, description will now be given on the control structure of the program executed by engine ECU 300 according to this modification. In a flowchart of FIG. 21, steps of the same processing as those in the flowchart of FIG. 19 bear the same reference numbers. Therefore, description thereof is not repeated.

In step S4300, engine ECU 300 executes the purge correction amount calculating processing (subroutine). This subroutine will be described later in detail.

In step S4320, engine ECU 300 reduces the purge flow rate by the correction amount calculated in the subroutine. In step S4330, engine ECU 300 gradually increases the flow rate by the amount corresponding to the above correction amount. In this case, engine ECU 300 gradually increases the purge flow rate to the target purge flow rate (purge flow rate upper limit or finally attainable value of purge flow rate).

Referring to FIG. 22, description will now be given on the control structure of the program of purge correction amount calculating processing executed by engine ECU 300.

In step S4302, engine ECU 300 detects the fuel flow rate during the purge before the injection switching. In step S4303, engine ECU 300 detects operation conditions (the temperature, engine speed and load) of engine 10.

In step S4306, engine ECU 300 makes a calculation according to a predetermined map to determine, based on the operation conditions, the purge flow rate correction amount such that the fuel flow rate affected by the purge does not change after the injection switching.

In step S4308, engine ECU 300 determines whether the purge flow rate correction amount thus calculated can be achieved or not, in view of the upper and lower limits of the purge flow rate. When the calculated purge flow rate correction amount can be achieved (YES in S4308), the process proceeds to step S4310. If not (NO in S4308), this subroutine processing ends, and the process returns to step S4320 in FIG. 21.

In step S4310, engine ECU 300 provides the injector injection amount reflecting the unachievable purge correction amount. For example, when the calculated correction value is smaller than the lower limit of the purge flow rate, the purge flow rate is set to the lower limit, and in-cylinder injector 110 or intake manifold injector 120 reduces its fuel injection amount by an amount corresponding to a difference between the purge correction amount and the lower limit. Thereafter, the subroutine processing ends, and the process returns to step S4320 in FIG. 21.

Based on the foregoing structures and flowcharts, engine ECU 300, which is the control device according to this modification, executes the correction control of the purged fuel amount at the time of injection switching in engine 10, and this correction control will now be described.

In the case where the control is effected on the injection sharing between in-cylinder injector 110 and intake manifold injector 120 based on the map of FIG. 2 (S4100), when switching to the in-cylinder injection or port injection is requested (YES in S4110), and the purge control execution flag is on (YES in S4120), the purge correction amount calculating processing is executed (S4300).

In the purge correction amount calculating processing, the purge correction amount is calculated based on the operation conditions of engine 10 (S4306). When the purge correction amount calculated from the upper and lower limit values of the purge flow rate is unachievable (YES in S4308), the fuel injection amount(s) of in-cylinder injector 110 and/or intake manifold injector 120 are corrected by a part of the purge correction amount (S4310).

After the purge flow rate is reduced by the calculated purge correction amount (S4320), switching to the in-cylinder injection or port injection is performed as requested (S4150). When the predetermined time elapses after the injection switching (YES in S4160), the purge flow rate gradually returns from the corrected value to the target value (S4330), and the desired purge processing is recovered.

As described above, according to the engine ECU, which is the control device of the internal combustion engine according to this modification, when the injection switch request is made, the purge processing is controlled to reduce the purge flow rate to the appropriate purge correction amount based on the operation conditions of the engine, and then the injection switching is executed. When the predetermined time elapses after the injection switching, the purge flow rate is gradually increased by the purge correction amount. Thereby, the combustion fluctuations due to the purged fuel is avoided at the time of injection switching, and the lowering of performance and the deterioration of emissions can be suppressed.

Fifth Embodiment

Description will now be given on a control device of an internal combustion engine according to a fifth embodiment of the invention. The fifth embodiment employs the same structures and operations as those in FIGS. 1 to 3 of the first embodiment, and therefore description thereof is not repeated.

Figure 23:
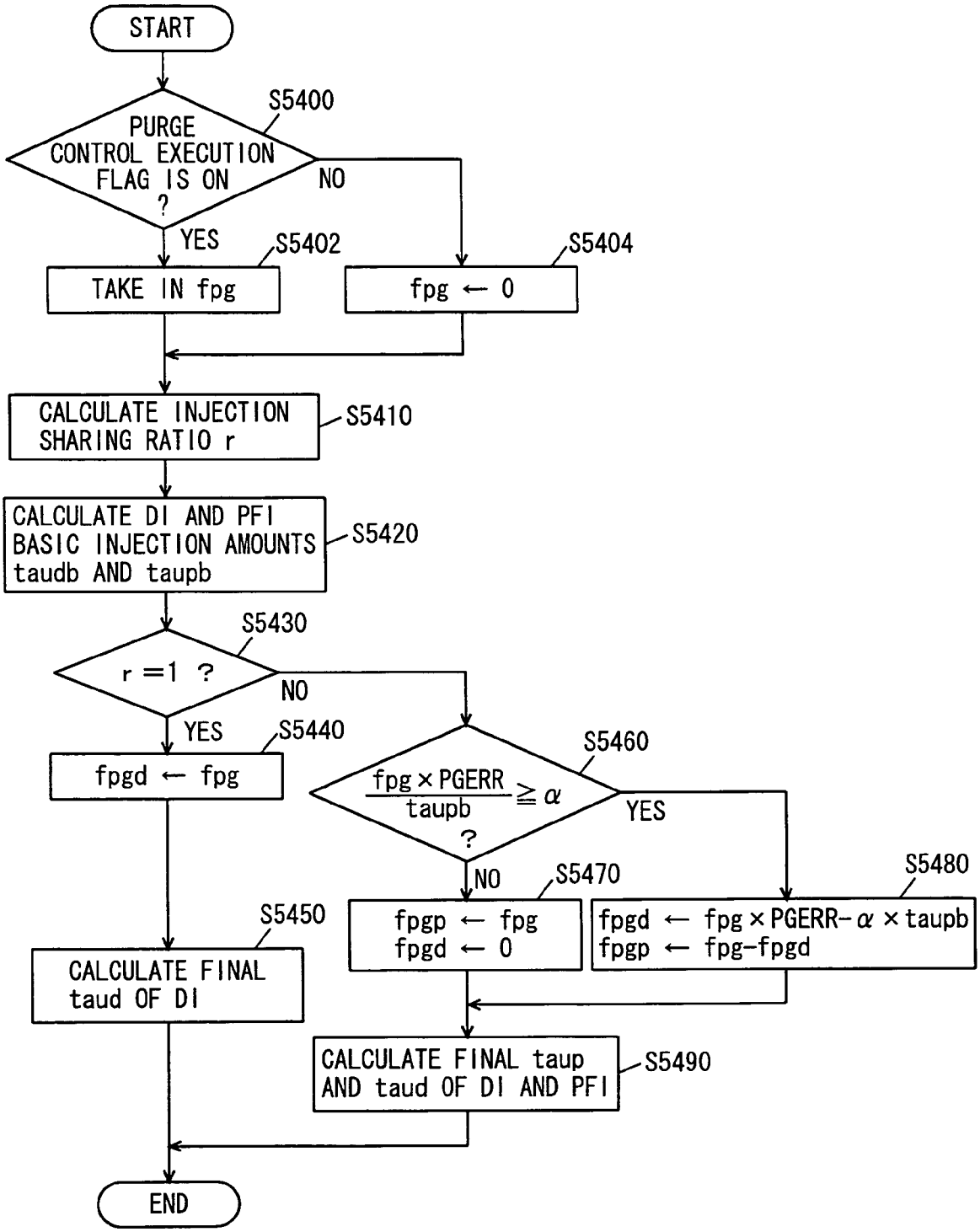
FIG. 23 is a flowchart illustrating a control structure of a program executed by an engine ECU, which is a control device of a fifth embodiment of the invention.

Referring to FIG. 23, description will now be given on a control structure of a program for calculating purge correction amount fpgd of in-cylinder injector 110 and purge correction amount fpgp of intake manifold injector 120 when the purge control is being executed. The control program illustrated in FIG. 23 is executed at every predetermined time or every predetermined crank angle.

In step S5400, engine ECU 300 determines whether the purge execution flag is on or not. In step S340 in FIG. 3, the purge execution flag is turned on. When the purge execution flag is on (YES in S5400), the process proceeds to step S5402. If not (NO in S5400), the process returns to step S5404.

In step S5402, engine ECU 300 takes in a value of purge correction amount fpg. In step S5402, engine ECU 300 substitutes 0 for purge correction amount fpg. After the processing in steps S5402 and S5404, the process proceeds to step S5410.

In step S5410, engine ECU 300 calculates the injection sharing ratio (DI ratio r) between in-cylinder injector 10 and intake manifold injector 120 with reference to the map in FIG. 2. In step S5420, engine ECU 300 calculates basic injection amounts taudb and taupb of in-cylinder injector 10 and intake manifold injector 120. Basic injection amount taudb of in-cylinder injector 110 is calculated from the following formula:

$$taudb=r\times EQMAX\times k1fwd\times fafd\times kgd\times kpr \quad (5\text{-}1)$$

Basic injection amount taupb of intake manifold injector 120 is calculated from the following formula:

$$taupb=k\times(1-r)\times EQMAX\times k1fwd\times fafp\times kgp \quad (5\text{-}2)$$

In the above formulas (5-1) and (5-2), r represents the injection sharing ratio (DI ratio), EQMAX represents the maximum injection amount, k1fwd represents the load factor, fafd and fafp represent the feedback coefficients in the stoichiometric state, kgd is the learned value of in-cylinder injector 110, kpr is the conversion coefficient corresponding to the fuel pressure, and kgp is the learned value of intake manifold injector 120.

In step S5430, engine ECU 300 determines whether DI ratio r is one or not. When DI ratio r is one (YES in S5430), the process proceeds to step S5440. If not (NO in S5430), the process proceeds to step S5460.

In step S5440, engine ECU 300 substitutes fpg for purge correction amount fpgd of in-cylinder injector 110. This purge correction value fpg can be calculated from the following formula:

$$fpg=pgr\times fgpg \quad (5\text{-}3)$$

where pgr is a target purge rate, i.e., a target value of a purge rate, which is a volume ratio of a purge amount with respect to an intake air amount), and fgpg is a purge concentration leaned value representing an influence rate (deviation amount) of A/F per unit purge rate (1%).

In step S5450, engine ECU 300 calculates final injection amount taud of in-cylinder injector 110 according to the following formula:

$$taud=taudb-fpgd \quad (5\text{-}4)$$

Thereafter, the processing ends.

Figure 24:
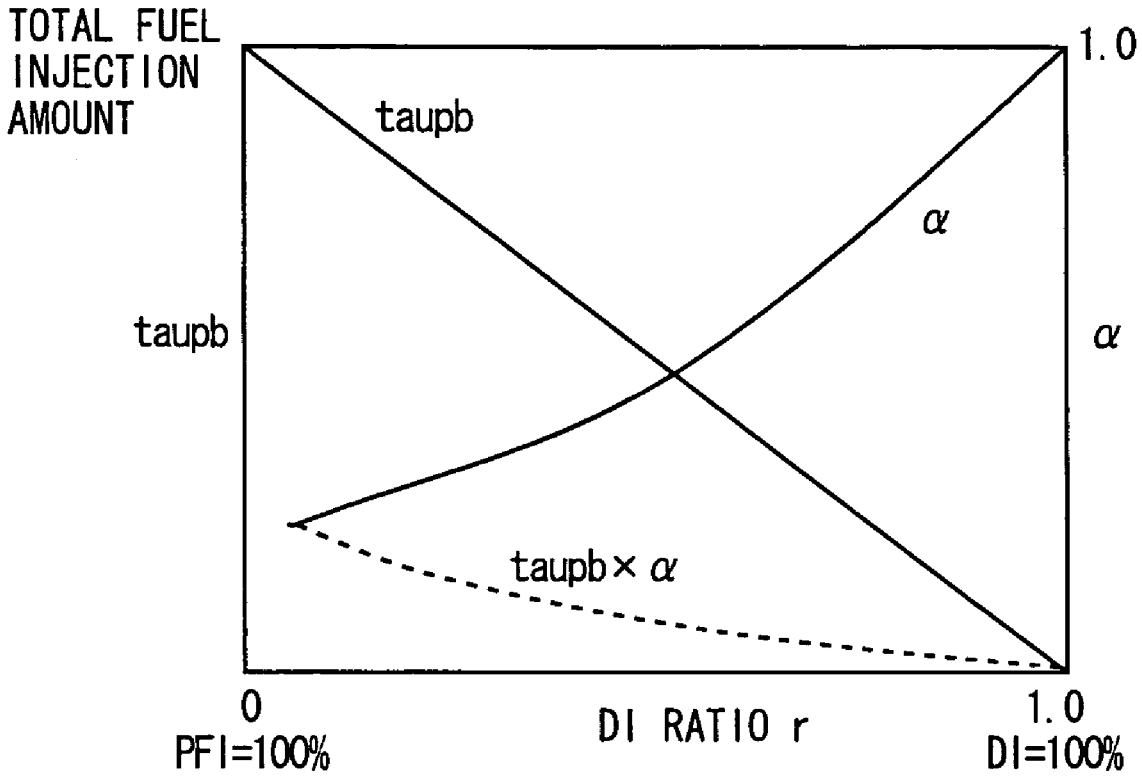
FIG. 24 illustrates a relationship between a DI ratio and a constant $\alpha$.

In step S5460, engine ECU 300 determines whether a relationship of $\{(fpg\times PGERR)/taupb\geqq\alpha\}$ is established or not, where PGERR is a constant, which means an error in fuel amount during the purge processing, and is smaller than one. Thus, PGERR is a constant representing a maximum extent, which is estimated in a difference in intake air amount between the cylinders as well as a difference in purge amount between the cylinders. If it is estimated that the purge processing decreases the fuel by up to 40% in a certain cylinder, PGERR is equal to 0.4. $\alpha$ is a predetermined value, and is a function of DI ratio r as illustrated in FIG. 24. $\alpha$ increases with DI ratio r, and decreases with decrease in DI ratio r. FIG. 24 illustrates only an example, and the invention is not restricted to this. When $\{(fpg\times PGERR)/taupb\geqq\alpha\}$ is satisfied (YES in S5460), the processing moves to step S5480. If not, (NO in S5460), the process proceeds to step S5470.

In step S5470, engine ECU 300 substitutes fpg for purge correction amount fpgp of intake manifold injector 120, and substitutes 0 to purge correction amount fpgd of in-cylinder injector 110. Thereafter, the process proceeds to step S5490.

In step S5480, engine ECU 300 substitutes $(fpg\times PGERR-\alpha\times taupb)$ for purge correction amount fpgd of in-cylinder injector 110, and substitutes (fpg−fpgd) for purge correction amount fpgd of intake manifold injector 120. Thereafter, the process proceeds to step S5490.

In step S5490, engine ECU 300 calculates final injection amount taud of in-cylinder injector 110 and final injection amount taup of intake manifold injector 120. Final injection amount taud is calculated from the foregoing formula (4). Final injection amount taup is calculated from the following formula:

$$taup=taupb-fpgp+tauv \quad (5\text{-}5)$$

where tauv is an invalid injection amount.

Based on the foregoing structures and flowcharts, engine ECU 300, which is the control device according to this embodiment, executes the injection sharing control during the purge processing of engine 10, and this sharing control will now be described.

[In the case of (DI ratio r=1)]

When the injection sharing ratio (DI ratio r) is equal to one (YES in S5430), the purge correction is performed by reducing the entire correction amount from the fuel injection amount of in-cylinder injector 110. Thus, purge correction amount fpg calculated by the formula (3) is substituted for purge correction amount fpgd of in-cylinder injector 110 (S5440), and purge correction amount fpgd is subtracted from basic injection amount taudb of in-cylinder injector 110 as represented by the formula (4) (S5450).

[In the case of (DI ratio r≠1)]

When the injection sharing ratio (DI ratio r) is not equal to one (NO in S5430), the purge correction is calculated in view of the difference in purge amount between the cylinders. If it is impossible to achieve the purge correction only by intake manifold injector 120, the purge correction is shared between in-cylinder injectors 110 and 120. This will be described in greater detail.

In the case of {(fpg×PGERR)/taupd≧α} (YES in S5460), purge correction amount fpgd of in-cylinder injector 110 is calculated as (fpg×PGERR−α×taupb), and purge correction amount fpgp of intake manifold injector 120 is calculated by (fpg−fpgd) (S5480). This restricts the reduction amount of the fuel injection amount of intake manifold injector 120 such that {fpg (purge correction amount)×PGERR (maximum estimated value of difference in purge amount between cylinders)} may be equal to or smaller than {taupb (basic fuel injection amount of intake manifold injector)×α}.

Purge correction amount fpgd of in-cylinder injector 110 is calculated by (fpg×PGERR−α×taupb), and (α×taupb) decreases with increase in DI ratio r (i.e., with decrease in injection ratio of intake manifold injector 120) as illustrated in FIG. 24. Therefore, as the injection ratio of intake manifold injector 120 decreases, purge correction value fpgd of in-cylinder injector 110 increases within a range where (fpg×PGERR) does not change. Purge correction amount fpgp of intake manifold injector 120 is calculated by (fpg−fpgd). Consequently, as the injection ratio of intake manifold injector 120 decreases, purge correction value fpgd of in-cylinder injector 110 increases, and therefore purge correction value fpgp of intake manifold injector 120 decreases. Thus, as the injection ratio of intake manifold injector 120 is smaller, the influence by the purge increases, and therefore stronger restriction is imposed on the amount by which the port injection is reduced due to the purge.

Figure 25:
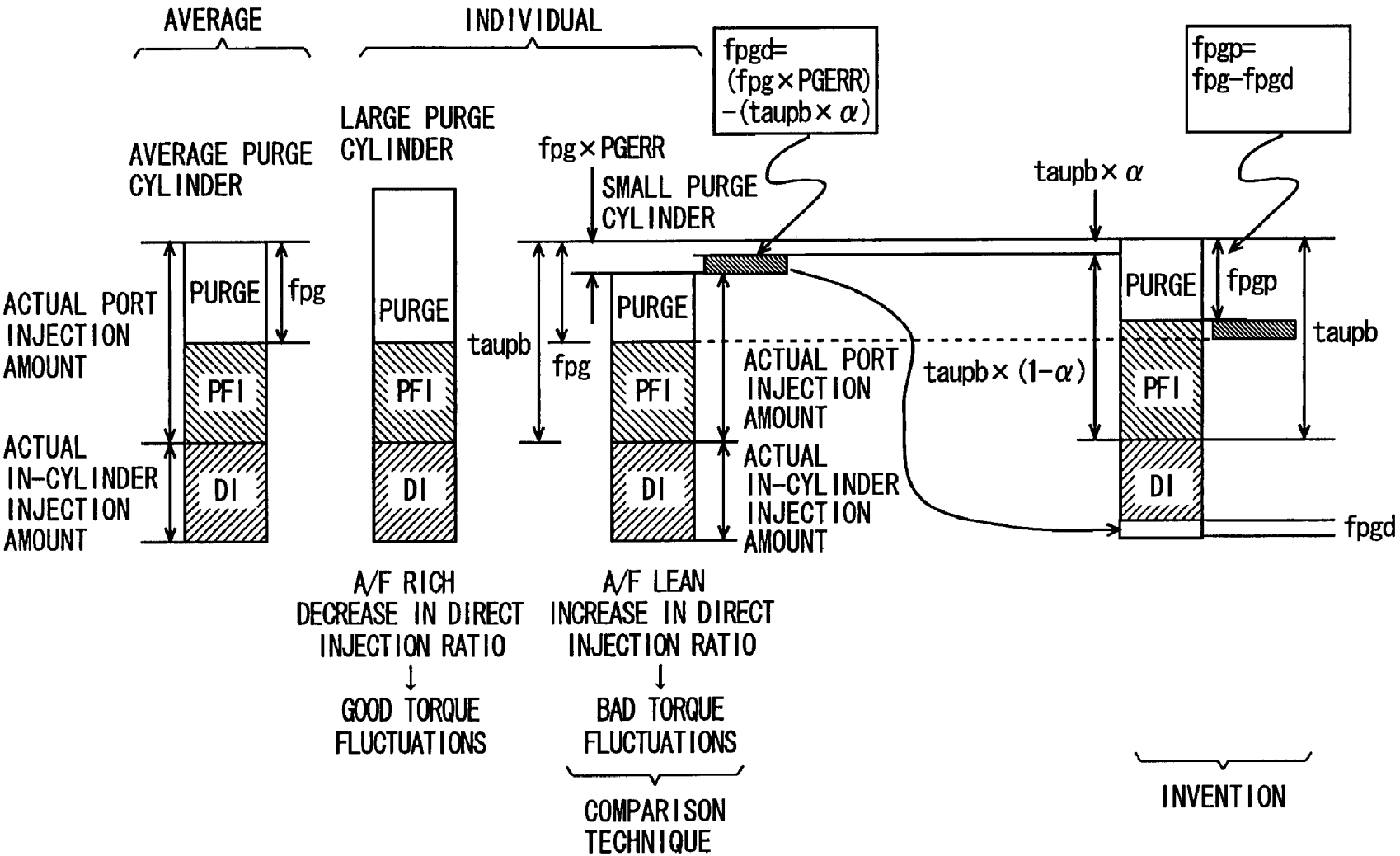
FIG. 25 illustrates a comparison between fuel injection amounts during purge processing.

FIG. 25 illustrates a comparison between the fuel injection amounts during execution of the purge processing. In FIG. 25, "AVERAGE" represents a basic manner of the purge correction. In this manner, the fuel injection amount (actual port injection amount in FIG. 25) of intake manifold injector 120 is calculated by subtracting purge correction value fpg. In this manner, a difference occurs in state of the combustion fluctuations between a cylinder of large purge and a cylinder of small purge, when viewed at "INDIVIDUAL" in FIG. 25. In the cylinder of the large purge, the air-fuel ratio (A/F) of the mixture in the combustion chamber becomes small (i.e., rich), and the direct injection ratio relatively decreases. Therefore, the air-fuel mixture taken from the intake port into the combustion chamber is mixed more uniformly, and the torque fluctuations attain a good state. In the cylinder of a small purge, the air-fuel ratio (A/F) of the mixture in the combustion chamber becomes large (i.e., lean), and the direct injection ratio becomes relatively large. Therefore, the mixture taken into the combustion chamber from the intake port is not mixed sufficiently uniformly so that the torque fluctuations are not in a good state.

In contrast to the above conventional manner, the invention restricts the reduction of the actual port injection fuel caused by the purge, and this restriction is performed so that good combustion can be achieved even when the purge amount is reduced by the maximum variation value, which is estimated. The actual port injection amount (a sum of the fuel injection amount of in-cylinder injector 110 and the purged fuel amount), which can achieve the above good combustion, is equal to {taupb ×(1−α)} of the "INVENTION" in FIG. 25. Thus, {taupb×(1−α)} is ensured as the actual port injection amount, and thereby good combustion is ensured.

For the above reasons, a conventional engine includes a cylinder in which the purged fuel amount lowers to (fpg×PGERR). According to the invention, however, the restriction is imposed for preventing the reduction to (fpg×PGERR) in view of the possible case where the purged fuel amount lowers to (fpg×PGERR). In this case, in-cylinder injector 110 and intake manifold injector 120 complement each other as follows. Intake manifold injector 120 injects the fuel of (fpg×PGERR−α×taupb) illustrated in FIG. 25, and the fuel injection amount of in-cylinder injector 110 is reduced by the same amount.

In the control device of the embodiment, as described above, when the purge is executed in the region where the in-cylinder injector and intake manifold injector share the injection, the restriction is imposed on the amount of reduction performed for purge correction of the intake manifold injector. In a multi-cylinder internal combustion engine, it is possible to avoid the reduction by a large amount in the cylinder of a small purge amount so that the stable combustion state can be maintained. In particular, when the sharing ratio of the intake manifold injector that is affected by the purge to a higher extent is small, the restriction is increased. Consequently, lowering of the performance and others can be avoided during the purge processing in the multi-cylinder engine sharing the fuel injection between the in-cylinder injector and intake manifold injector.

Sixth Embodiment

Description will now be given on a control device of an internal combustion engine according to a sixth embodiment of the invention. The sixth embodiment employs the same structures and operations as those in FIGS. 1 to 3 of the first embodiment, and therefore description thereof is not repeated.

Figure 26:
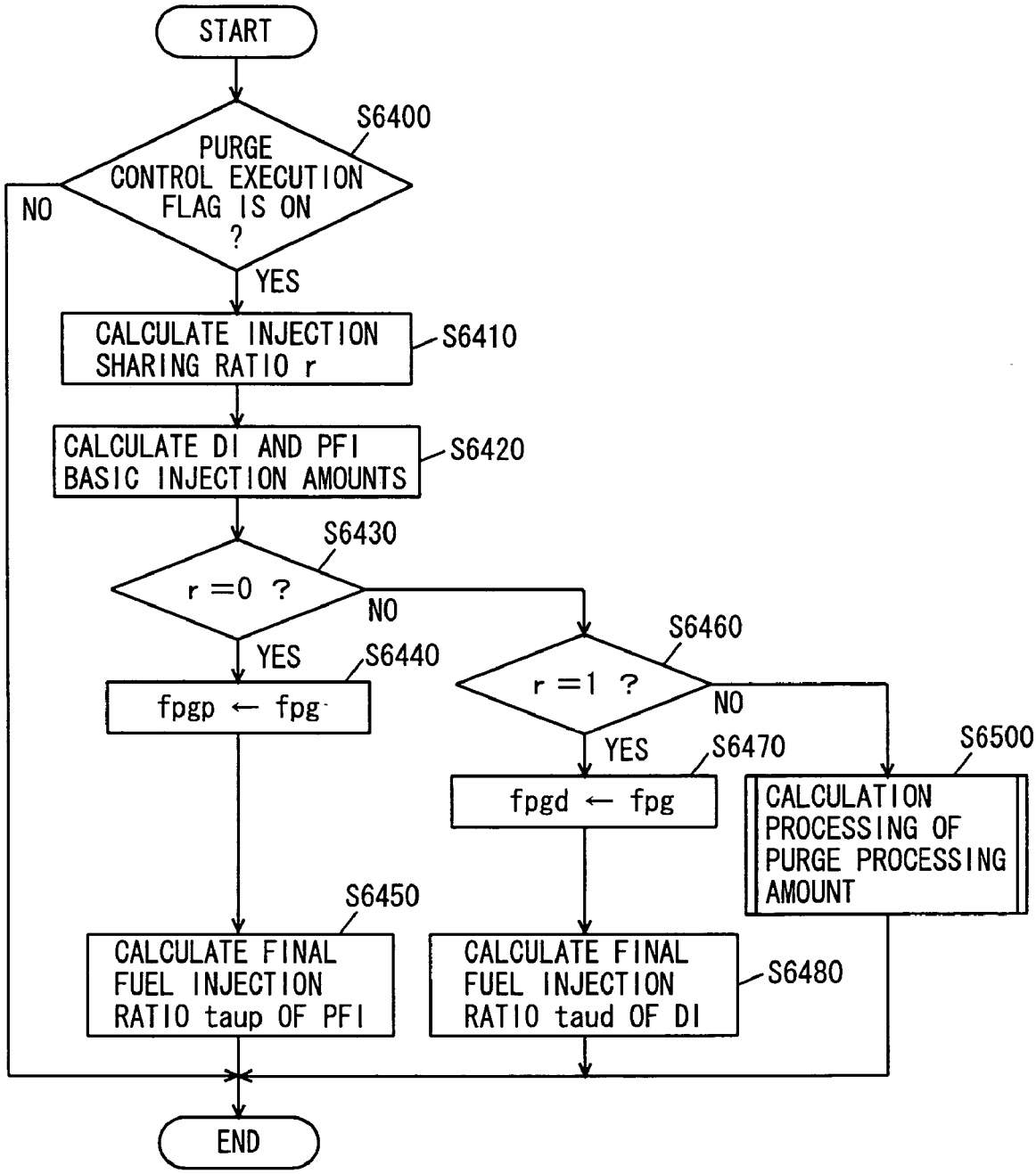
FIGS. 26 and 27 are flowcharts illustrating a control structure of a program executed by an engine ECU, which is a control device of a sixth embodiment of the invention.

Referring to FIG. 26, description will now be given on a control structure of a program for correcting the purged fuel amount. The control program illustrated in FIG. 26 is executed at every predetermined time or every predetermined crank angle.

In step S6400, engine ECU 300 determines whether the purge control execution flag is on or not. When the purge control execution flag is on (YES in S6400), the process proceeds to step S6410. If not (NO in S6400), the process ends.

In step S6410, engine ECU 300 calculates a sharing ratio (DI ratio) r. The map illustrated in FIG. 2 is used for this calculation of sharing ratio (DI ratio) r.

In step S6420, engine ECU 300 calculates the basic injection amounts of in-cylinder injector 110 (DI) and intake manifold injector 120 (PFI). Final injection amount taudb of in-cylinder injector 110 is calculated from the following formula:

$$taudb = r \times EQMAX \times k1fwd \times fafd \times kgd \times kpr \quad (6\text{-}1)$$

Basic injection amount taupb of intake manifold injector 120 is calculated from the following formula:

$$taupb = k \times (1-r) \times EQMAX \times k1fwd \times fafp \times kgp \quad (6\text{-}2)$$

In the above formulas (6-1) and (6-2), r represents the injection sharing ratio (DI ratio), EQMAX represents the maximum injection amount, k1fwd represents the load factor, fafd and fafp represent the feedback coefficients in the stoichiometric state, kgd is the learned value of in-cylinder injector 110, kpr is the conversion coefficient corresponding to the fuel pressure, and kgp is the learned value of intake manifold injector 120.

In step S6430, engine ECU 300 determines whether DI ratio r is zero or not. When DI ratio r is zero (YES in S6430), the process proceeds to step S6440. If not (NO in S6430), the process proceeds to step S6460.

In step S6440, engine ECU 300 substitutes purge correction value fpg corresponding to the foregoing purged fuel amount for purge reduction calculation value fpgd of intake manifold injector 120. Also, engine ECU 300 substitutes 0 for purge reduction calculation value fpgd of in-cylinder injector 110. In step S6450, engine ECU 300 calculates final injection amount taup of intake manifold injector 120. This final injection amount taup of intake manifold injector 120 is calculated by the following formula:

$$taup=taupb-fpgp+tauv \quad (6\text{-}3)$$

where tauv is the invalid injection amount.

In step S6460, engine ECU 300 determines whether DI ratio r is equal to one or not. When DI ratio is equal to one (YES in S6460), the process proceeds to step S6470. If not (NO in S6460), the process proceeds to step S6500.

In step S6470, engine ECU 300 substitutes fpg for purge reduction calculation value fpgd of in-cylinder injector 110. It substitutes 0 for purge reduction calculation value fpgp of intake manifold injector 120.

In step S6480, engine ECU 300 calculates final injection amount taud of in-cylinder injector 110 according to the following formula:

$$taud=taudb-fpgd \quad (6\text{-}4)$$

The purge reduction calculation value can be summarized as follows:

$$\text{When DI ratio r is 1, fpgd=fpg (fpgp=0)} \quad (6\text{-}5)$$

$$\text{When DI ratio r is 0, fpgp=fpg (fpgd=0)} \quad (6\text{-}6)$$

In step S6500, engine ECU 300 performs processing of calculating the purge processing amount for the case in which the fuel injection is shared by in-cylinder injector 110 and intake manifold injector 120 (0<(DI ratio r)<1).

Figure 27:
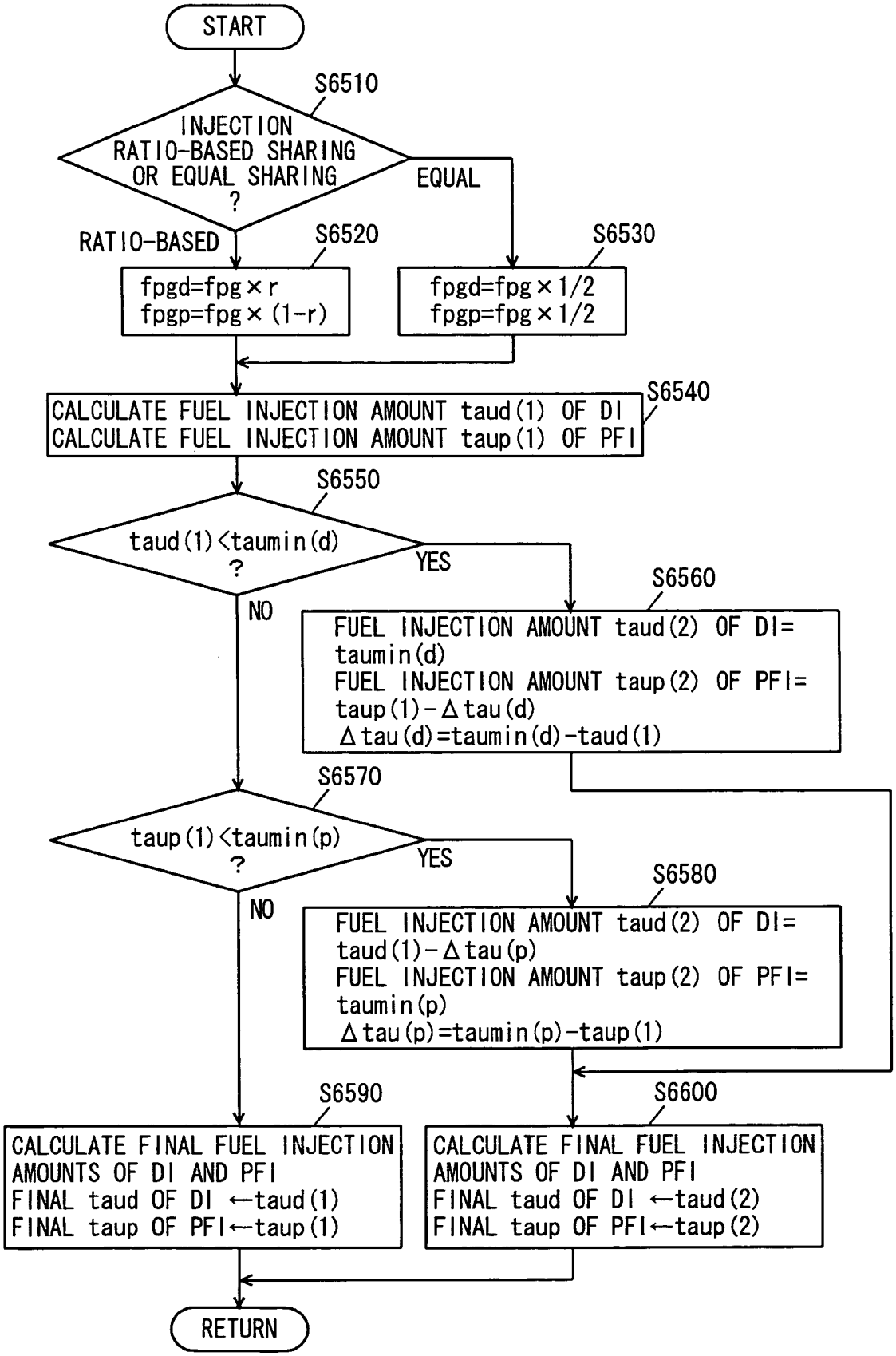

Referring to FIG. 27, description will now be given on the processing of calculating the purge processing amount in step S6500 illustrated in FIG. 26.

In step S6510, engine ECU 300 determines whether the in-cylinder injector 110 and intake manifold injector 120 share the purge processing according to a current fuel injection ratio or equally. For example, it is assumed that one of these sharing manners (injection ratio-based sharing and equal sharing) is preselected and stored in a memory. In the case of the injection ratio-based sharing ("RATIO-BASED" in step S6510), the process proceeds to step S6520. In the case of the equal sharing ("EQUAL" in S6510), the process proceeds to step S6530.

In step S6520, engine ECU 300 calculates purge reduction calculation values fpgd and fpgp of in-cylinder injector 110 and intake manifold injector 120 by the following formulas:

$$fpgd=fpg\times r \quad (6\text{-}7)$$

$$fpgp=fpg\times(1-r) \quad (6\text{-}8)$$

In step S6530, engine ECU 300 calculates purge reduction calculation values fpgd and fpgp of in-cylinder injector 110 and intake manifold injector 120 by the following formulas:

$$fpgd=fpg\times 1/2 \quad (6\text{-}9)$$

$$fpgp=fpg\times 1/2 \quad (6\text{-}10)$$

If sharing other than the equal sharing is allowed, the multiplier factor may be a constant other than ½.

In step S6540, engine ECU 300 calculates fuel injection amounts taud(1) and taup(1) of in-cylinder injector 110 and intake manifold injector 120 by the following formulas:

$$taud(1)=taudb-fpgd \quad (6\text{-}11)$$

$$taup(1)=taupb-fpgp+tauv \quad (6\text{-}12)$$

In step S6550, engine ECU 300 determines whether fuel injection amount taud(1) of in-cylinder injector 110 is smaller than minimum fuel injection amount taumin(d) of in-cylinder injector 110 or not. Minimum fuel injection amount taumin(d) is the minimum fuel injection amount that ensures the linearity in relationship between the fuel injection time and the injected fuel amount in in-cylinder injector 110. Thus, it is difficult to control the injection time such that the fuel of the amount smaller than minimum fuel injection amount taumin(d) may be injected. When fuel injection amount taud(1) of in-cylinder injector 110 is smaller than minimum fuel injection amount taumin(d) of in-cylinder injector 110 (YES in S6550), the process proceeds to step S6560. If not (NO in S6550), the process proceeds to step S6570.

In step S6560, engine ECU 300 calculates correction fuel injection amounts taud(2) and taup(2) of in-cylinder injector 110 and intake manifold injector 120 by the following formulas:

$$taud(2)=taumin(d) \quad (6\text{-}13)$$

$$taup(2)=taup(1)-\Delta tau(d) \quad (6\text{-}14)$$

$$\Delta tau(d)=taumin(d)-taud(1) \quad (6\text{-}15)$$

Then, the process proceeds to step S6600.

In step S6570, engine ECU 300 determines whether fuel injection amount taup(1) of intake manifold injector 120 is smaller than minimum fuel injection amount taumin(p) of intake manifold injector 120 or not. Minimum fuel injection amount taumin(p) is the minimum fuel injection amount that ensures the linearity in relationship between the fuel injection time and the injected fuel amount in intake manifold injector 120. Thus, it is difficult to control the injection time such that the fuel of the amount smaller than minimum fuel injection amount taumin(d) may be injected. When fuel injection amount taud(1) of intake manifold injector 120 is smaller than minimum fuel injection amount taumin(p) of intake manifold injector 120 (YES in S6570), the process proceeds to step S6580. If not (NO in S6570), the process proceeds to step S6590.

In step S6580, engine ECU 300 calculates correction fuel injection amounts taud(2) and taup(2) of in-cylinder injector 110 and intake manifold injector 120 by the following formulas:

$$taud(2)=taud(1)-\Delta tau(p) \quad (6\text{-}16)$$

$$taup(2)=taumin(p) \quad (6\text{-}17)$$

$$\Delta tau(p)=taumin(p)-taup(1) \quad (6\text{-}18)$$

Then, the process proceeds to step S6600.

In step S6590, engine ECU 300 calculates final fuel injection amounts taud and taup of in-cylinder injector 110 and intake manifold injector 120. In this calculation, taud(1) is substituted for final injection amount taud of in-cylinder injector 110, and taup(1) is substituted for final injection amount taup of intake manifold injector 120.

In step S6600, engine ECU 300 calculates final fuel injection amounts taud and taup of in-cylinder injector 110 and intake manifold injector 120. In this calculation, taud(2) is substituted for final injection amount taud of in-cylinder injector 110, and taup(2) is substituted for final injection amount taup of intake manifold injector 120.

Based on the foregoing structures and flowcharts, engine ECU 300, which is the control device according to this embodiment, executes the injection sharing control during the purge processing of engine 10, and this injection sharing control will now be described.

In the case where the control is effected on the injection sharing between in-cylinder injector 110 and intake manifold injector 120 (including the case of fuel injection by only one of the injectors) based on the predetermined map, when the purge processing is executed (YES in S6400), and the DI ratio r is 0 (YES in S6430), fpg is substituted for purge reduction calculation value fpgp (S6440), and purge reduction calculation value fpgp is subtracted from basic fuel injection amount taupb of intake manifold injector 120 to calculate final fuel injection amount taup of intake manifold injector 120 (S6450). When DI ratio r is 1 (NO in S6430, and YES in step S6460), fpg is substituted for purge reduction calculation value fpgd (S6470), and purge reduction calculation value fpgd is subtracted from basic fuel injection amount taudb of in-cylinder injector 110 to calculate final fuel injection amount taud of in-cylinder injector 110 (S6480).

When DI ratio r is neither 100% nor 0% (NO in S6430, NO in S6460), i.e., when the injection is shared between in-cylinder injector 110 and intake manifold injector 120 (0<DI ratio r<1.0), processing of calculating the purge processing amount is executed (S6500).

For sharing the purge reduction at DI ratio r ("RATIO-BASED" in step S6510), purge reduction calculation value fpgd of in-cylinder injector 110 is calculated by (fpg×r), and purge reduction calculation value fpgp of intake manifold injector 120 is calculated by (fpg×(1−r)) (S6520).

For equally sharing the purge reduction ("EQUAL" in S6510), purge reduction calculation value fpgd of in-cylinder injector 110 is calculated by (fpg×½), and purge reduction calculation value fpgp of intake manifold injector 120 is calculated by (fpg×½) (S6530).

By using purge reduction calculation value fpgd of in-cylinder injector 110 and purge reduction calculation value fpgp of intake manifold injector 120, fuel injection amount taud(1) of in-cylinder injector 110 is calculated by (taudb−fpgd), and fuel injection amount taup(1) of intake manifold injector 120 is calculated by (taupb−fpgp+tauv) (S6540).

Figure 28:
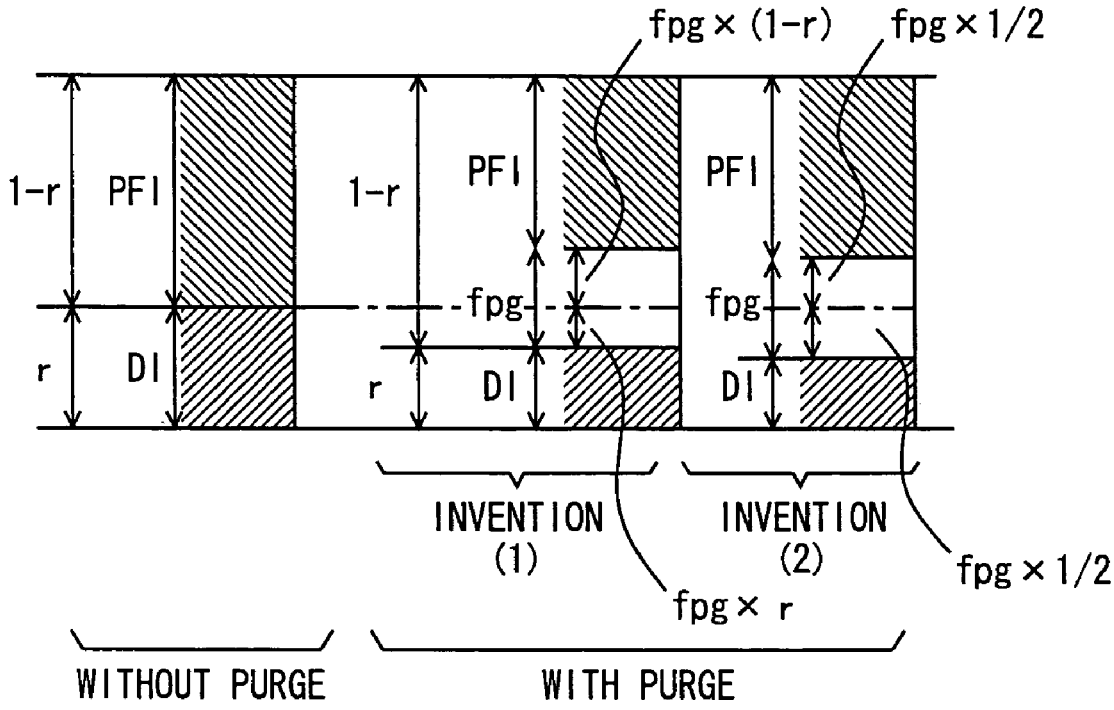
FIGS. 28 and 29 illustrate comparisons between fuel injection amounts in purge processing.

FIG. 28 illustrates the above state. In FIG. 28, "INVENTION (1) WITH PURGE" corresponds to the case where the purge reduction is shared at DI ratio r, and "INVENTION (2) WITH PURGE" corresponds to the case where the purge reduction is equally shared.

In either case, as illustrated in FIG. 28, the fuel injection amount of in-cylinder injector 110 is reduced by the purge correction amount corresponding to the purged fuel amount, and the fuel injection amount of intake manifold injector 120 is reduced by the purge correction amount. Therefore, each of the injectors (in-cylinder injector 110 and intake manifold injector 120) does not stop the fuel injection. As an effect achieved by using both the injectors for the purge processing, it is possible to ensure homogeneity in the air-fuel mixture injected from intake manifold injector 120. Also, it is possible to prevent excessive rising of the temperature of in-cylinder injector 110 so that production of deposits in the injection hole of in-cylinder injector 110 can be prevented.

Description will now be given on the case where fuel injection amount taud(1) of in-cylinder injector 110 and fuel injection amount taup(1) of intake manifold injector 120 are lower than minimum fuel injection amounts taumin(d) and taumin(p), respectively.

When fuel injection amount taud(1) of in-cylinder injector 110 is lower than minimum fuel injection amount taumin(d) of in-cylinder injector 110 (YES in S6550), the fuel injected from in-cylinder injector 110 becomes excessively small in amount unless changed, and it is impossible to inject accurately the fuel of injection amount taud(1). Therefore, the fuel injection amount of in-cylinder injector 110 is increased to minimum fuel injection amount taumin(d) of in-cylinder injector 110 to attain taud(2). In this operation, the fuel injection amount is raised by Δtau(d) equal to (taumin(d)−taud(1)), and fuel injection amount taud(2) of in-cylinder injector 110 attains minimum fuel injection amount taumin (d). Therefore, fuel injection amount taup(1) of intake manifold injector 120 is reduced by Δtau(d) equal to the above amount of raising to attain taup(2) equal to (taup(1)−Δtau (d)) (S6560).

Figure 29:
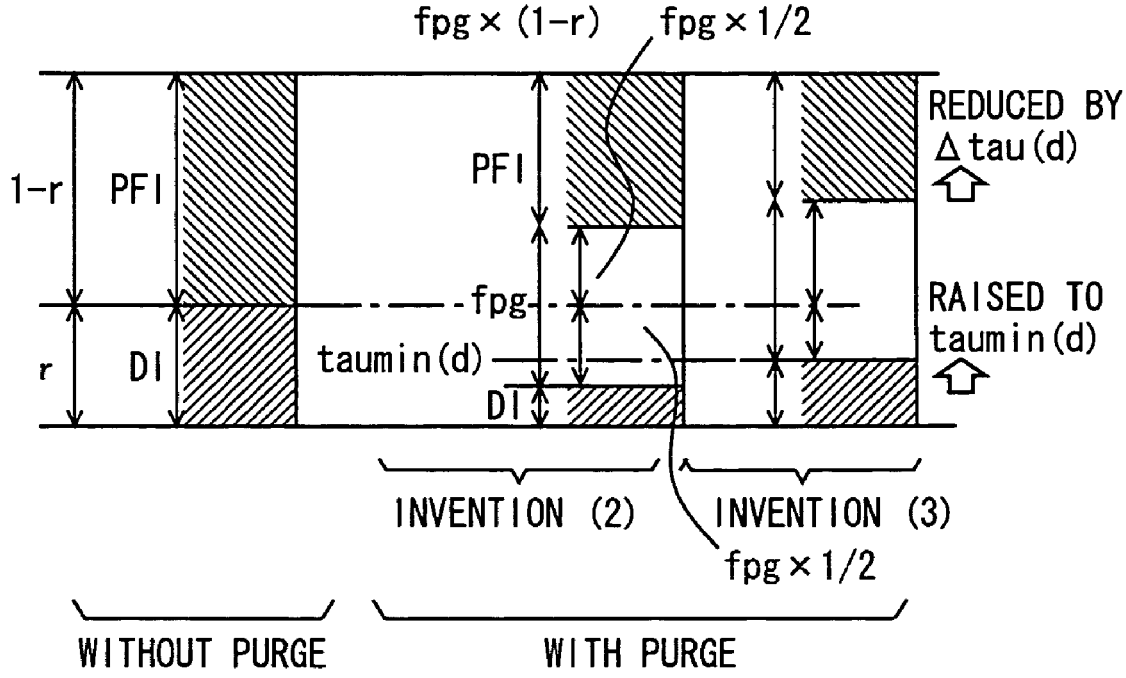

FIG. 29 illustrates the above state. In the case where the purge reduction amount is equally shared as represented by "INVENTION (2) WITH PURGE" in FIG. 29, when DI ratio r is small, and purge correction value fpg corresponding to the purged fuel amount is large, fuel injection amount taud(1) of in-cylinder injector 110 is lower than minimum fuel injection amount taumin(p) of in-cylinder injector 110. Therefore, as represented by "INVENTION (3) WITH PURGE", the fuel injection amount of in-cylinder injector 110 is raised to minimum fuel injection amount taumin(d), and fuel injection amount taup(1) of intake manifold injector 120 is reduced by an amount Δtau(d) of the raising to attain taup(2).

When fuel injection amount taup(1) of intake manifold injector 120 is lower than minimum fuel injection amount taumin(p) of intake manifold injector 120 (YES in S6570), the fuel injected from intake manifold injector 120 is excessively small in amount unless changed, and it is impossible to inject accurately the fuel of fuel injection amount taup(1). Therefore, the fuel injection amount of intake manifold injector 120 is increased to minimum fuel injection amount taumin(p) of intake manifold injector 120 to attain taup(2). In this operation, the fuel injection amount is raised by Δtau(p) equal to (taumin(p)−taup(1)), and fuel injection amount taup(2) of intake manifold injector 120 attains minimum fuel injection amount taumin(p). Therefore, fuel injection amount taud(1) of in-cylinder injector 110 is reduced by Δtau(p) equal to the amount of the raising, and attains taud(2) equal to (taud(1)−Δtau(p)) (S6580).

As described above, when the purge processing effected on the injectors reduces the fuel injection amount of one of the injectors below the minimum fuel injection amount, the fuel injection amount of the injection thus reduced is raised to the minimum fuel injection amount, and the fuel injection amount of the other injector, which is already reduced by the purge processing, is further reduced by an additional amount. Thereby, the purge processing can be executed in the region having the linearity in the relationship between the fuel injection time and the fuel injection amount. Therefore, the fuel can be accurately supplied to execute the accurate air-fuel ratio control. When the purge processing is executed in both injectors, the effects as described above are achieved.

<Engine (1) Suitable for Employing the Control Device>

Description will now be given on an engine (1), which can suitably employ the control devices according to the first to sixth embodiments described above.

Figure 30:
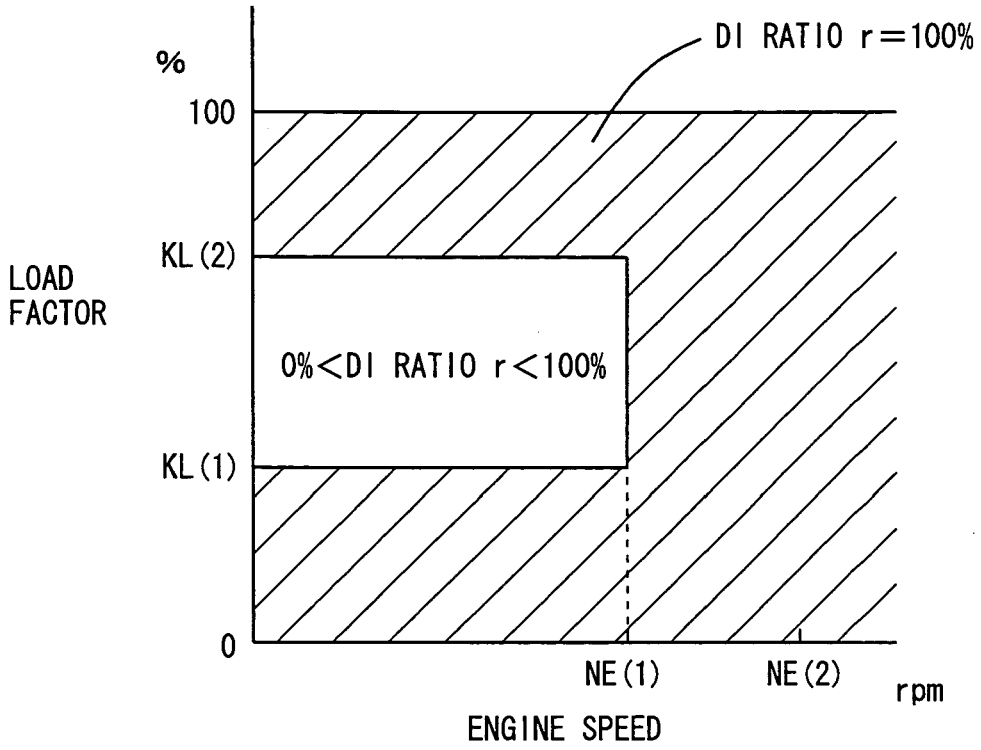
FIGS. 30 and 32 illustrate DI ratio maps in a warm state of an engine, which can appropriately employ the control device according to the embodiment of the invention.
Figure 31:
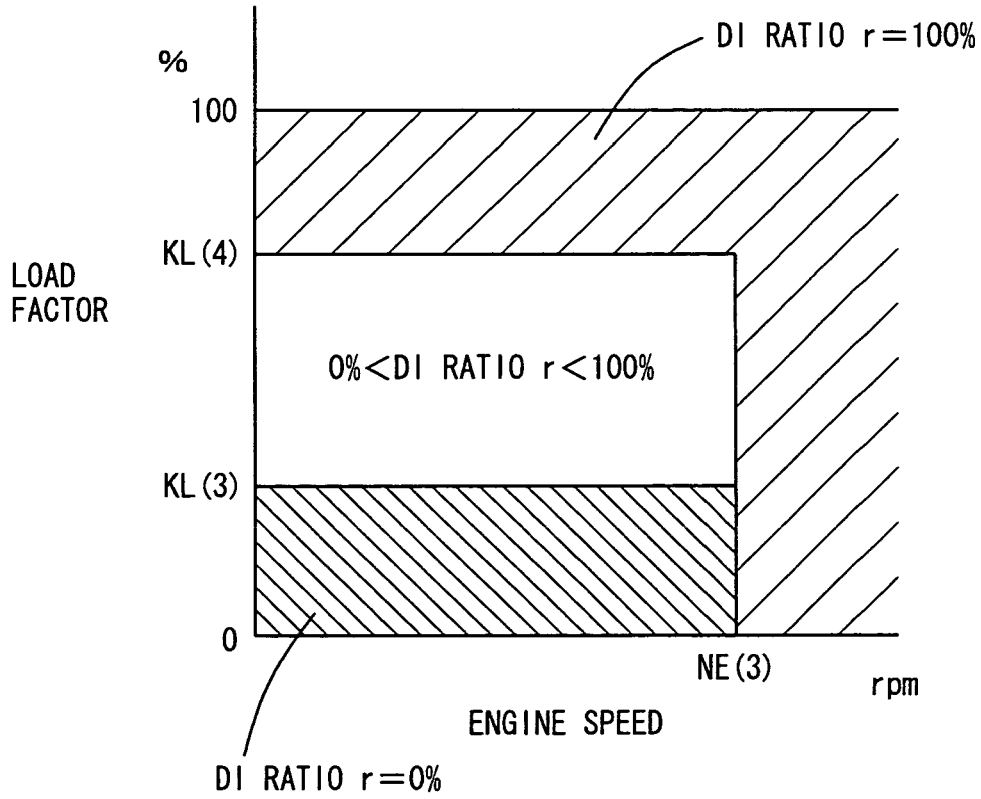
FIGS. 31 and 33 illustrate DI ratio maps in a cold state of an engine, which can appropriately employ the control device according to the embodiment of the invention.

Referring to FIGS. 30 and 31, description will now be given on information corresponding to the operation state of engine 10, and particularly on the map representing the injection sharing ratio (i.e., DI ratio r) between in-cylinder injector 110 and intake manifold injector 120. This map is stored in ROM 320 of engine ECU 300. FIG. 30 is a map for a warm state of engine 10, and FIG. 31 is a map for a cold state of engine 10.

In the maps illustrated in FIGS. 30 and 31, the abscissa gives an engine speed of engine 10, the ordinate gives a load factor, and the DI ratio r, i.e., the sharing ratio of in-cylinder injector 110 is represented as a percentage.

As illustrated in FIGS. 30 and 31, DI ratio r is set for each operation region determined by the engine speed and the load factor of engine 10. "DI RATIO r=100%" represents a region in which only in-cylinder injector 110 performs the fuel injection. "DI RATIO r=0%" represents a region in which only intake manifold injector 120 performs the fuel injection. "DI RATIO r≠0%", "DI RATIO r≠100%" and "0%<DI RATIO r<100%" represent regions in which in-cylinder injector 110 and intake manifold injector 120 share the fuel injection. Schematically, in-cylinder injector 110 contributes to the rising of output performance, and intake manifold injector 120 contributes to the uniformity in air-fuel mixture. These two kinds of injectors having different characteristics are appropriately selected depending on the engine speed and load factor so that only homogenous combustion can be performed in the normal operation state of engine 10, i.e., in the state other than the abnormal operation state such as a catalyst warm-up state during idling.

As illustrated in FIGS. 30 and 31, sharing ratio (DI ratio) r between in-cylinder injector 110 and intake manifold injector 120 is defined in each of the maps representing the warm state and the cold state, respectively. The maps are configured such that a different control region is used for in-cylinder injector 110 and intake manifold injector 120 when the temperature of engine 10 changes. The temperature of engine 10 is detected, and the map of the warm state in FIG. 30 is selected when the temperature of engine 10 is equal to or higher than a predetermined temperature threshold. Otherwise, the map of the cold state in FIG. 31 is selected. Based on the maps thus selected, in-cylinder injector 110 and/or intake manifold injector 120 are controlled according to the engine speed and the load factor of engine 10.

Description will now be given on the engine speed and the load factor of engine 10 represented in FIGS. 30 and 31. In FIG. 30, NE(1) is set to 2500–2700 rpm, KL(1) is set to 30–50%, and KL(2) is set to 60–90%. In FIG. 31, NE(3) is set to 2900–3100 rpm. Thus, NE(1) is smaller than NE(3). NE(2) in FIG. 30 as well as KL(3) and KL(4) in FIG. 31 are appropriately determined.

From a comparison between FIGS. 30 and 31, it can be seen that NE(3) in the cold state map of FIG. 31 is higher than NE(1) in the warm state map of FIG. 30. This means that the lower temperature of engine 10 expands the control region of intake manifold injector 120 to a higher engine speed. That is, cold engine 10 can suppress production of deposits in the injection hole of in-cylinder injector 110 (even when in-cylinder injector 110 does not inject the fuel). Therefore, it is possible to achieve the setting that expands the region of performing the fuel injection by intake manifold injector 120, and the homogeneity can be improved.

From the comparison between FIGS. 30 and 31, when the engine speed of engine 10 is in a region equal to or higher than NE(1) on the warm state map, or is in a region equal to or higher than NE(3) on the cold state map, the relationship of "DI RATIO r=100%" is attained. When the load factor is in a region equal to or higher than KL(2) on the warm state map, or is in a region equal to or higher than KL(4) on the cold state map, the relationship of "DI RATIO r=100%" is attained. These mean that only in-cylinder injector 110 is used in the predetermined high engine speed region, and only in-cylinder injector 110 is used in the predetermined high engine load region. This is allowed because, in the high speed region or high load region, even when only in-cylinder injector 110 injects the fuel, it can produce the homogenous air-fuel mixture because the engine speed and load of engine 10 are high and thus the intake air volume is large. In the above manner, the fuel injected from in-cylinder injector 110 obtains latent heat of vaporization in the combustion chamber (i.e., takes in the heat from the combustion chamber), and thereby vaporizes. This lowers the temperature of the air-fuel mixture at the compression end so that antiknock performance is improved. Since the temperature of the combustion chamber decreases, the intake efficiency is improved to attain high power.

According to the warm state map of FIG. 30, only in-cylinder injector 110 is used when the load factor is equal to or lower than KL(1). This represents that only in-cylinder injector 110 is used in a predetermined low load region when the temperature of engine 10 is high. In the warm state, engine 10 is warm so that deposits are liable to occur in the injection hole of in-cylinder injector 110. However, the fuel injected by in-cylinder injector 110 can lower the injection hole temperature so that the occurrence of deposits can be avoided. Also, the minimum fuel injection amount of the in-cylinder injector can be ensured to prevent clogging of in-cylinder injector 110. For achieving these effects, in-cylinder injector 110 is used in the low load region as described above.

From the comparison between FIGS. 30 and 31, the region of "DI RATIO r=0%" is present in only the cold state map of FIG. 31. This represents that only intake manifold injector 120 is used in a predetermined low load region (equal to or lower than KL(3)) when the temperature of engine 10 is low. Since engine 10 is cold, the load of engine 10 is low and the intake air flow rate is small so that the vaporization of fuel is relatively suppressed. In this region, the fuel injection of in-cylinder injector 110 is difficult to achieve good combustion, and a high output by in-cylinder injector 110 is not required particularly in the region of a low load and a low engine speed. For these reasons, in-cylinder injector 110 is not used, and only intake manifold injector 120 is used.

In the operation other than the normal operation, i.e., in the abnormal state such as a catalyst warm-up state during idling, in-cylinder injector 110 is controlled to perform the stratified charge combustion. By performing the stratified charge combustion only during the catalyst warm-up state, the catalyst warm-up is promoted to improve emissions.

<Engine (2) Suitable for Employing the Control Device>

Description will now be given on an engine (2), which can suitably employ the control devices according to the first to sixth embodiments described above. In the following description of the engine (2), description of the same portions as those of the engine (1) is not repeated.

Figure 32:
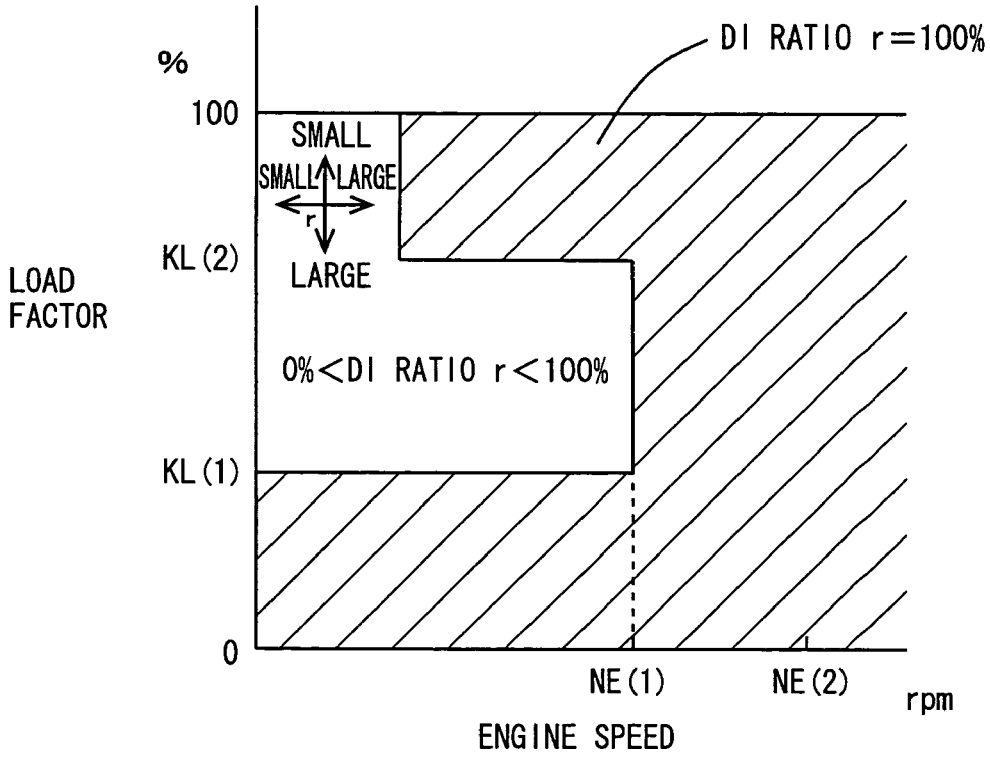
Figure 33:
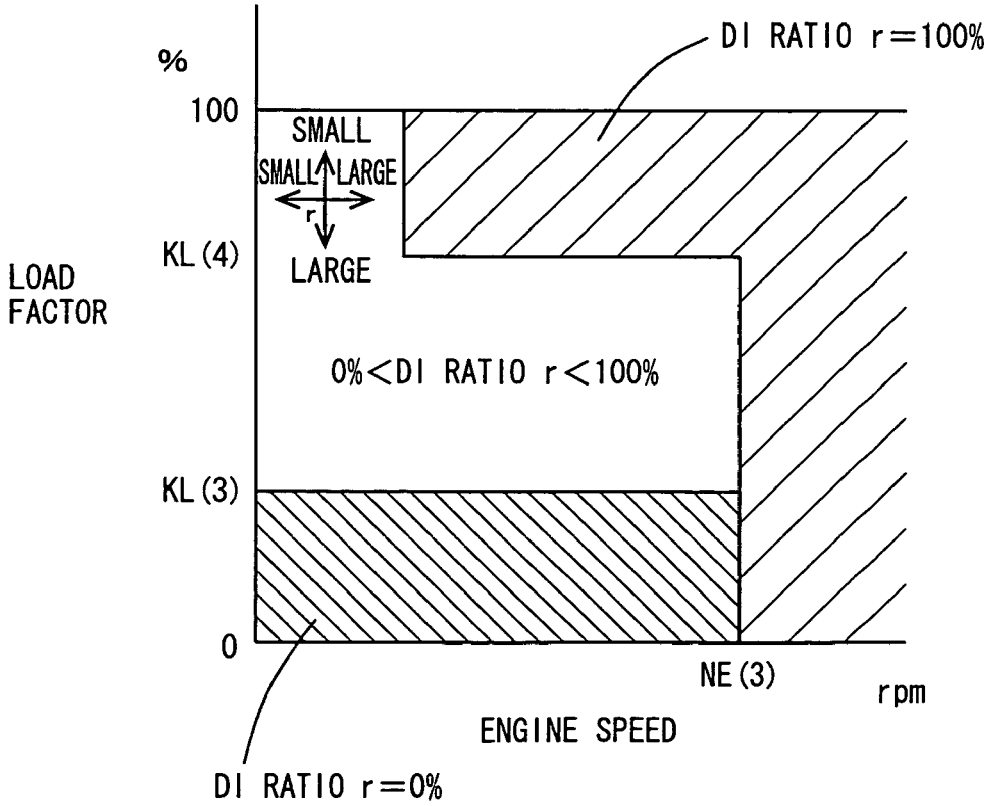

Referring to FIGS. 32 and 33, description will now be given on the map representing information corresponding to the operation state of engine 10, and particularly representing the injection sharing ratio between in-cylinder injector 110 and intake manifold injector 120. This map is stored in ROM 320 of engine ECU 300. FIG. 32 is a map for the warm state of engine 10, and FIG. 33 is a map for the cold state of engine 10.

FIGS. 32 and 33 differ from FIGS. 30 and 31 in the following points. "DI RATIO r=100%" is achieved in the region of the engine speed of engine 10 equal to or higher than NE(1) on the warm state map, and is achieved in the region of the engine speed equal to or higher than NE(3) on the cold state map. "DI RATIO r=100%" is achieved in the region of the load factor equal to or higher than KL(2) on the warm state map other than the low engine speed region, and is also achieved in the region of the load factor equal to or higher than KL(4) on the cold state map other than the low engine speed region. This represents that only in-cylinder injector 110 is used in a predetermined region of a high engine speed, and only in-cylinder injector 110 is used in a large predetermined region of a high engine load. However, in a high load region within a low engine speed region, the fuel injected from in-cylinder injector 110 does not form the air-fuel mixture in a sufficiently mixed state, and the air-fuel mixture in the combustion chamber is liable to be inhomogeneous and to cause instable combustion. For preventing this problem, the control is performed to increase the injection ratio of the in-cylinder injector as the engine speed changes to a higher side. Also, as the operation changes to the high load region, in which the above problem may occur, the control is performed to decrease the injection ratio of in-cylinder injector 110. In FIGS. 32 and 33, these changes in DI ratio r are indicated by double-head arrows in a cross arrangement. The above control can suppress fluctuations in output torque of the engine, which may occur due to instable combustion. For confirmation, it can be stated that above control is substantially equivalent to the control of decreasing the injection ratio of in-cylinder injector 110 in accordance with the change into the predetermined low engine speed region, and to the control of increasing the injection ratio of in-cylinder injector 110 in accordance with the change into the predetermined low-load region. Even when only in-cylinder injector 110 is used, it can easily homogenize the air-fuel mixture in regions other than the above regions (in which double-headed arrows are depicted in a cross arrangement in FIGS. 32 and 33), and more specifically, in the regions on the high speed side and low load side where only in-cylinder injector 110 performs the fuel injection. Thereby, the fuel injected from in-cylinder injector 110 obtains latent heat of vaporization in the combustion chamber (i.e., takes in the heat from the combustion chamber) to vaporize. This lowers the temperature of the air-fuel mixture at the compression end so that antiknock performance is improved. Since the temperature of the combustion chamber decreases, the intake efficiency can be improved to attain high power.

In engine 10 explained with reference to FIGS. 30 to 33, the homogenous combustion is achieved by setting the fuel injection timing of in-cylinder injector 110 in the intake stroke, and the stratified charge combustion is achieved by setting the fuel injection timing of in-cylinder injector 110 in the compression stroke. Thus, by setting the fuel injection timing of in-cylinder injector 110 in the compression stroke, a rich air-fuel mixture can be locally located around a spark plug, and thereby a lean air-fuel mixture in the combustion chamber as a whole can be ignited so as to achieve stratified charge combustion. Even when the injection of in-cylinder injector 110 is performed in the intake stroke, the stratified charge combustion can be achieved if it is possible to locate locally the rich air-fuel mixture around the spark plug.

The stratified charge combustion herein includes both the stratified charge combustion and weak stratified charge combustion. The weak stratified charge combustion is performed such that intake manifold injector 120 injects the fuel in the intake stroke to form a lean and homogenous air-fuel mixture in the whole combustion chamber, and in-cylinder injector 110 injects the fuel in the compression stroke to form the rich air-fuel mixture around the spark plug for improving the combustion state. The weak stratified charge combustion is preferable in the catalyst warm-up operation for the following reasons. In the catalyst warm-up operation, the ignition timing must be significantly delayed in angle so that the hot combustion gas may reach the catalyst and thereby the good combustion state (idle state) may be maintained. Also, a certain amount of fuel must be supplied. For satisfying the above requirements by the stratified charge combustion, such a problem occurs that the fuel amount is small. For satisfying the above requirements by the homogenous combustion, such a problem occurs that the retarded angle for maintaining good combustion is smaller than that in the stratified charge combustion. In view of them, it is preferable to use the weak stratified charge combustion in the catalyst warm-up operation, although either one of the stratified charge combustion and weak stratified charge combustion may be employed.

In the engines described with reference to FIGS. 30–33, it is preferable that the fuel injection timing of in-cylinder injector 110 is set in the compression stroke for the following reasons. Meanwhile, according to the engine 10 described above, the fuel injection timing of in-cylinder injector 110 is set in the intake stroke within a basic or major region, i.e., in a region except for the region of the weak stratified charge combustion, which is performed only in the catalyst warm-up operation by injecting the fuel from intake manifold injector 120 in the intake stroke and injecting the fuel from in-cylinder injector 110 in the compression stroke. However, the fuel injection timing of in-cylinder injector 110 may be set temporarily in the compression stroke for the purpose of stabilizing the combustion in view of the following reasons.

By setting the fuel injection timing of in-cylinder injector 110 in the compression stroke, the fuel injection cools the air-fuel mixture when the temperature in the cylinder is relatively high. Thereby, the cooling effect is improved, and the antiknock performance is improved. Further, when the fuel injection timing of in-cylinder injector 110 is set in the compression stroke, the time from the fuel injection to the ignition is short, so that the injection can enhance a stream of the mixture to increase the combustion rate. By virtue of the improvement of the antiknock performance and increase in combustion rate, the combustion fluctuations can be avoided, and the combustion stability can be improved.

Independently of the temperature of engine 10 (i.e., in both of the warm and cold states), the warm state map in FIG. 30 or 32 may be used during off-idling (i.e., when an idle switch is off, or an accelerator pedal is pressed down), and thus in-cylinder injector 110 is used in the low load region whether in the warm state or in the cold state.

The maps in FIGS. 30–33 can be used in addition to or instead of the map in FIG. 2.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control device of an internal combustion engine including a first fuel injection mechanism for injecting fuel into a cylinder, and a second fuel injection mechanism for injecting the fuel into an intake manifold, and being configured to execute purge processing of fuel vapor, comprising:

a control unit for controlling the fuel injection mechanisms to inject the fuel by sharing the injection between said first fuel injection mechanism and said second fuel injection mechanism according to conditions required in said internal combustion engine; and a purge control unit for controlling the fuel injection mechanisms to correct a fuel injection amount corresponding to an introduced purged fuel amount during execution of said purge processing by sharing the correction between said first and second fuel injection mechanisms, wherein said purge control unit corrects the fuel injection amount corresponding to the introduced purged fuel amount by causing the fuel injection mechanisms to share the correction according to a sharing ratio between said first and second fuel injection mechanisms, and said purge control unit performs control such that a basic fuel injection amount corresponding to the sharing ratio of each of said first and second fuel injection mechanisms is reduced by an amount depending on the sharing ratio and a fuel injection correction amount corresponding to the introduced purged fuel amount.

2. The control device of the internal combustion engine according to claim 1, wherein when the fuel injection amount reduced by said amount is smaller than a minimum fuel injection amount of one of said first and second fuel injection mechanisms, a fuel injection amount restricted by said minimum fuel injection amount is distributed to the other of said first and second fuel injection mechanisms.

3. The control device of the internal combustion engine according to claim 1, wherein said control device further includes a correction unit for correcting a sharing ratio of correction of said fuel injection amount according to fuel injection timing of said first fuel injection mechanism.

4. The control device of the internal combustion engine according to claim 3, wherein said correction unit modifies the sharing ratio of the correction of said fuel injection amount such that the sharing ratio of the correction of said fuel injection amount of said first fuel injection mechanism decreases as timing of the fuel injection from said first fuel injection mechanism becomes closer to a compression top dead center in a compression stroke region.

5. The control device of the internal combustion engine according to claim 1, wherein said control device includes a correct unit for correcting the fuel injection amount by an amount corresponding to a deviation of the air-fuel ratio by performing injection from said first fuel injection mechanism when an emission air-fuel ratio rapidly changes with respect to a target air-fuel ratio.

6. The control device of the internal combustion engine according to claim 1, wherein said purge control unit corrects the fuel injection amount corresponding to said introduced purged fuel amount by the injection from only said second fuel injection mechanism during a transient operation.

7. The control device of the internal combustion engine according to claim 1, wherein said first fuel injection mechanism is an in-cylinder injector, and said second fuel injection mechanism is an intake manifold injector.

8. A control device of an internal combustion engine including a first fuel injection mechanism for injecting fuel into a cylinder, and a second fuel injection mechanism for injecting the fuel into an intake manifold, and being configured to execute purge processing of fuel vapor, comprising:

a control unit for controlling the fuel injection mechanisms to inject the fuel by sharing the injection between said first fuel injection mechanism and said second fuel injection mechanism according to conditions required in said internal combustion engine; and a purge control unit for controlling the fuel injection mechanisms to correct a fuel injection amount corresponding to an introduced purged fuel amount during execution of said purge processing by using at least one of said first and second fuel injection mechanisms, wherein said purge control unit controls said fuel injection mechanisms to ensure a normal operation of said first fuel injection mechanism in a region of the fuel injection shared by said first and second fuel injection mechanisms, and said purge control unit controls the fuel injection mechanisms such that a ratio of correction using said second fuel injection mechanism is larger than a ratio of correction using said first fuel injection mechanism.

9. The control device of the internal combustion engine according to claim 8, wherein said purge control unit controls the fuel injection mechanisms such that said second fuel injection mechanism is used for the correction, and the fuel injection amount of said first fuel injection mechanism does not change.

10. The control device of the internal combustion engine according to claim 8, wherein the purge control unit controls the fuel injection mechanisms such that the correction using said first fuel injection mechanism is not performed until an amount of correction using said second fuel injection mechanism exceeds a maximum correction amount.

11. A control device of an internal combustion engine including a first fuel injection mechanism for injecting fuel into a cylinder, and a second fuel injection mechanism for injecting the fuel into an intake manifold, and being configured to execute purge processing of fuel vapor, comprising:

a control unit for controlling the fuel injection mechanisms to inject the fuel by sharing the injection between said first fuel injection mechanism and said second fuel injection mechanism according to conditions required in said internal combustion engine; and an adjusting unit for adjusting the purged fuel amount, wherein said adjusting unit adjusts said purged fuel amount corresponding to a change of a state caused by said control unit from the state of injecting the fuel from said second fuel injection mechanism to the state of not injecting the fuel, or from the state of not injecting the fuel from said second fuel injection mechanism to the state of injecting the fuel.

12. The control device of said internal combustion engine according to claim 11, wherein said adjusting unit reduces said purged fuel amount corresponding to said change of the state.

13. The control device of the internal combustion engine according to claim 11, wherein said adjusting unit adjusts the purged fuel amount to zero corresponding to said change of the state.

14. The control device of the internal combustion engine according to claim 11, wherein said adjusting unit adjusts said purged fuel amount corresponding to said change of the state and based on the operation state of said internal combustion engine.

15. The control device of the internal combustion engine according to claim 11, wherein said adjusting unit adjusts said purged fuel amount until a predetermined time elapses after said change of the state.

16. The control device of the internal combustion engine according to claim 15, wherein said adjusting unit performs the adjustment by gradually changing said purged fuel amount to return to a desired purged fuel amount after said predetermined time elapses.

17. The control device of the internal combustion engine according to claim 11, further comprising:

a unit for causing said first or second fuel injection mechanism to complement the fuel by an amount corresponding to the purged fuel amount adjusted by said adjusting unit.

18. A control device of an internal combustion engine including a first fuel injection mechanism for injecting fuel into a cylinder, and a second fuel injection mechanism for injecting the fuel into an intake manifold, and being configured to execute purge processing of fuel vapor, comprising:

a control unit for controlling the fuel injection mechanisms to inject the fuel by sharing the injection between said first fuel injection mechanism and said second fuel injection mechanism according to conditions required in said internal combustion engine; and a purge control unit for controlling the fuel injection mechanisms to correct a fuel injection amount corresponding to an introduced purged fuel amount during execution of said purge processing by sharing the correction between said first and second fuel injection mechanisms, wherein said purge control unit provides a limited value in the reduction for the purge correction by said second fuel injection mechanism in a region of the fuel injection shared by said first and second fuel injection mechanisms, and said purge control unit calculates said limit value such that fluctuations in combustion do not occur even when a difference is present in introduced purged fuel amount between the cylinders.

19. The control device of the internal combustion engine according to claim 18, wherein said purge control unit provides a limit value in the reduction performed for the purge correction by said second fuel injection mechanism when the value calculated based on the ratio of the purge correction amount with respect to the basic fuel injection amount of said second fuel injection mechanism is equal to or larger than the predetermined value.

20. The control device of the internal combustion engine according to claim 19, wherein said predetermined value is calculated from a function of the sharing ratios of said first and second fuel injection mechanisms.

21. The control device of the internal combustion engine according to claim 20, wherein said function increases said predetermined value with decrease in sharing ratio of said second fuel injection mechanism, and said purge control unit calculates the purge correction amount in said first fuel injection mechanism by subtracting a second value obtained by multiplying the basic fuel injection amount of said second fuel injection mechanism by said predetermined value from a first value calculated based on the purge correction amount.

22. The control device of the internal combustion engine according to claim 18, wherein said purge control unit controls the fuel injection mechanisms by using a correction amount calculated to limit more strongly the reduction for the purge correction by said second fuel injection mechanism with decrease in sharing ratio of said second fuel injection mechanism.

23. The control device of the internal combustion engine according to claim 18, wherein said purge control unit controls the fuel injection mechanisms to achieve the correction amount exceeding said limit value by using said first fuel injection mechanism.

24. A control device of an internal combustion engine including a first fuel injection mechanism for injecting fuel into a cylinder, and a second fuel injection mechanism for injecting the fuel into an intake manifold, and being configured to execute purge processing of fuel vapor, comprising:

a control unit for controlling the fuel injection mechanisms to inject the fuel by sharing the injection between said first fuel injection mechanism and said second fuel injection mechanism according to conditions required in said internal combustion engine; and a purge control unit for controlling the fuel injection mechanisms to correct a fuel injection amount corresponding to an introduced purged fuel amount during execution of said purge processing by sharing the correction between said first and second fuel injection mechanisms, wherein said purge control unit controls the fuel injection mechanisms to perform the correction of the fuel injection amount corresponding to said purged fuel amount by changing the fuel injection amounts of both of said first and second fuel injection mechanisms in a region of the fuel injection shared by said first and second fuel injection mechanisms without falling below a minimum fuel injection amount of each fuel injection mechanism.

25. The control device of the internal combustion engine according to claim 24, wherein said purge control unit controls the fuel injection mechanisms such that the fuel injection amount corrected in said first fuel injection mechanism is equal to the fuel injection amount corrected in said second fuel injection mechanism.

26. The control device of the internal combustion engine according to claim 24, wherein said purge control unit controls the fuel injection mechanisms such that the fuel injection amount of said first fuel injection mechanism and the fuel injection amount of said second fuel injection mechanism are corrected in accordance with a ratio of sharing of the fuel injection between said first fuel injection mechanism and said second fuel injection mechanism.

27. The control device of the internal combustion engine according to claim 24, wherein said purge control unit controls the fuel injection mechanisms such that a ratio of sharing of the fuel injection between said first and second fuel injection mechanisms remains unchanged for the whole fuel supply amount including said purged fuel amount.

28. The control device of the internal combustion engine according to claim 24, wherein said purge control unit controls the fuel injection mechanisms to correct the fuel injection amounts corresponding to said purged fuel amount such that linearity of the injection amount with respect to an injection time is ensured in each of said first fuel injection mechanism and said second fuel injection mechanism.

29. The control device of the internal combustion engine according to claim 28, wherein said purge control unit controls the fuel injection mechanisms such that, when the linearity may not be ensured in the injection amount with respect to the injection time of said first fuel injection mechanism, the fuel injection amount is corrected corresponding to said purged fuel amount within a range capable of ensuring said linearity, and said second fuel injection mechanism corrects the fuel injection amount by an amount corresponding to a shortage.

* * * * *